US012703593B2

(12) United States Patent
Shuto et al.

(10) Patent No.: US 12,703,593 B2
(45) Date of Patent: Aug. 11, 2026

(54) MEDIUM FEEDING APPARATUS AND IMAGE READING APPARATUS

(71) Applicant: SEIKO EPSON CORPORATION, Tokyo (JP)

(72) Inventors: Ryoichi Shuto, Kitakyushu (JP); Kazuhito Noda, Shiojiri (JP); Kiyotaka Nakamura, Kitakyushu (JP); Takayuki Shiota, Kitakyushu (JP)

(73) Assignee: Seiko Epson Corporation, Tokyo (JP)

( * ) Notice: Subject to any disclaimer, the term of this patent is extended or adjusted under 35 U.S.C. 154(b) by 43 days.

(21) Appl. No.: 18/163,052

(22) Filed: Feb. 1, 2023

(65) Prior Publication Data

US 2023/0242360 A1 Aug. 3, 2023

(30) Foreign Application Priority Data

Feb. 2, 2022 (JP) ..... 2022-014755
Feb. 2, 2022 (JP) ..... 2022-014756

(51) Int. Cl.
*B65H 3/52* (2006.01)
*B65H 3/06* (2006.01)
(Continued)

(52) U.S. Cl.
CPC ..... *B65H 3/5215* (2013.01); *B65H 3/06* (2013.01); *B65H 3/0661* (2013.01);
(Continued)

(58) Field of Classification Search
CPC ..... B65H 3/06; B65H 3/0661; B65H 3/5207; B65H 3/5215; B65H 3/5261; B65H 3/66;
(Continued)

(56) References Cited

U.S. PATENT DOCUMENTS 11,597,617 B2 3/2023 Namiki et al.
2008/0309000 A1* 12/2008 Tu ..... B65H 3/0684 271/109
(Continued)

FOREIGN PATENT DOCUMENTS

CN 112573254 3/2021
JP 2009091143 4/2009
(Continued)

*Primary Examiner* — Prasad V Gokhale
(74) *Attorney, Agent, or Firm* — WORKMAN NYDEGGER

(57) ABSTRACT

A medium feeding apparatus includes a medium supporting portion supporting a medium, a feeding roller that feeds the medium, a separation portion configured to advance and retreat with respect to the feeding roller, a path forming member that is a member positioned upstream in a medium feeding direction with respect to a contact position between the feeding roller and the separation portion, that is configured to advance and retreat with respect to the feeding roller, and that is configured to narrow a medium feeding path directed toward the contact position, and a first pressing portion pressing the path forming member toward the feeding roller, in which the path forming member displaces the separation portion in a direction away from the feeding roller when the path forming member is pushed down in a direction retreating from the feeding roller by a medium having a thickness exceeding a predetermined thickness.

18 Claims, 38 Drawing Sheets

(51) Int. Cl.
*B65H 3/56* (2006.01)
*B65H 3/66* (2006.01)
*B65H 5/06* (2006.01)

(52) U.S. Cl.
CPC ..... *B65H 3/5261* (2013.01); *B65H 3/56* (2013.01); *B65H 3/66* (2013.01); *B65H 5/06* (2013.01); *B65H 2404/1441* (2013.01)

(58) Field of Classification Search
CPC ..... B65H 3/68; B65H 2404/144; B65H 2404/1441; B65H 2511/13
See application file for complete search history.

(56) References Cited

U.S. PATENT DOCUMENTS

| | | | | |
|---|---|---|---|---|
| 2014/0197593 | A1* | 7/2014 | Machii | B65H 5/062 271/121 |
| 2019/0135564 | A1 | 5/2019 | Machida | |
| 2019/0270604 | A1* | 9/2019 | Morikawa | B65H 5/062 |
| 2020/0071100 | A1 | 3/2020 | Namiki et al. | |
| 2021/0099592 | A1 | 4/2021 | Nishimura | |
| 2023/0095138 | A1* | 3/2023 | Shuto | H04N 1/00628 271/264 |
| 2024/0025685 | A1* | 1/2024 | Namiki | B65H 3/56 |

FOREIGN PATENT DOCUMENTS

| | | |
|---|---|---|
| JP | 2016179872 | 10/2016 |
| JP | 2020037483 | 3/2020 |
| JP | 2023-050488 | 4/2023 |
| WO | 2017/209174 | 12/2017 |
| WO | 2018/116365 | 6/2018 |

* cited by examiner

MEDIUM FEEDING APPARATUS AND IMAGE READING APPARATUS

The present application is based on, and claims priority from JP Application Serial Number 2022-014755, filed Feb. 2, 2022, and JP Application Serial Number 2022-014756, filed Feb. 2, 2022, the disclosures of which are hereby incorporated by reference herein in their entirety.

BACKGROUND

1. Technical Field

The present disclosure relates to a medium feeding apparatus that feeds a medium and an image reading apparatus that includes the same.

2. Related Art

There is a sheet feed type scanner as an example of an image reading apparatus, and in such an image reading apparatus, a configuration in which media are nipped and separated by a separation roller and a feeding roller may be adopted. In a scanner described in International Publication No. 2017/209174, a separation roller is provided to be capable of advancing and retreating with respect to a paper feeding roller. A paper feeding roller guide is provided upstream of a contact position between the separation roller and the paper feeding roller, and the paper feeding roller guide prevents a front end of a document that is set from being caught by the feeding roller.

In some scanners, not only a document having a sheet shape but also a document having a booklet shape is transported. The thickness of the document having a booklet shape is thick, and even when the document having a booklet shape is inserted toward the contact position between the separation roller and the paper feeding roller, there is a possibility that the document hits against an outer peripheral surface of the separation roller and cannot be fed.

SUMMARY

According to an aspect of the present disclosure, there is provided a medium feeding apparatus including: a medium supporting portion supporting a medium; a feeding roller that comes into contact with an upper surface of the medium supported by the medium supporting portion; a separation portion disposed to face the feeding roller and configured to advance and retreat with respect to the feeding roller; a path forming member that is a member positioned upstream in a medium feeding direction with respect to a contact position between the feeding roller and the separation portion, that is configured to advance and retreat with respect to the feeding roller in accordance with a thickness of the medium, and that is configured to narrow a medium feeding path directed toward the contact position by advancing with respect to the feeding roller; and a first that presses portion pressing the path forming member toward the feeding roller, in which the path forming member is configured to displace the separation portion in a direction away from the feeding roller when the path forming member is pushed down in a direction retreating from the feeding roller by a medium having a thickness exceeding a predetermined thickness.

According to an aspect of the present disclosure, there is further provided an image reading apparatus including the medium feeding apparatus and a reading portion reading the medium fed by the medium feeding apparatus.

BRIEF DESCRIPTION OF THE DRAWINGS

FIG. 26A is a view illustrating a state in which a pull out portion is accommodated, and FIG. 26B is a view illustrating a state in which the pull out portion is pulled out.

FIG. 34A is a diagram illustrating a feeding standby state, and FIG. 34B is a diagram illustrating a state in which the separation roller is displaced.

FIG. 35A is a diagram illustrating a state when a plurality of documents having a sheet shape are fed, and FIG. 35B is a diagram illustrating a state when a document having a booklet shape is fed.

FIG. 37A is a diagram illustrating a state in the middle of document feeding, and FIG. 37B is a diagram illustrating a state in which a rear end of the document to be fed is removed from the contact position between the feeding roller and the separation roller.

DESCRIPTION OF EXEMPLARY EMBODIMENTS

Figure 1:
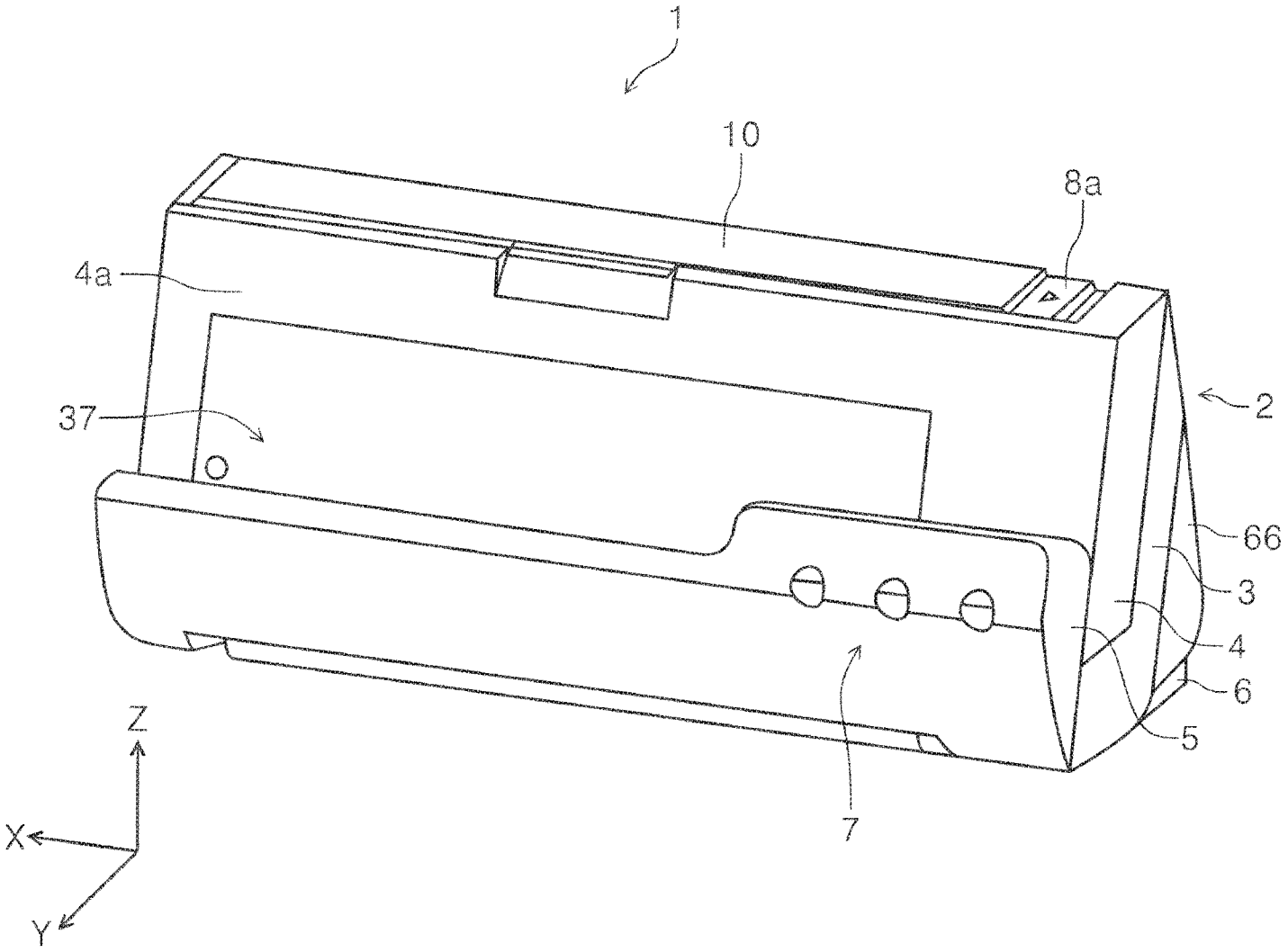
FIG. 1 is a perspective view of a scanner in which an apparatus main body is in a normal reading posture as viewed from the front.

Hereinafter, the present disclosure will be schematically described.

A medium feeding apparatus according to a first aspect includes: a medium supporting portion supporting a medium; a feeding roller that comes into contact with an upper surface of the medium supported by the medium supporting portion; a separation portion disposed to face the feeding roller and configured to advance and retreat with respect to the feeding roller; a path forming member that is a member positioned upstream in a medium feeding direction with respect to a contact position between the feeding roller and the separation portion, that is configured to advance and retreat with respect to the feeding roller in accordance with a thickness of the medium, and that is configured to narrow a medium feeding path directed toward the contact position by advancing with respect to the feeding roller; and a first pressing portion that presses the path forming member toward the feeding roller, in which the path forming member is configured to displace the separation portion in a direction away from the feeding roller when the path forming member is pushed down in a direction retreating from the feeding roller by a medium having a thickness exceeding a predetermined thickness.

According to the present aspect, the path forming member is capable of being engaged with the separation portion and displaces the separation portion in a direction away from the feeding roller when pushed down in a direction retreating from the feeding roller by the medium having a thickness exceeding the predetermined thickness, thereby the separation portion is separated from the feeding roller in advance before the medium enters between the separation portion and the feeding roller when the medium having a thickness exceeding the predetermined thickness is fed. As a result, it is possible to prevent the medium having a thickness exceeding the predetermined thickness from hitting the separation portion and being unable to be fed.

The engagement between the path forming member and the separation portion is not limited to a case where the path forming member and the separation portion have a direct engagement, and it also includes a case where the path forming member and the separation portion have an indirect engagement via another member.

In a second aspect according to the first aspect, when a plurality of media are supported by the medium supporting portion, an upper surface of the path forming member may apply a separation action to a front end of the plurality of medium.

According to the present aspect, since the upper surface of the path forming member applies the separation action to the front end of the plurality of medium when the plurality of media are supported by the medium supporting portion, by performing the separation of the media by the path forming member prior to the separation of the media by the feeding roller and the separation portion, the media can be more reliably separated.

In a third aspect according to the first or second aspect, the path forming member may include a plurality of ribs extending in the medium feeding direction, and the plurality of ribs may be disposed in a width direction that is a direction intersecting the medium feeding direction to be line symmetrical about a straight line that passes through a center of the medium and that is parallel to the medium feeding direction.

According to the present aspect, the plurality of ribs is disposed to be line symmetrical about the straight line, which passes through the center of the medium and is parallel to the medium feeding direction, and the frictional forces, which are applied to the medium by the path forming member, become equal to the left and right with respect to the straight line in the width direction, thereby it is possible to suppress the skew of the medium.

In a fourth aspect according to the third aspect, the straight line may pass through a center position of the feeding roller and a center position of the separation portion in the width direction, and two ribs, among the plurality of ribs, that are close to the straight line in the width direction may be positioned while interposing the separation portion therebetween in the width direction and are positioned within a width of the feeding roller in the width direction.

According to the present aspect, since the two ribs, among the plurality of ribs, that are close to the straight line in the width direction are positioned while interposing the separation portion therebetween in the width direction and are positioned within the width of the feeding roller, the medium feeding path toward the contact position can be narrowed appropriately, and the number of media toward the contact position can be appropriately regulated. As a result, the separation action by the separation portion can be appropriately obtained.

In a fifth aspect according to the first or second aspect, the separation portion may be composed of a separation roller configured to rotate, the path forming member may be engaged with the separation portion by coming into contact with a cylindrical portion centered on a rotation center of the separation roller, there may be a gap between the path forming member and the cylindrical portion when the thickness of the medium is equal to or thinner than the predetermined thickness, and the path forming member may come into contact with the cylindrical portion and displaces the separation roller in the direction away from the feeding roller when the thickness of the medium exceeds the predetermined thickness.

According to the present aspect, since the path forming member comes into contact with the cylindrical portion and displaces the separation roller in a direction away from the feeding roller, the separation roller is reliably separated from the feeding roller.

In a sixth aspect according to the first or second aspect, the separation portion may be composed of a separation roller configured to rotate, the path forming member may engaged with the separation portion by coming into contact with a rotation shaft of the separation roller, there may be a gap between the path forming member and the rotation shaft when the thickness of the medium is equal to or thinner than the predetermined thickness, and the path forming member may come into contact with the rotation shaft and displaces the separation roller in the direction away from the feeding roller when the thickness of the medium exceeds the predetermined thickness.

According to the present aspect, since the path forming member comes into contact with the rotation shaft and displaces the separation roller in a direction away from the feeding roller, the separation roller is reliably separated from the feeding roller.

In a seventh aspect according to the first or second aspect, the separation portion may be held by a holding member that is capable of advancing and retreating with respect to the feeding roller, the path forming member may be engaged with the separation portion by coming into contact with a contact portion formed on the holding member, there may be a gap between the path forming member and the contact portion when the thickness of the medium is equal to or thinner than the predetermined thickness, and the path forming member may come into contact with the contact portion and displaces the separation portion in the direction away from the feeding roller when the thickness of the medium exceeds the predetermined thickness.

According to the present aspect, the path forming member comes into contact with the contact portion and displaces the separation portion in a direction away from the feeding roller. Since the contact portion is formed on the holding member, the position of the contact portion has a high degree of freedom in disposition, and the degree of freedom in design can be improved.

An eighth aspect according to the fifth aspect may further include: a pushing portion that is a member capable of advancing and retreating with respect to the feeding roller upstream in the medium feeding direction with respect to the contact position between the feeding roller and the separation roller, and that is capable of pushing a second medium, which is supported by the medium supporting portion and to be fed following a first medium, toward the feeding roller after a rear end of the first medium to be fed passed through the contact position; and a pressing portion pressing the pushing portion toward the feeding roller.

According to the present aspect, since the pushing portion, which is capable of pushing the second medium that is supported by the medium supporting portion toward the feeding roller after the rear end of the first medium to be fed passed through the contact position, is provided, it is possible to suppress a phenomenon in which the second medium is returned upstream due to the reverse rotation of the feeding roller in a configuration in which the highest medium of the stacked media is fed first.

A ninth aspect according to any one of the first to eighth aspects may further include: a main body supporting portion placed on a placement surface of the apparatus; an apparatus main body supported by the main body supporting portion, in which the separation portion is composed of a separation roller configured to rotate, the apparatus main body is rotatably attached to the main body supporting portion and is configured to be switched by rotation of the apparatus main body between a first posture and a second posture in which an angle formed by the medium feeding path with the placement surface is smaller than that of the first posture, the medium feeding apparatus further includes a separation switching section configured to switch between a separation state in which the separation roller separates media and a non-separation state in which the separation roller does not separate media, and the separation switching section puts the separation roller in the separation state when the apparatus main body is in the first posture and puts the separation roller in the non-separation state when the apparatus main body is in the second posture.

According to the present aspect, the separation switching section puts the separation roller in the separation state when the apparatus main body is in the first posture and puts the separation roller in the non-separation state when the apparatus main body is in the second posture, so that a user does not need to perform a dedicated operation for switching between the separation state and the non-separation state of the separation roller, and the usability of the apparatus is improved.

An image reading apparatus according to a tenth aspect includes: the medium feeding apparatus according to any one of the first to ninth aspects; and a reading portion reading the medium fed by the medium feeding apparatus.

According to the present aspect, in the image reading apparatus, any one of the effects of the first to eighth aspects described above may be obtained.

The medium feeding apparatus of the present disclosure can also have the following configuration.

A medium feeding apparatus according to an eleventh aspect includes: a medium supporting portion supporting a medium; a feeding roller that comes into contact with an upper surface of the medium supported by the medium supporting portion; a separation roller that is a roller disposed facing the feeding roller and that nips and separates media with the feeding roller; a pushing portion that is a member capable of advancing and retreating with respect to the feeding roller upstream in a medium feeding direction with respect to a contact position between the feeding roller and the separation roller, and that is capable of pushing a second medium, which is supported by the medium supporting portion and to be fed following a first medium, toward the feeding roller after a rear end of the first medium to be fed passed through the contact position; and a first pressing portion pressing the pushing portion toward the feeding roller.

According to the present aspect, since the pushing portion, which is capable of pushing the second medium that is supported by the medium supporting portion toward the feeding roller after the rear end of the first medium to be fed passed through the contact position, is provided, it is possible to suppress a phenomenon in which the second medium is returned upstream due to the reverse rotation of the feeding roller in a configuration in which the highest medium of the stacked media is fed first.

In a twelfth aspect according to the eleventh aspect, the pushing portion may rotate around a rotation shaft so that a front end portion advances and retreats with respect to the feeding roller, and the rotation shaft may be positioned upstream in the medium feeding direction with respect to the front end portion.

According to the present aspect, since the pushing portion rotates around the rotation shaft so that the front end portion advances and retreats with respect to the feeding roller, and the rotation shaft is positioned upstream in the medium feeding direction with respect to the front end portion, the pushing portion that comes into contact with the medium is configured to be difficult to rotate when the medium is about to be returned upstream by the reverse rotation of the feeding roller, the phenomenon in which the medium is returned upstream due to the reverse rotation of the feeding roller can be effectively suppressed.

A thirteenth aspect according to the twelfth aspect may further include a regulation portion regulating a rotation limit of the pushing portion in a direction in which the front end portion advances to the feeding roller.

According to the present aspect, since the regulation portion, which regulates the rotation limit of the pushing portion in a direction in which the front end portion advances to the feeding roller, is provided, it is possible to make the pushing portion that comes into contact with the medium less likely to rotate more reliably when the medium is about to be returned upstream due to the reverse rotation of the feeding roller.

In a fourteenth aspect according to any one of the eleventh to thirteenth aspects, the pushing portion may be provided within a width of the feeding roller in a width direction that is a direction intersecting the medium feeding direction.

According to the present aspect, since the pushing portion is provided within the width of the feeding roller in the width direction that is a direction intersecting the medium feeding direction, the pushing portion can reliably push the medium with respect to the feeding roller, and the phenomenon in which the medium is returned upstream due to the reverse rotation of the feeding roller can be more reliably suppressed.

In the fifteenth aspect according to the fourteenth aspect, the pushing portion may be provided at both end portions of the feeding roller in the width direction.

According to the present aspect, since the pushing portion is provided at both end portions of the feeding roller in the width direction, the skew when the medium is about to be returned upstream due to the reverse rotation of the feeding roller can be suppressed.

In the sixteenth aspect according to the fifteenth aspect, the pushing portion may have at least two levers, each of which may be capable of independently advancing and retreating with respect to the feeding roller.

When the pushing portion may have at least two levers and the levers are configured to advance and retreat integrally, a difference in the pushing state of the media by each of the levers may occur, thereby there is a risk that the skew of the medium may occur. For example, when one lever comes into contact with the medium and the other lever does not come into contact with the medium, the skew of the medium occurs. However, in the present aspect, since the levers can independently advance and retreat with respect to the feeding roller, each of the levers can appropriately push the medium, and the skewing can be suppressed.

A seventeenth aspect according to any one of the eleventh to sixteenth aspects may further include a path forming member that is a member positioned upstream in the medium feeding direction with respect to the contact position, that is capable of advancing and retreating with respect to the feeding roller in accordance with the thickness of the medium, and that narrows the medium feeding path directed toward the contact position by advancing with respect to the feeding roller in which in a feeding standby state, the path forming member and the pushing portion come into contact with the feeding roller, and a position where the pushing portion comes into contact with the feeding roller is positioned upstream of a position where the path forming member comes into contact with the feeding roller in the medium feeding direction.

According to the present aspect, since the number of media directed toward the contact position can be regulated by the path forming member, the separation effect by the feeding roller and the separation roller can be enhanced.

Further, since a position where the pushing portion comes into contact with the feeding roller is positioned upstream of a position where the path forming member comes into contact with the feeding roller in the medium feeding direction, when the medium is about to be returned upstream due to the reverse rotation of the feeding roller, the medium can be pushed for a longer period of time, and the phenomenon in which the medium is returned upstream due to the reverse rotation of the feeding roller can be more reliably suppressed.

An eighteenth aspect according to the seventeenth aspect may further include a second pressing portion pressing the path forming member toward the feeding roller, in which a force of the first pressing portion pressing the pushing portion is smaller than a force of the second pressing portion pressing the path forming member.

According to the present aspect, since the force of the first pressing portion presses the pushing portion is smaller than the force of the second pressing portion pressing the path forming member, when the medium is fed, the pushing portion can easily retreat from the medium feeding path, and it is possible to prevent the pushing portion from interfering with the feeding of the medium.

In a nineteenth aspect according to the eighteenth aspect, the path forming member is capable of being engaged with the separation roller and displaces the separation roller in a direction away from the feeding roller when the path forming member is pushed down in a direction retreating from the feeding roller by a medium having a thickness exceeding a predetermined thickness, and the pushing portion does not push down the separation roller in a direction away from the feeding roller when the pushing portion is pushed down from the path forming member to a non-protruding state with respect to the medium feeding path.

According to the present aspect, the path forming member is capable of being engaged with the separation portion and displaces the separation roller in a direction away from the feeding roller when pushed down in a direction retreating from the feeding roller by the medium having a thickness exceeding the predetermined thickness, thereby the separation roller is separated from the feeding roller in advance before the medium enters between the separation roller and the feeding roller when the medium having a thickness exceeding the predetermined thickness is fed. As a result, it is possible to prevent the medium having a thickness exceeding the predetermined thickness from hitting the separation roller and being unable to be fed.

The engagement between the path forming member and the separation roller is not limited to a case where the path forming member and the separation roller have a direct engagement, and it also includes a case where the path forming member and the separation roller have an indirect engagement via another member.

Further, since the pushing portion does not push down the separation roller in a direction away from the feeding roller when the pushing portion is pushed down from the path forming member to a non-protruding state with respect to the medium feeding path, it is possible to prevent inappropriate timing of separation of the separation roller from the feeding roller.

The image reading apparatus according to a twentieth aspect includes: the medium feeding apparatus according to any one of the eleventh to nineteenth aspects; and a reading portion reading the medium fed by the medium feeding apparatus.

According to the present aspect, in the image reading apparatus, any one of the effects of the eleventh to nineteenth aspects described above may be obtained.

Hereinafter, the present disclosure will be specifically described.

In the following, as an example of the image reading apparatus, a scanner 1 will be taken as an example, which is capable of reading at least one side between a first side of a document and a second side that is opposite to the first side. The scanner 1 is a so-called sheet feed type scanner that reads the document while moving the document with respect to a reading portion described later.

In the present specification, the document includes not only a document having a sheet shape but also a document having a card shape or a document having a booklet shape. The document is an example of a medium.

In the X-Y-Z coordinate system illustrated in each figure, the X axis direction is an apparatus width direction and also a document width direction. The Y axis direction is an apparatus depth direction, and the Z axis direction is a direction along the vertical direction.

In the present embodiment, the +Y direction is defined as a direction from a back surface toward a front surface of the apparatus, and the −Y direction is defined as a direction from the front surface toward the back surface of the apparatus. When viewed from the front surface of the apparatus, the left direction is defined as the +X direction, and the right direction is defined as the −X direction.

In the following, a direction in which the document is transported may be referred to as "downstream", and a direction opposite thereto may be referred to as "upstream".

Figure 2:
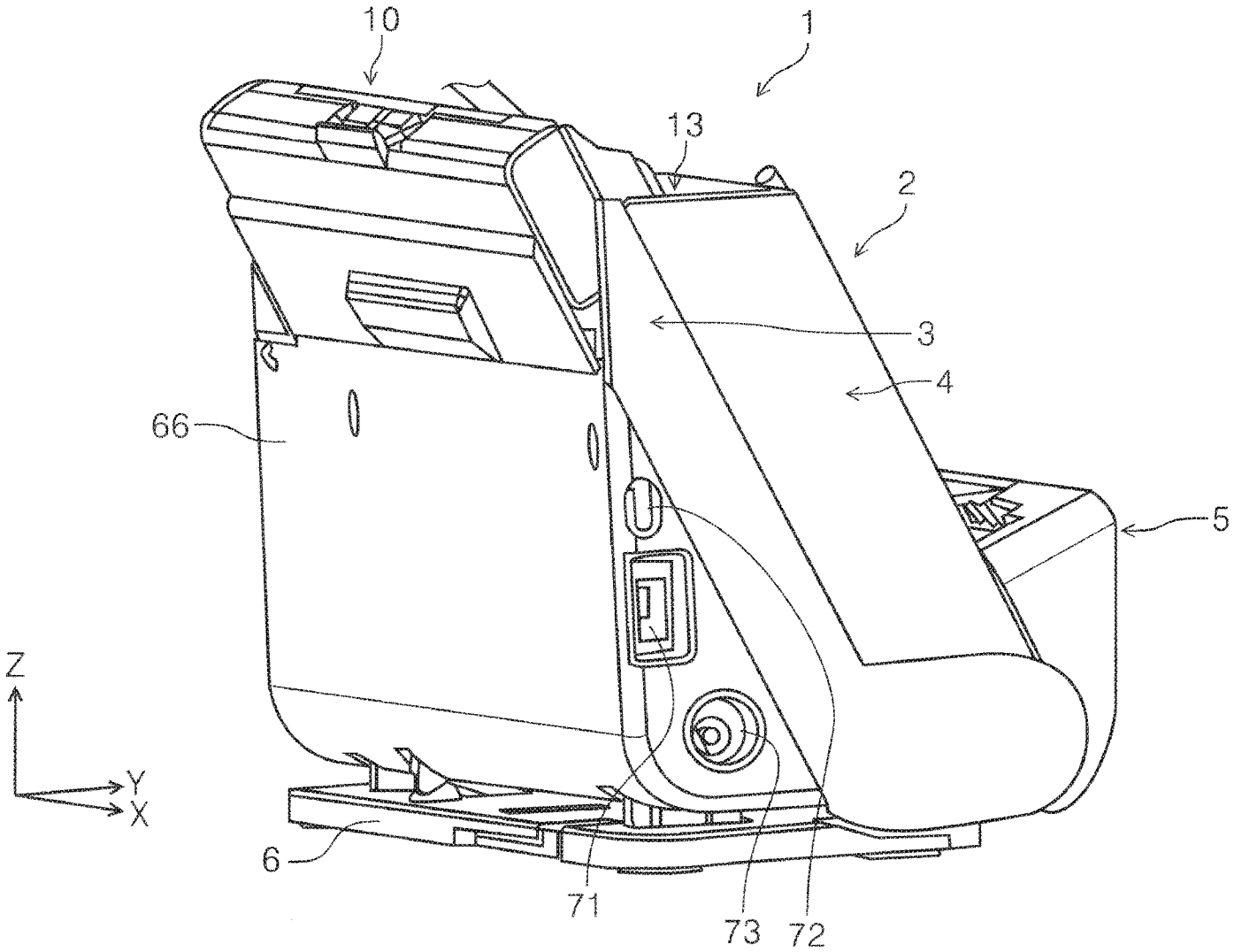
FIG. 2 is a perspective view of the scanner in which the apparatus main body is in the normal reading posture as viewed from the rear.

In FIGS. 1 and 2, the scanner 1 includes a document feeding apparatus 150, which is an example of a medium feeding apparatus. In the present embodiment, the document feeding apparatus 150 has a configuration in which a first reading portion 32 and a second reading portion 33, which will be described later, are removed from the scanner 1. However, from the viewpoint of feeding the document, the entire scanner 1 including the first reading portion 32 and the second reading portion 33 may be used as the document feeding apparatus 150.

The scanner 1 according to the present embodiment includes an apparatus main body 2 and a main body supporting portion 6 that rotatably supports the apparatus main body 2.

The apparatus main body 2 includes a first unit 3, a second unit 4, and a third unit 5.

Figure 3:
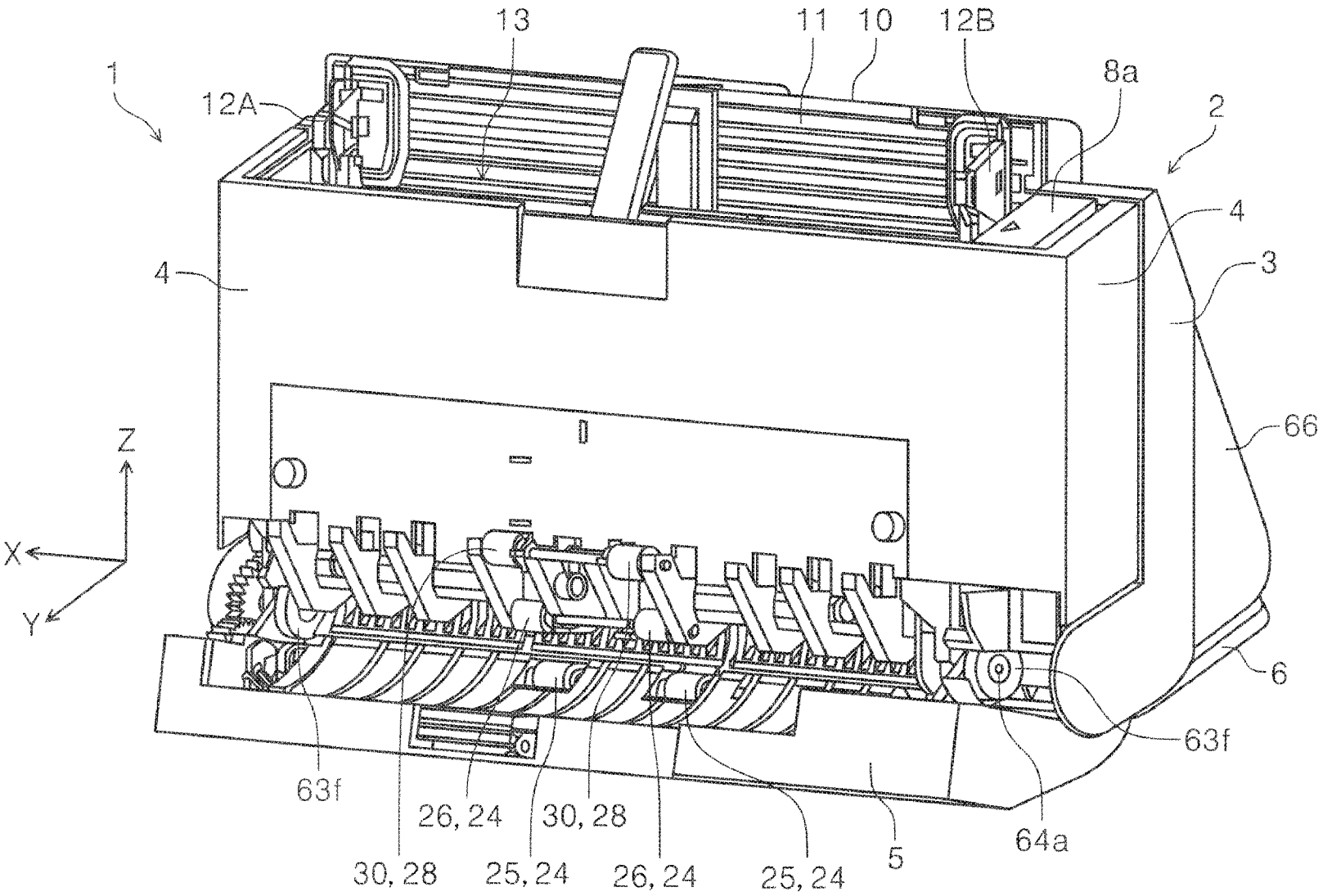
FIG. 3 is a perspective view of the scanner, in which the apparatus main body is in the normal reading posture and a third unit is opened, as viewed from the front.

The second unit 4 and the third unit 5 are provided so as to be capable of rotating around a frame rotation shaft 64*a* (see FIG. 3). The frame rotation shaft 64*a* is a rotation shaft forming a center of the rotation shaft that is parallel to the X axis direction.

Figure 4:
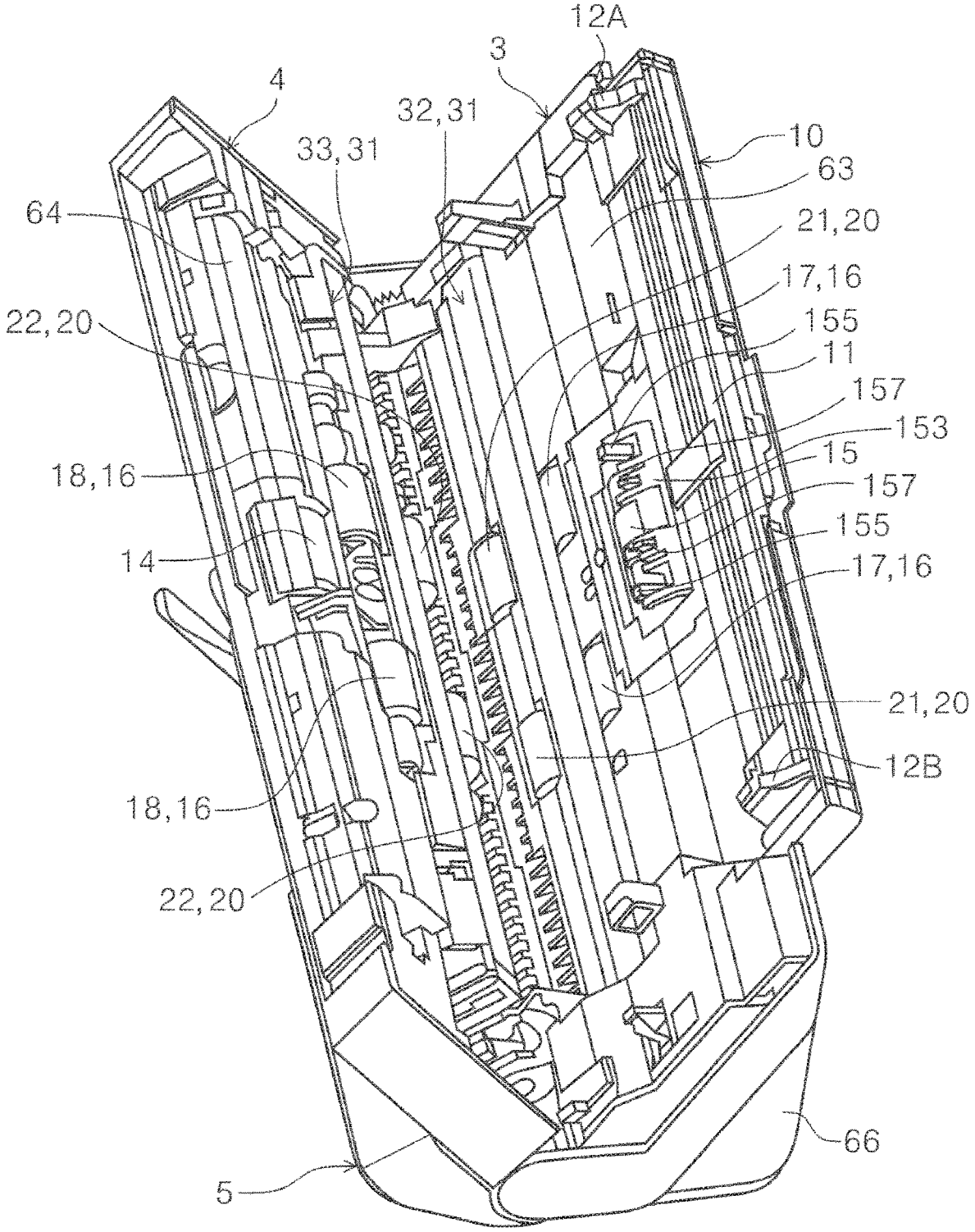
FIG. 4 is a perspective view of the scanner, in which the apparatus main body is in the normal reading posture and a second unit is opened, as viewed from above.

The second unit 4 and the third unit 5 can integrally rotate around the frame rotation shaft 64*a* with respect to the first unit 3 (see FIG. 4). By rotating the second unit 4 and the third unit 5 with respect to the first unit 3, part of a document transporting path can be exposed as illustrated in FIG. 4. Particularly, a document feeding path R1 and a read transporting path R2, which will be described later, can be exposed. A user can unlock the second unit 4 with respect to the first unit 3 and open the second unit 4 by sliding an unlocking portion 8*a* in the −X direction.

The third unit 5 can rotate around the frame rotation shaft 64*a* with respect to the first unit 3 and the second unit 4 (see FIG. 3). By rotating the third unit 5 with respect to the first unit 3 and the second unit 4, part of the document transporting path can be exposed as illustrated in FIG. 3. Particularly, an inversion transporting path R3, which will be described later, can be exposed.

Figure 5:
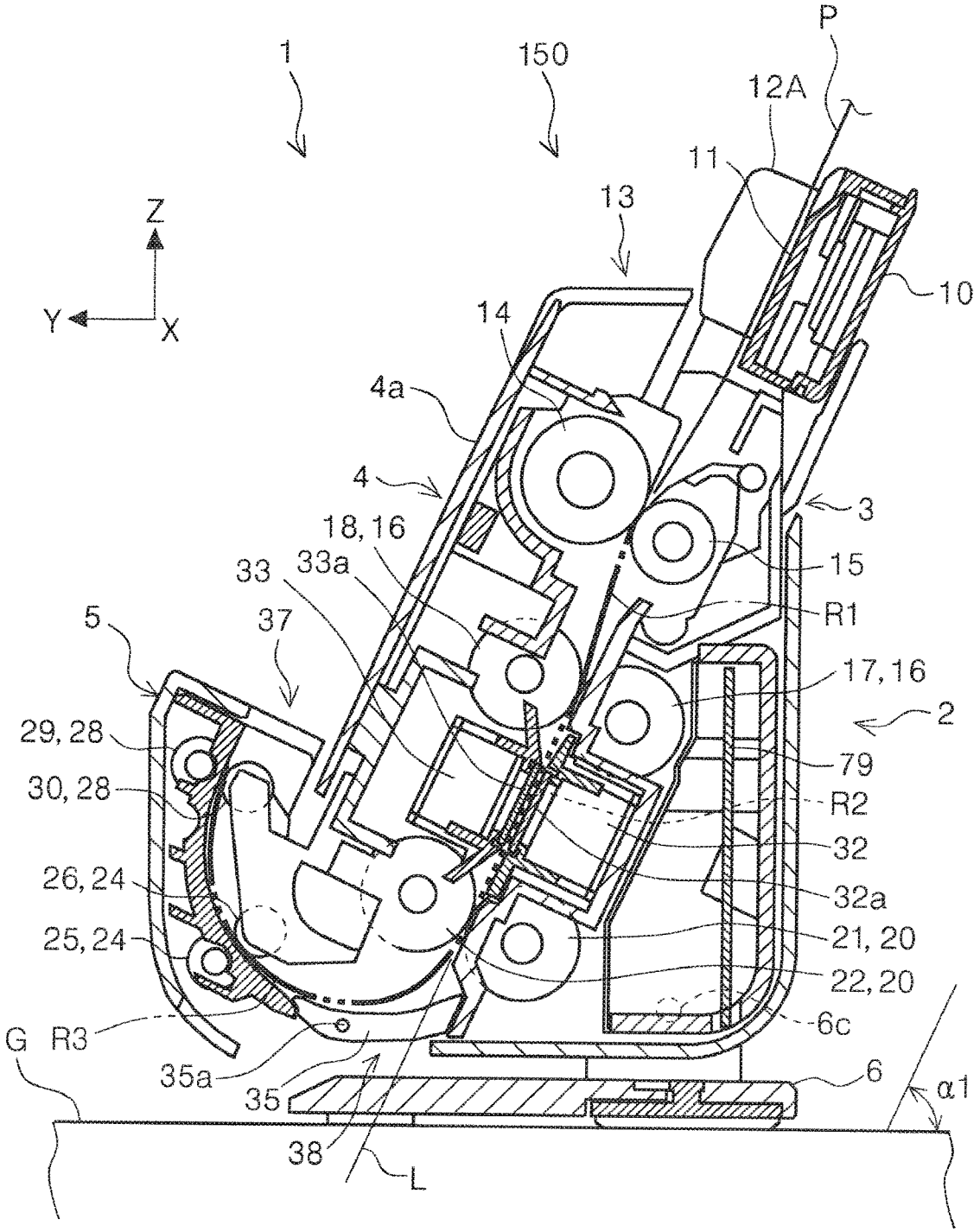
FIG. 5 is a cross-sectional view of a document transporting path of the scanner in which the apparatus main body is in the normal reading posture as viewed from the width direction.
Figure 6:
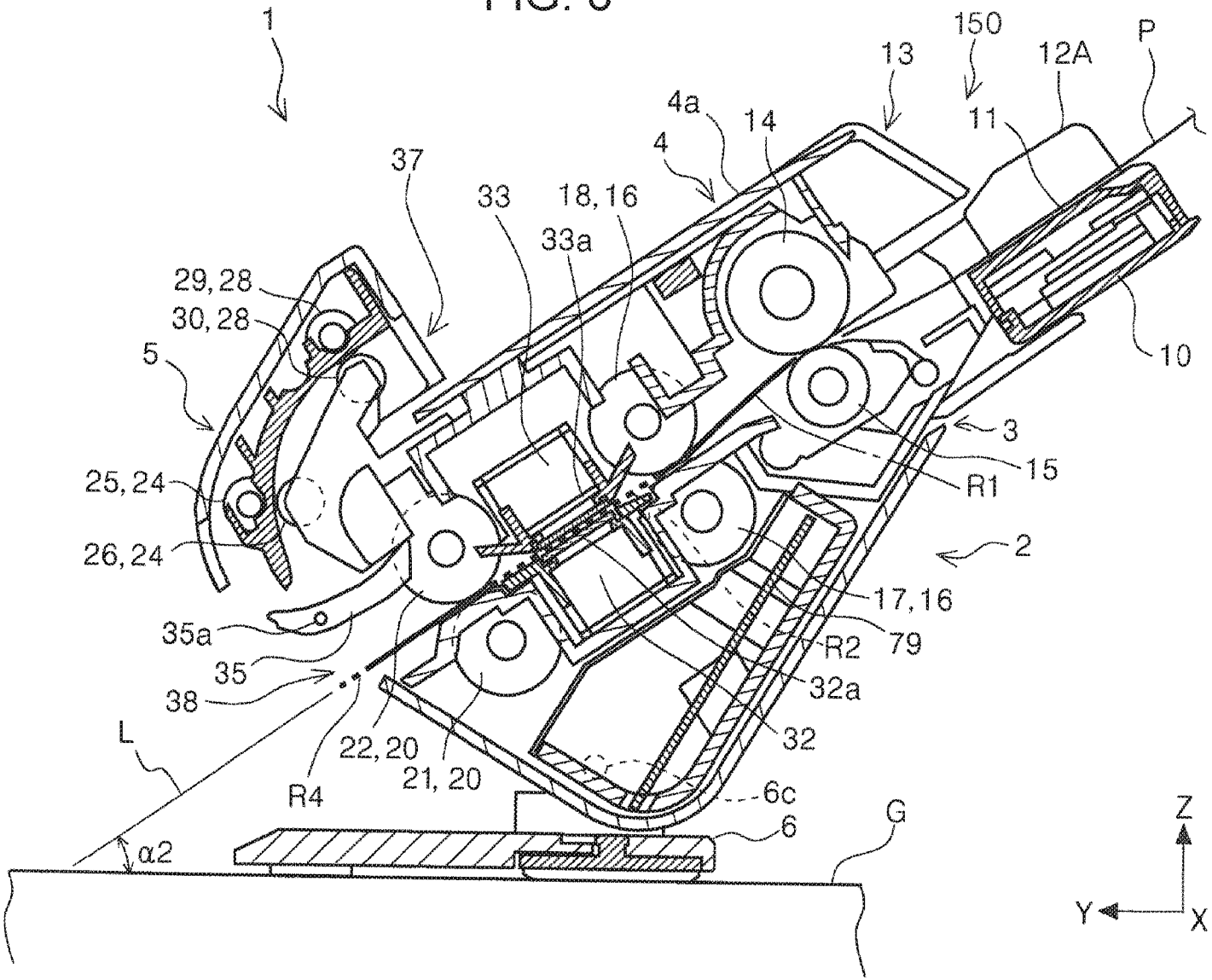
FIG. 6 is a cross-sectional view of the document transporting path of the scanner in which the apparatus main body is in a booklet reading posture as viewed from the width direction.

The apparatus main body 2 is rotatable around a main body rotation shaft 6*c* with respect to the main body supporting portion 6 (see FIGS. 7 and 8), and in the present embodiment, the apparatus main body 2 is capable of maintaining two postures by the rotation of the apparatus main body 2. The two postures of the apparatus main body 2 are illustrated in FIGS. 5 and 6, and hereinafter, the posture in FIG. 5 is referred to as a normal reading posture, and the posture in FIG. 6 is referred to as a booklet reading posture. The normal reading posture is an example of a first posture of the apparatus main body 2, and the booklet reading posture is an example of a second posture of the apparatus main body 2.

An angle $\alpha$1 illustrated in FIG. 5 and an angle $\alpha$2 illustrated in FIG. 6 are angles formed by the read transporting path R2 and a placement surface G of the apparatus, described later. The angle $\alpha$2 in a case of the booklet reading posture is smaller than the angle $\alpha$1 in a case of the normal reading posture.

In the normal reading posture, a projected area of the apparatus main body 2 on the placement surface G on which the scanner 1 is placed is the smallest, that is, a footprint of the apparatus main body 2 is the smallest.

The footprint in the present specification is an occupied area of the apparatus main body 2 in the X-Y plane when the apparatus main body 2 is viewed from above.

The normal reading posture is suitable for reading a document having a sheet shape, that is, a document having low rigidity and easy bending. The booklet reading posture is suitable for reading a document having high rigidity and hard bending such as a plastic card or a booklet.

An operation portion 7 that is configured with a plurality of operation buttons including a power button is provided on the front surface of the apparatus.

As illustrated in FIG. 2, a first coupling portion 71, a second coupling portion 72, and a third coupling portion 73 are provided on the side surface among the side surfaces constituting the periphery of the apparatus in the +X direction. The first coupling portion 71 is a coupling portion to which a USB Type-A plug (not illustrated), which is an example of a coupling target, is coupled. The second coupling portion 72 is a coupling portion to which a USB Type-C plug (not illustrated), which is an example of a coupling target, is coupled. The third coupling portion 73 is a coupling portion to which a power plug (not illustrated) for supplying electric power to the apparatus main body 2 is coupled.

USB is an abbreviation for universal serial bus, and Type-A and Type-C are one of a plurality of types defined in the USB standard.

An external apparatus can be coupled to the first coupling portion 71 via a USB cable (not illustrated), and a storage medium, for example, a USB memory (not illustrated) can be also coupled to the first coupling portion 71. A control portion 80 (see FIG. 12) can store read data in the storage medium that is coupled to the first coupling portion 71.

Further, the external apparatus can be coupled to the second coupling portion 72 via a USB cable (not illustrated).

The first coupling portion 71, the second coupling portion 72, and the third coupling portion 73 are provided on a circuit substrate 79 (see FIG. 7) positioned on the back surface side of the apparatus.

In the present embodiment, the apparatus main body 2 is configured to receive the electric power from the external apparatus that is coupled to the second coupling portion 72.

Subsequently, the configuration of the document transporting path in the scanner 1 will be described with reference to FIGS. 5 and 6. The fed document is supported in an inclined posture by a document supporting portion 11. The reference numeral P indicates the supported document. When a plurality of documents is supported by the document supporting portion 11, the topmost document is fed downstream by a feeding roller 14. The feeding roller 14 comes in contact with the upper side of the document supported by the document supporting portion 11.

The document supporting portion 11 is formed at an upper opening/closing portion 10. The upper opening/closing portion 10 is rotatable around a rotation shaft (not illustrated), and a feeding port 13 is opened/closed by the rotation of the upper opening/closing portion 10. FIG. 1 illustrates a state in which the upper opening/closing portion 10 is closed, and FIG. 2 illustrates a state in which the upper opening/closing portion 10 is opened. The upper opening/closing portion 10 constitutes the first unit 3.

As illustrated in FIG. 3, the document supporting portion 11 is provided with a pair of edge guides 12A and 12B that guides the side edges of the document. The pair of edge guides 12A and 12B is provided so as to be slidable in the document width direction (the X axis direction). The pair of edge guides 12A and 12B is provided so as to be in conjunction with a rack and pinion mechanism (not illustrated) such that the pair of edge guides 12A and 12B is separated from each other or close to each other with the center position in the document width direction interposed therebetween. That is, the scanner 1 adopts a so-called center feeding method.

Figure 26A:
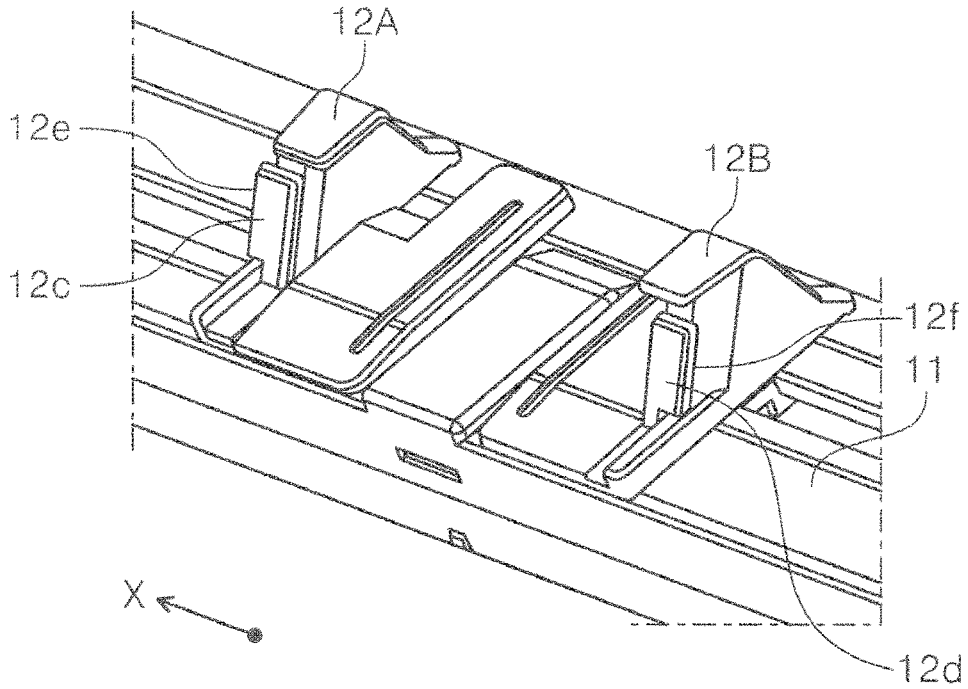
FIGS. 26A and 26B are perspective views of an edge guide.
Figure 26B:
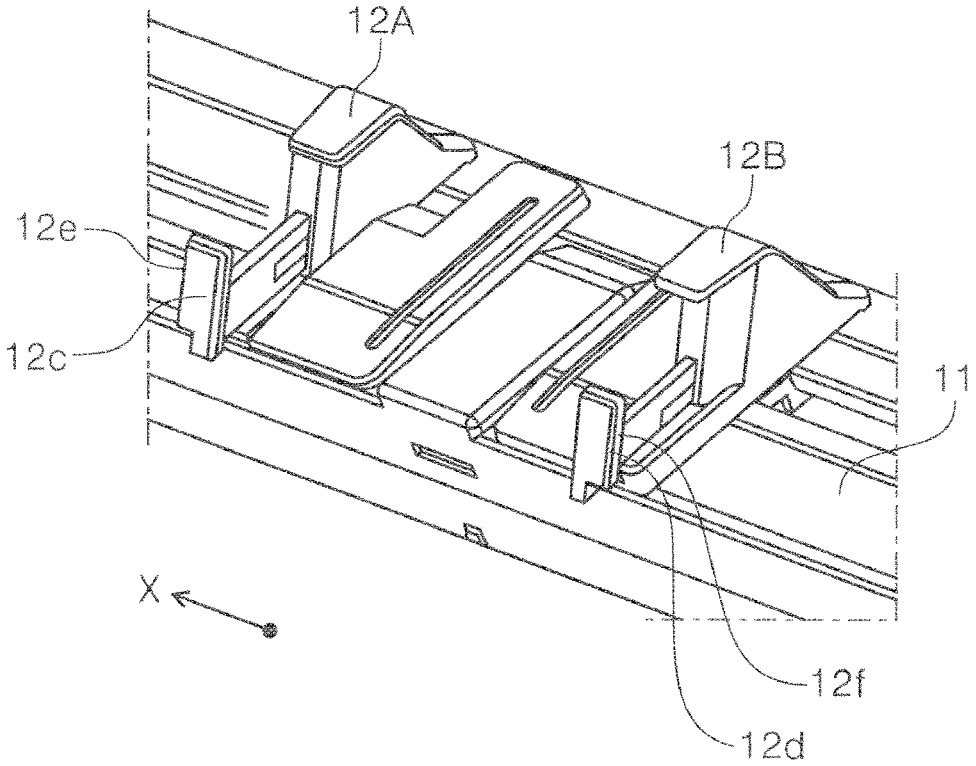

As illustrated in FIGS. 26A and 26B, the edge guides 12A and 12B are provided with pull out portions 12*c* and 12*d*, respectively. The pull out portion 12*c* includes a protruding portion 12*e* that protrudes outward (+X direction) in a state of being accommodated in the edge guide 12A, and by putting a finger on the protruding portion 12*e*, the pull out portion 12*c* can be pulled out downstream in the feeding direction as indicated by the change from FIG. 26A to FIG. 26B. Similarly, the pull out portion 12*d* includes a protruding portion 12*f* that protrudes outward (−X direction) in a state of being accommodated in the edge guide 12B, and by putting a finger on the protruding portion 12*f*, the pull out portion 12*d* can be pulled out downstream in the feeding direction as indicated by the change from FIG. 26A to FIG. 26B.

As described above, the edge guides 12A and 12B are respectively provided with the pull out portions 12*c* and 12*d* that can be pulled out downstream in the feeding direction, so that the area for guiding the side edge of the document can be extended downstream in the feeding direction. As a result, the side edge of the document can be guided in a wider area in the feeding direction, and the document having a small size in the feeding direction can also be properly guided, so that skewing during feeding can be suppressed satisfactorily.

When the upper opening/closing portion 10 is closed as illustrated in FIG. 1 in a state in which the pull out portions 12*c* and 12*d* are respectively pulled out from the edge guides 12A and 12B, the pull out portions 12*c* and 12*d* are accommodated by coming into contact with a first frame 63 (see FIG. 4), which constitutes a base body of the first unit 3. That is, there is no need for a dedicated operation for accommodating the pull out portions 12*c* and 12*d*, and the usability is improved.

The feeding roller 14 is provided in the second unit 4. When the second unit 4 is closed with respect to the first unit 3, the feeding roller 14 and a separation roller 15, that will be described later, come into contact with each other. When the second unit 4 is opened with respect to the first unit 3, the feeding roller 14 is separated from the separation roller 15.

The feeding roller 14 rotates by receiving power from a transporting motor 50 described later. The separation roller 15 is provided at a position facing the feeding roller 14 in the first unit 3. Rotational torque is applied to the separation roller 15 by a torque limiter (not illustrated), thereby the double feeding of the documents is suppressed. A separation pad may be adopted instead of the separation roller 15.

The feeding roller 14 and the separation roller 15 are provided at the center position in the document width direction (see FIG. 4).

The separation roller 15, which is an example of a separation portion disposed to face the feeding roller 14, is capable of advancing and retreating with respect to the feeding roller 14 and can have a separation state in which the rotational torque is generated by the action of a torque limiter 98 (see FIG. 16) and a non-separation state in which the action of the torque limiter 98 is not generated. A separation switching section 100 (see FIGS. 14 and 17), which will be described later, switches a state between the separation state in which the separation roller 15 separates the documents and the non-separation state in which the separation roller 15 does not separate the documents. The separation switching section 100 puts the separation roller 15 in the separation state when the apparatus main body 2 is in the normal reading posture and puts the separation roller 15 in the non-separation state when the apparatus main body 2 is in the booklet reading posture.

The separation switching section 100 will be described in detail later.

A pair of first transporting rollers 16 is provided downstream of the feeding roller 14 and the separation roller 15. The pair of first transporting rollers 16 is configured with a first lower roller 17 provided in the first unit 3 and a first upper roller 18 provided in the second unit 4. The first upper roller 18 is provided so as to be capable of advancing and retreating with respect to the first lower roller 17 and is pressed toward the first lower roller 17 by a pressing member (not illustrated) such as a coil spring.

Both the first lower roller 17 and the first upper roller 18 rotate by receiving the power from the transporting motor 50 described later. Two sets of first lower roller 17 and first upper roller 18 are provided so as to interpose the center position in the document width direction (see FIG. 4).

When the second unit 4 is closed with respect to the first unit 3, the first lower roller 17 and the first upper roller 18 come into contact with each other. When the second unit 4 is opened with respect to the first unit 3, the first upper roller 18 is separated from the first lower roller 17.

A first reading portion 32 and a second reading portion 33 are disposed to face each other downstream of the pair of first transporting rollers 16. The first reading portion 32 is provided in the first unit 3, and the second reading portion 33 is provided in the second unit 4. The first reading portion 32 reads a lower side (the first side) of the document supported by the document supporting portion 11, and the second reading portion 33 reads an upper side (the second side) of the document supported by the document supporting portion 11. The second reading portion 33 is provided so as to be capable of advancing and retreating with respect to the first reading portion 32 and is pressed toward the first reading portion 32 by the pressing member (not illustrated) such as the coil spring.

In the present embodiment, the first reading portion 32 and the second reading portion 33 are configured with a contact type image sensor module (CISM). The reference numeral 32*a* indicates a contact glass constituting the first reading portion 32, and the reference numeral 33*a* indicates a contact glass constituting the second reading portion 33.

A pair of second transporting rollers 20 is provided downstream of the first reading portion 32 and the second reading portion 33. The pair of second transporting rollers 20 is configured with a second lower roller 21 provided in the first unit 3 and a second upper roller 22 provided in the second unit 4. The second upper roller 22 is provided so as to be capable of advancing and retreating with respect to the second lower roller 21 and is pressed toward the second lower roller 21 by the pressing member (not illustrated) such as the coil spring.

Both the second lower roller 21 and the second upper roller 22 rotate by receiving the power from the transporting motor 50 described later. Two sets of second lower roller 21 and second upper roller 22 are provided so as to interpose the center position in the document width direction (see FIG. 4).

When the second unit 4 is closed with respect to the first unit 3, the second lower roller 21 and the second upper roller 22 come into contact with each other. When the second unit 4 is opened with respect to the first unit 3, the second upper roller 22 is separated from the second lower roller 21.

In FIGS. 5 and 6, an alternate long and short dash line indicated by the reference numeral R1 indicates the document feeding path, and the document feeding path R1 is defined from a nip position between the feeding roller 14 and the separation roller 15 to a nip position between the pair of first transporting rollers 16. Further, in FIGS. 5 and 6, a broken line indicated by the reference numeral R2 indicates a read transporting path, and the read transporting path R2 is defined from a nip position between the pair of first transporting rollers 16 to a nip position between the pair of second transporting rollers 20. The read transporting path R2 is the document transporting path facing the first reading portion 32 and the second reading portion 33.

When the apparatus main body 2 is in the normal reading posture illustrated in FIG. 5, the inversion transporting path R3, which is used when the read document is inverted upward and ejected, is formed downstream of the read transporting path R2. The inversion transporting path R3 is the document transporting path positioned downstream of the nip position between the pair of second transporting rollers 20, and as illustrated by a two-dot chain line in FIG. 5, is the document transporting path for bending and inverting the document, which is transported in the diagonally downward direction and ejecting the document in the diagonally upward direction from a first ejection port 37.

When the apparatus main body 2 is in the booklet reading posture illustrated in FIG. 6, a non-inversion transporting path R4, which is used when the read document is ejected without being inverted, is formed downstream of the read transporting path R2. The non-inversion transporting path R4 is the document transporting path positioned downstream of the nip position between the pair of second transporting rollers 20, and as illustrated by a two-dot chain line in FIG. 6, is the document transporting path for ejecting the document, which is transported in the diagonally downward direction in the read transporting path R2, in the diagonally downward direction from a second ejection port 38 without bending and inverting.

The pair of second transporting rollers 20 functions as a pair of ejection rollers that ejects the document from the non-inversion transporting path R4.

Switching between the inversion transporting path R3 and the non-inversion transporting path R4 is performed by using a flap 35 as a flap member constituting a transporting path switching section. The flap 35 is rotatable about a flap rotation shaft 35*a*, and by the rotation, the flap 35 couples the inversion transporting path R3 to the read transporting path R2 or couples the non-inversion transporting path R4 to the read transporting path R2. Coupling the inversion transporting path R3 to the read transporting path R2 means that the inversion transporting path R3 is in a usable state and the non-inversion transporting path R4 is in an unusable state. Similarly, coupling the non-inversion transporting path R4 to the read transporting path R2 means that the non-inversion transporting path R4 is in a usable state and the inversion transporting path R3 is in an unusable state.

In the present embodiment, the flap 35 is configured to be rotated in conjunction with the posture switching of the apparatus main body 2. In the present embodiment, a first solenoid 86 (see FIG. 12) is adopted as a configuration in which the flap 35 is rotated in conjunction with the posture switching of the apparatus main body 2. The control portion 80 (see FIG. 12), which performs various controls, detects the posture of the apparatus main body 2 in accordance with a detection signal of a first posture detection sensor 87 or a second posture detection sensor 88 described later, and rotates the flap 35 by driving the first solenoid 86 in accordance with the detection. The method for rotating the flap 35 is not limited to the first solenoid 86 but may be another actuator such as a motor. Alternatively, the flap 35 may be configured to be rotated mechanically in conjunction with the posture of the apparatus main body 2.

The inversion transporting path R3 is provided with a pair of third transporting rollers 24 and a pair of fourth transporting rollers 28.

The pair of third transporting rollers 24 is configured with a third driving roller 25 provided in the third unit 5 and a third driven roller 26 provided in the second unit 4. The third driven roller 26 is provided so as to be capable of advancing and retreating with respect to the third driving roller 25 and is pressed toward the third driving roller 25 by the pressing member (not illustrated) such as the coil spring. The third driving roller 25 is driven by the transporting motor 50. The third driven roller 26 is a roller that is driven to rotate.

The pair of fourth transporting rollers 28 is configured with a fourth driving roller 29 provided in the third unit 5 and a fourth driven roller 30 provided in the second unit 4. The fourth driven roller 30 is provided so as to be capable of advancing and retreating with respect to the fourth driving roller 29 and is pressed toward the fourth driving roller 29 by the pressing member (not illustrated) such as the coil spring. The fourth driving roller 29 is driven by the transporting motor 50. The fourth driven roller 30 is a roller that is driven to rotate.

Two sets of third driving roller 25, the third driven roller 26, the fourth driving roller 29, and the fourth driven roller 30 are provided so as to interpose the center position in the document width direction (see FIG. 3).

When the third unit 5 is closed with respect to the second unit 4, the third driving roller 25 and the third driven roller 26 come into contact with each other, and the fourth driving roller 29 and the fourth driven roller 30 also come into contact with each other. When the third unit 5 is opened with respect to the second unit 4, the third driving roller 25 and the third driven roller 26 are separated from each other, and the fourth driving roller 29 and the fourth driven roller 30 are also separated from each other.

The document, which is transported on the inversion transporting path R3, is ejected diagonally upward including the −Y direction component by the pair of fourth transporting rollers 28 and is supported in an inclined posture by an upper surface 4*a* of the second unit 4.

Next, a configuration for rotating the apparatus main body 2 will be described. In the present embodiment, the apparatus main body 2 rotates by using the power of the posture switching motor 40 (see FIGS. 7 to 10) under the control of the control portion 80 and switches the posture. The control portion 80 controls the posture switching motor 40 in accordance with input information from an external apparatus 500 that is coupled to the scanner 1.

Figure 7:
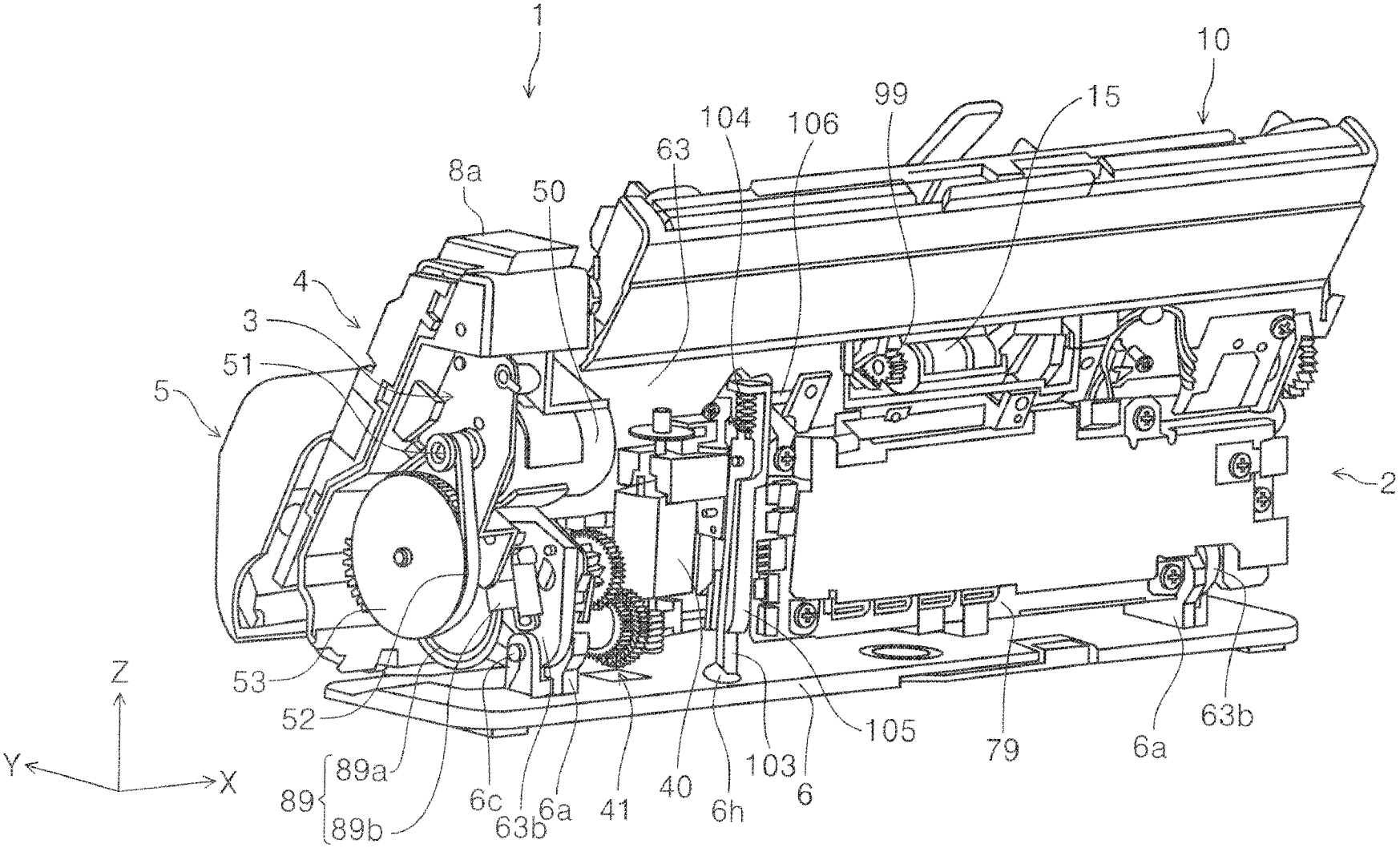
FIG. 7 is a perspective view of the scanner in which a back surface cover of a first unit is removed as viewed from the rear.

FIG. 7 illustrates a state in which a back surface cover 66 (see FIG. 2) constituting the external appearance of the back surface of the apparatus is removed. The reference numeral 41 indicates a rotation converting section for converting the rotation of the posture switching motor 40 into the rotation of the apparatus main body 2. The posture switching motor 40 and the rotation converting section 41 are provided closer to the side surface in the −X direction in the apparatus width direction. In the apparatus width direction, closer to the side surface in the −X direction means that the posture switching motor 40 and the rotation converting section 41 are positioned in the −X direction from the apparatus center position in the X axis direction.

The first frame 63 constituting a base body of the first unit 3 is provided with two support target portions 63*b* with a gap interposed therebetween in the X axis direction. The main body supporting portion 6 is provided with the two main body rotation shafts 6*c* with a gap interposed therebetween in the X axis direction. The first frame 63, that is, the apparatus main body 2, is rotatable about the main body rotation shaft 6*c* by the main body rotation shaft 6*c* passing through the support target portion 63*b*. The main body rotation shaft 6*c* is a rotation shaft forming the center of the rotation shaft parallel to the X axis direction.

The posture switching motor 40 is provided in the first frame 63. The first frame 63 has a shape along the read transporting path R2. The posture switching motor 40 is provided on the back surface side of the first frame 63 that is provided in the inclined posture.

Figure 8:
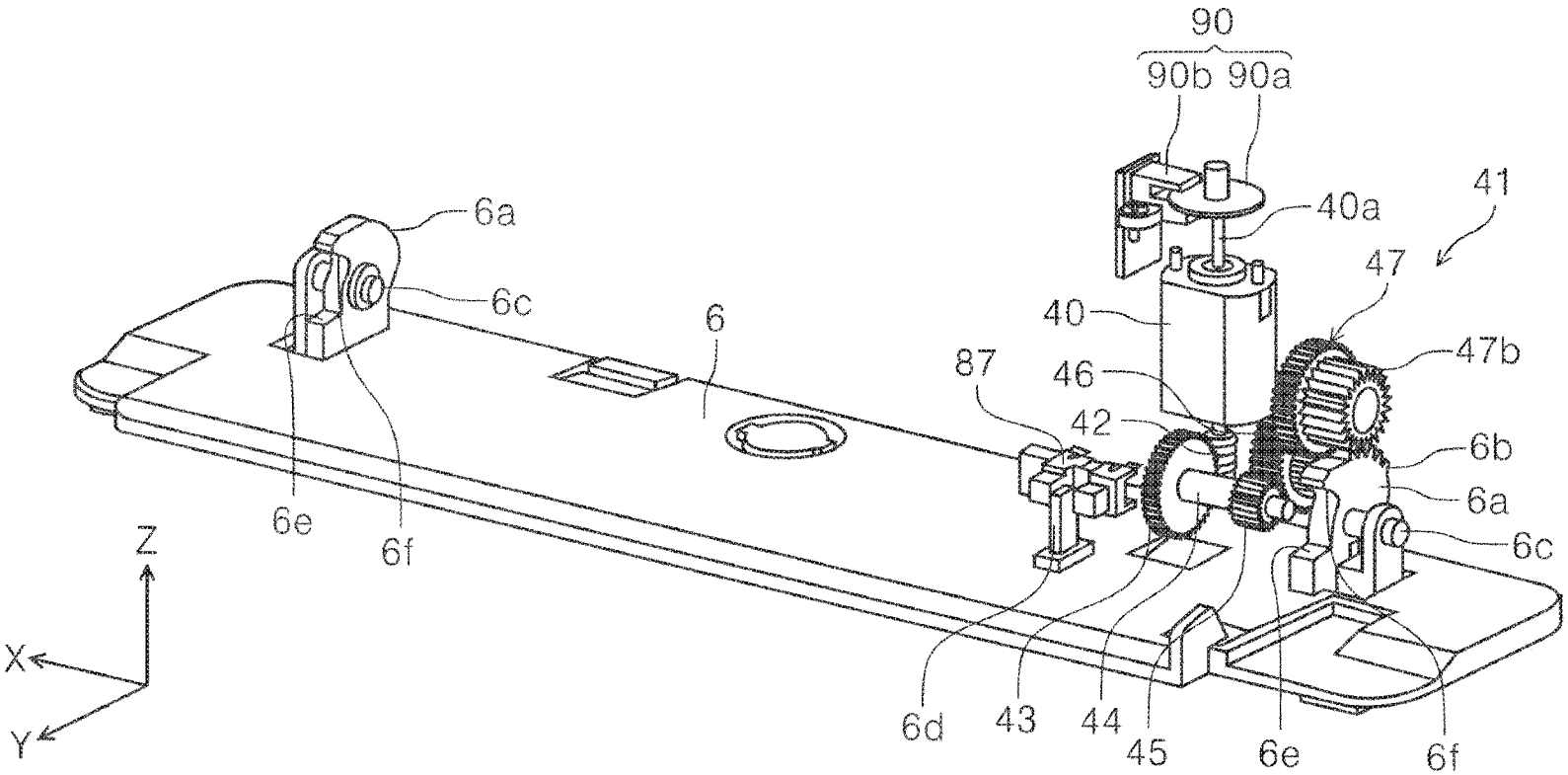
FIG. 8 is a perspective view illustrating a configuration of a posture switching motor and a rotation converting section.
Figure 9:
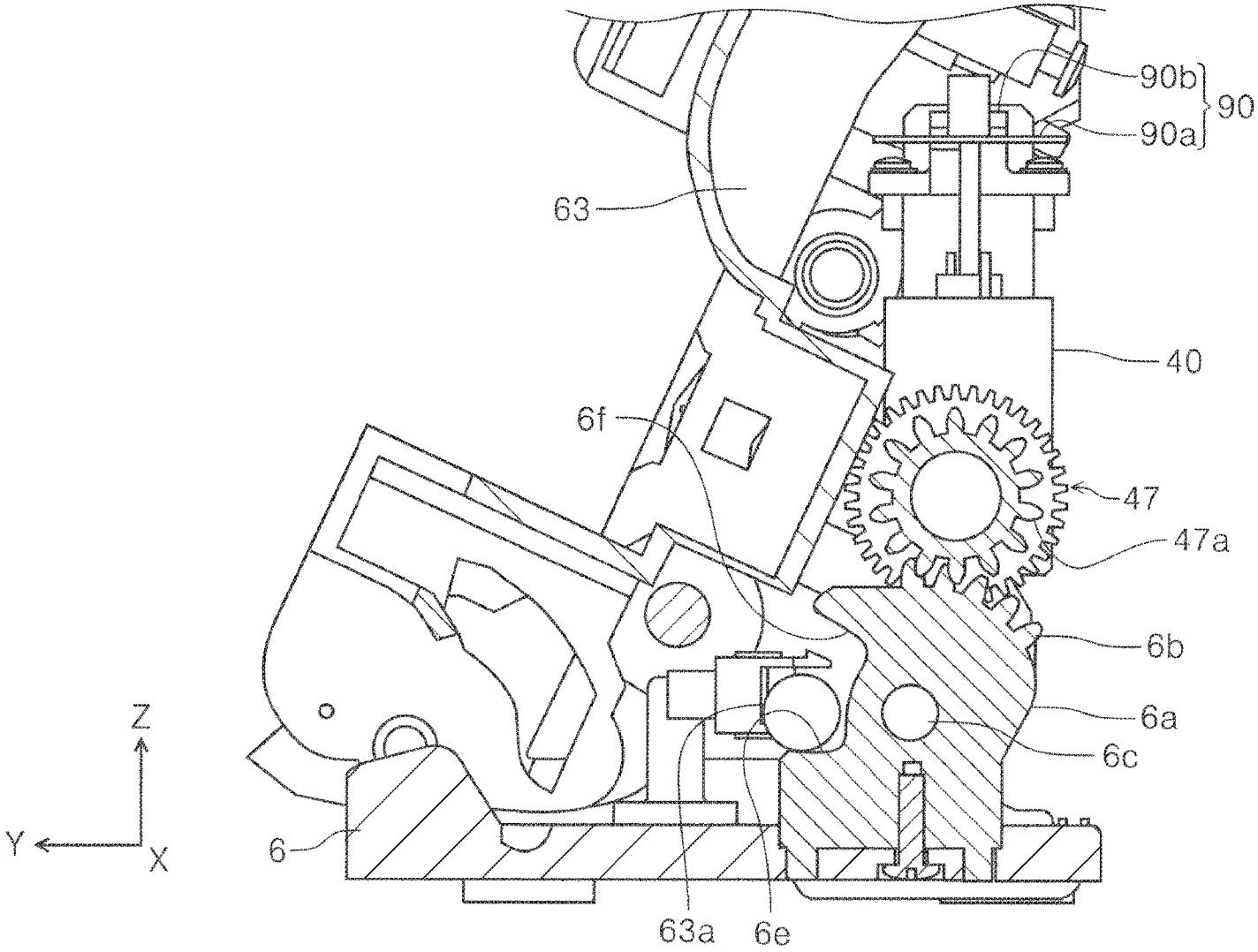
FIG. 9 is a cross-sectional view of configurations of the posture switching motor and the rotation converting section when the apparatus main body is in the normal reading posture as viewed from the width direction.
Figure 10:
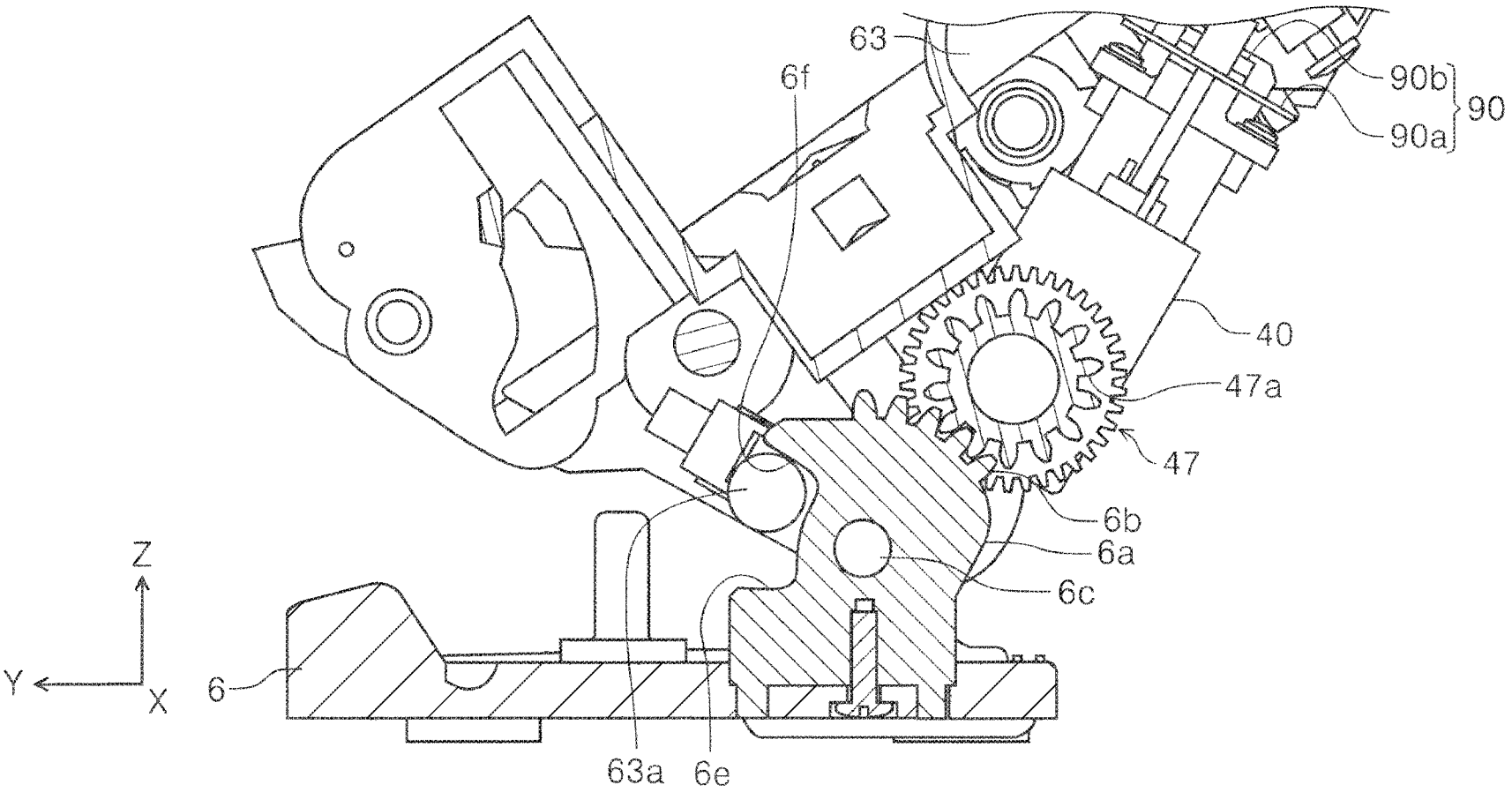
FIG. 10 is a cross-sectional view of configurations of the posture switching motor and the rotation converting section when the apparatus main body is in the booklet reading posture as viewed from the width direction.

In FIG. 8, the rotation converting section 41 has a toothed wheel 47*b* that is a toothed wheel rotatably provided in the first unit 3 and that rotates by the power of the posture switching motor 40, and a toothed portion 6*b* that is a toothed portion fixed to the main body supporting portion 6 and that meshes with the toothed wheel 47*b*.

The toothed portion 6*b* is a toothed portion formed around the main body rotation shaft 6*c* in a vertical wall portion 6*a*. The vertical wall portion 6*a* is a member constituting the main body supporting portion 6.

More specifically, a worm gear 42 is provided on a rotation shaft of the posture switching motor 40, and power is transmitted from the worm gear 42 to a toothed wheel 43. The toothed wheel 43 is integrally configured with a toothed wheel 45 via a shaft 44. The toothed wheel 45 transmits the power to a first compound toothed wheel 46, and the first compound toothed wheel 46 transmits the power to a second compound toothed wheel 47. The toothed wheel 47*b* constitutes part of the second compound toothed wheel 47.

A configuration excluding the toothed portion 6*b*, among the configurations of the posture switching motor 40 and the rotation converting section 41 described above, is provided in the first unit 3, that is, the apparatus main body 2. Therefore, when the toothed wheel 47*b* rotates by the power of the posture switching motor 40, the apparatus main body 2 rotates as indicated by the change from FIG. 9 to FIG. 10 or the change from FIG. 10 to FIG. 9, and the posture is switched.

In the present embodiment, the configuration excluding the toothed portion 6*b*, among the configurations of the posture switching motor 40 and the rotation converting section 41 described above, is provided in the first unit 3, that is, the apparatus main body 2, and the toothed portion 6*b* is provided in the main body supporting portion 6, but instead of the above disposition, the configuration excluding the toothed portion 6*b*, among the configurations of the posture switching motor 40 and the rotation converting section 41 described above, may be provided in the main body supporting portion 6, and the toothed portion 6*b* may be provided in the apparatus main body 2.

The vertical wall portion 6*a* is formed with a first contact portion 6*e* as a first rotation regulating section and a second contact portion 6*f* as a second rotation regulating section. A boss 63*a*, which is provided on the first frame 63, is inserted between the first contact portion 6*e* and the second contact portion 6*f*. When the apparatus main body 2 rotates from the booklet reading posture illustrated in FIG. 10 toward the normal reading posture illustrated in FIG. 9, the boss 63*a* comes into contact with the first contact portion 6*e*, and then the normal reading posture of the apparatus main body 2 is defined. Further, when the apparatus main body 2 rotates from the normal reading posture illustrated in FIG. 9 toward the booklet reading posture illustrated in FIG. 10, the boss 63*a* comes into contact with the second contact portion 6*f*, and then the booklet reading posture of the apparatus main body 2 is defined.

When the boss 63*a* comes into contact with the first contact portion 6*e*, or when the boss 63*a* comes into contact with the second contact portion 6*f*, a drive current value of the posture switching motor 40 increases. Therefore, the control portion 80 (see FIG. 12) can detect the posture of the apparatus main body 2 in accordance with the rotational direction and the increased drive current value of the posture switching motor 40. In the present embodiment, the first posture detection sensor 87 and the second posture detection sensor 88, which will be described later, are provided, and the control portion 80 can also detect the posture of the apparatus main body 2 in accordance with detection signals of these sensors.

The normal reading posture and the booklet reading posture of the apparatus main body 2 are maintained by supplying electric power to the stopped posture switching motor 40 and by being in a hold state.

The first posture detection sensor 87 is an optical sensor and is provided on the first frame 63, that is, the apparatus main body 2. When the apparatus main body 2 is in the normal reading posture, a protrusion 6*d*, which is provided on the main body supporting portion 6, blocks the optical axis of the first posture detection sensor 87 as illustrated in FIG. 8. When the apparatus main body 2 rotates toward the booklet reading posture from the above state, the protrusion 6*d* is displaced from the optical axis of the first posture detection sensor 87.

Figure 11A:
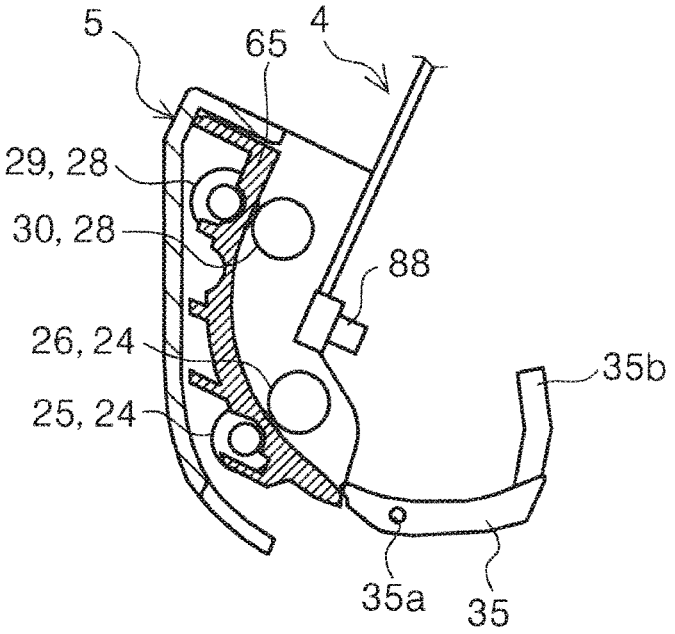
FIGS. 11A and 11B are diagrams illustrating a second posture detection sensor.
Figure 11B:
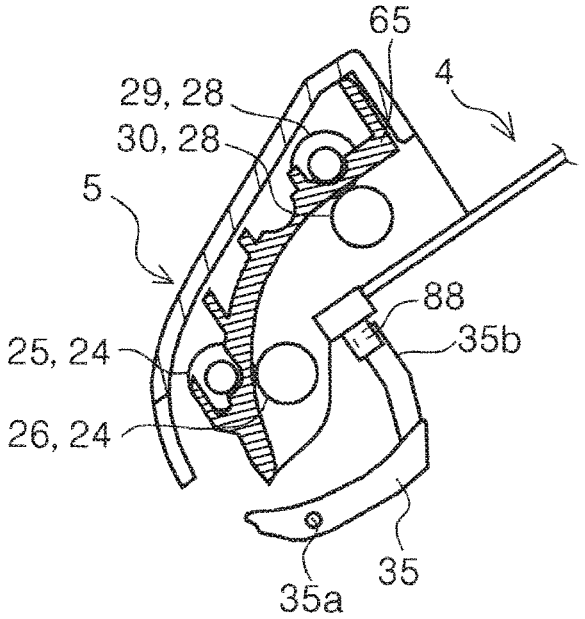

As illustrated in FIGS. 11A and 11B, the second posture detection sensor 88 is provided in the second unit 4. A detection target portion 35*b* is formed in the flap 35, and when the apparatus main body 2 is in the normal reading posture, the detection target portion 35*b* is displaced from the optical axis of the second posture detection sensor 88 as illustrated in FIG. 11A. When the apparatus main body 2 rotates toward the booklet reading posture from the above state, the detection target portion 35*b* blocks the optical axis of the second posture detection sensor 88 as illustrated in FIG. 11B.

As described above, the control portion 80 can detect the posture of the apparatus main body 2 in accordance with the detection signal of the first posture detection sensor 87 and the detection signal of the second posture detection sensor 88.

In the above-described embodiment, the posture of the apparatus main body 2 is switched by the power of the posture switching motor 40, but instead of or in addition to this, the user may switch the posture of the apparatus main body 2 by applying a force to the apparatus main body 2.

Figure 13:
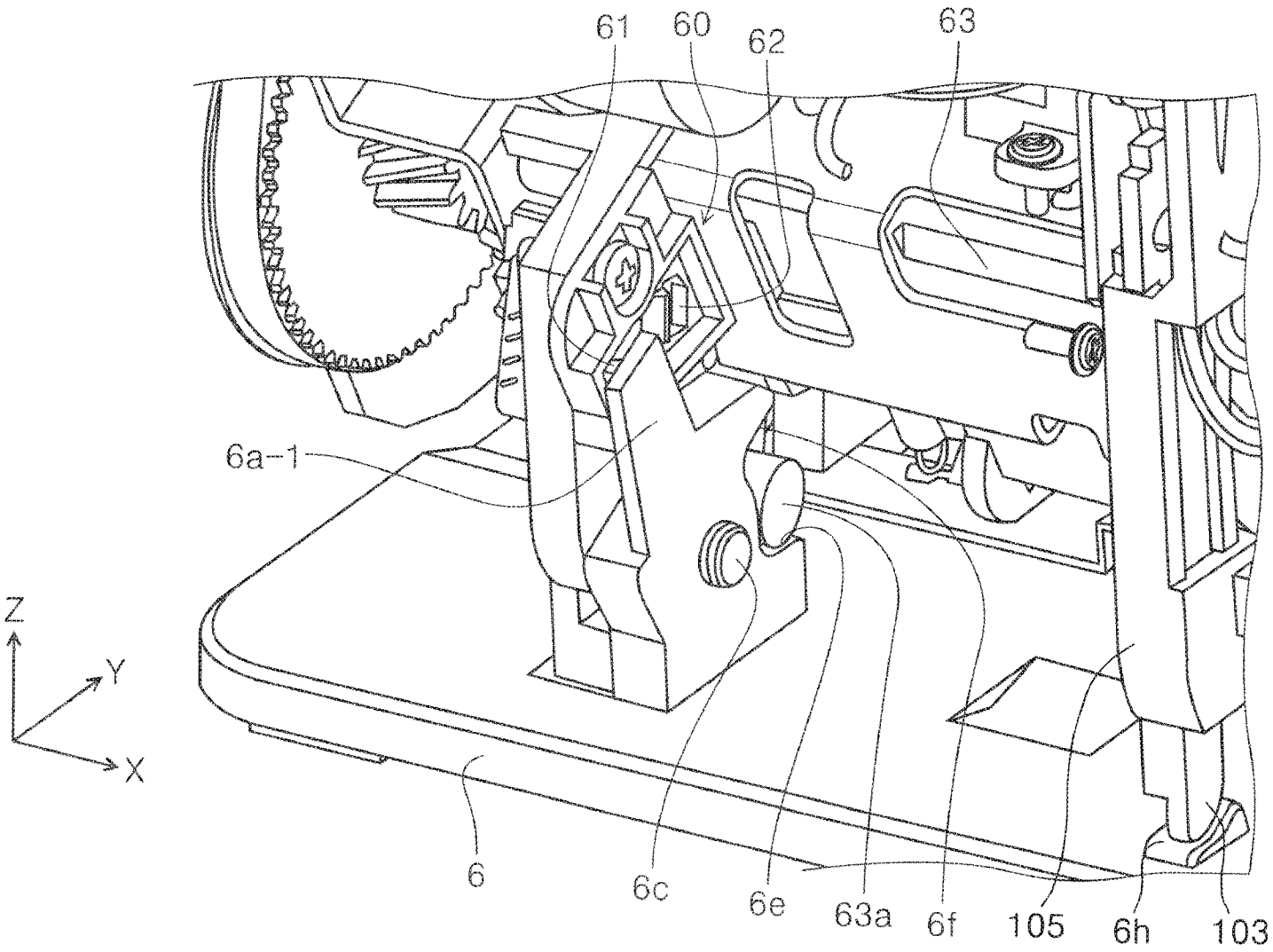
FIG. 13 is a perspective view illustrating a posture maintaining section according to another embodiment.

FIG. 13 illustrates a configuration in which the posture of the apparatus main body 2 is switched by the user's operation, and the reference numeral 6*a*-1 indicates a vertical wall portion provided on the main body supporting portion 6. The first contact portion 6*e* and the second contact portion 6*f* are formed at the vertical wall portion 6*a*-1. When the boss 63*a* comes into contact with the first contact portion 6*e*, the normal reading posture of the apparatus main body 2 is defined, and when the boss 63*a* comes into contact with the second contact portion 6*f*, the booklet reading posture of the apparatus main body 2 is defined.

A protrusion 61 is provided on the vertical wall portion 6*a*-1. A recess portion 62 is formed in the first frame 63, and the protrusion 61 is inserted into the recess portion 62, so that the posture of the apparatus main body 2 is maintained. FIG. 13 illustrates the normal reading posture, and in FIG. 13, the protrusion 61 is inserted into the hidden recess portion, thereby the normal reading posture is maintained. The recess portion (not illustrated), the recess portion 62, and the protrusion 61 constitute a posture maintaining section 60 that maintains the posture of the apparatus main body 2.

In the configuration in which the posture of the apparatus main body 2 is switched by the user operation, it is also preferable to provide the apparatus main body 2 with a handle portion for putting the user's hand.

Figure 12:
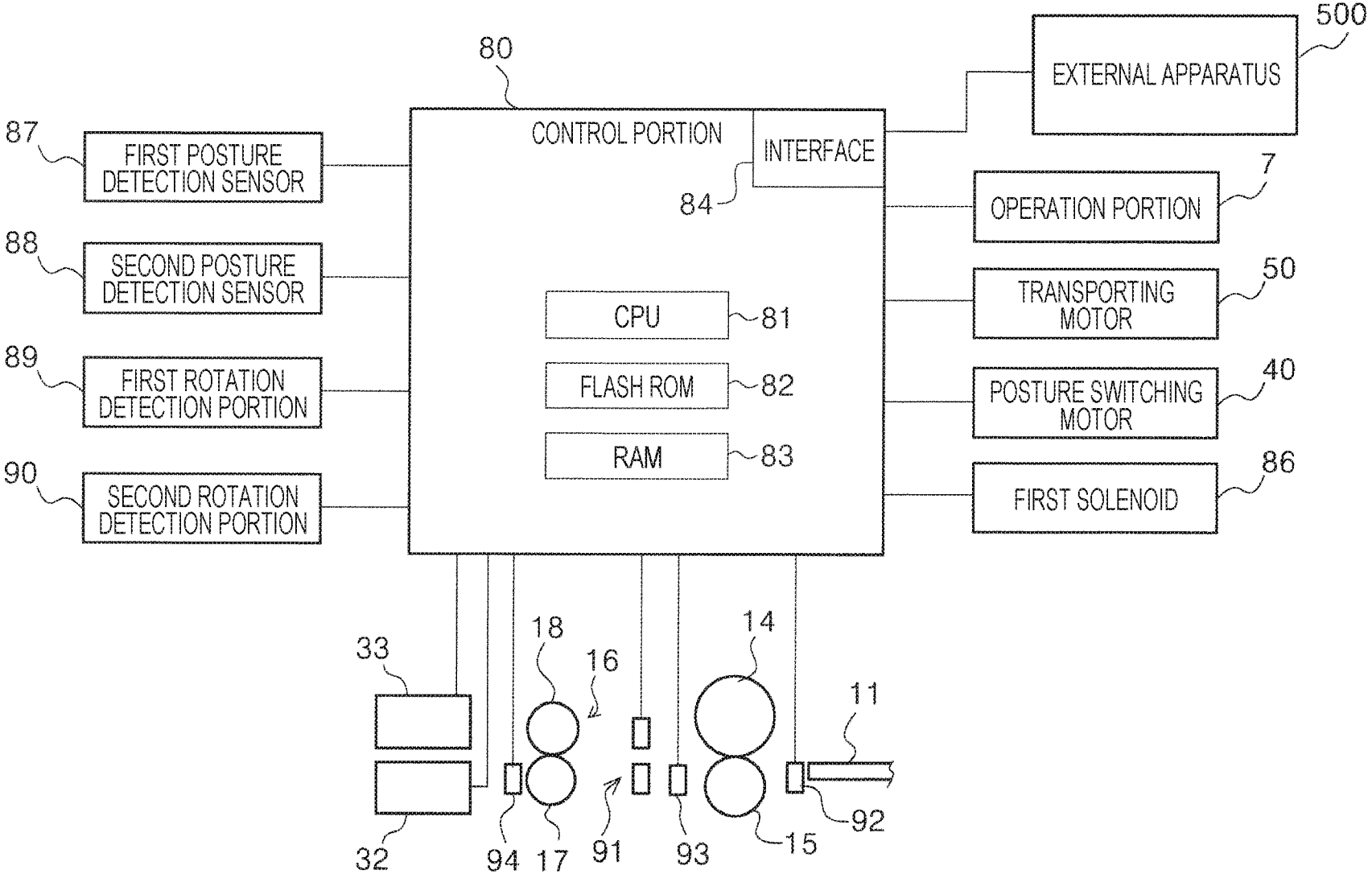
FIG. 12 is a block diagram illustrating a control system of the scanner.

Subsequently, the control system in the scanner 1 will be described with reference to FIG. 12.

The control portion 80 performs feeding, transporting, ejection control, and read control of the document, and various other controls on the scanner 1. The control portion 80 receives a signal from the operation portion 7.

The control portion 80 controls the transporting motor 50 and the posture switching motor 40. In the present embodiment, each motor is a DC motor.

The control portion 80 receives the read data from the first reading portion 32 and the second reading portion 33, and a signal for controlling each reading portion is transmitted from the control portion 80 to each reading portion.

The control portion 80 also receives signals from detection sections, that is, from a placement detection portion 92, a double feeding detection portion 91, a first document detection portion 93, a second document detection portion 94, the first posture detection sensor 87, the second posture detection sensor 88, a first rotation detection portion 89, and a second rotation detection portion 90.

As illustrated in FIG. 7, the first rotation detection portion 89 is a detection portion provided at an end portion of the apparatus main body 2 in the −X direction, and the control portion 80 can ascertain the rotation amount of each roller that is provided in the document transporting path by detecting the rotation amount of the transporting motor 50 by the first rotation detection portion 89.

The first rotation detection portion 89 is a rotary encoder that includes a rotation disk 89*a* and a detection portion 89*b*.

As illustrated in FIG. 8, the second rotation detection portion 90 is a rotary encoder that includes a rotation disk 90*a* provided on a rotation shaft 40*a* of the posture switching motor 40 and a detection portion 90*b*. The control portion 80 can ascertain the rotational direction and the rotation amount of the posture switching motor 40 by detecting the rotation amount of the posture switching motor 40 by the second rotation detection portion 90.

Returning to FIG. 12, the control portion 80 includes a CPU 81, a flash ROM 82, and a RAM 83. The CPU 81 performs various arithmetic processing in accordance with a program stored in the flash ROM 82 and controls the entire operations of the scanner 1. The flash ROM 82, which is an example of a memory, is a non-volatile memory from and to which data can be read and written. Various information is temporarily stored in the RAM 83, which is an example of a memory.

An interface 84 included in the control portion 80 includes the first coupling portion 71 and the second coupling portion 72 described with reference to FIG. 2. The control portion 80 transmits or receives data to or from the external apparatus 500 via the interface 84.

Subsequently, each of the other detection portions will be described.

The placement detection portion 92 is a detection portion provided upstream of the feeding roller 14. The control portion 80 can detect the presence of a document on the document supporting portion 11 by using a signal transmitted from the placement detection portion 92.

The first document detection portion 93 is a detection portion provided between the feeding roller 14 and the pair of first transporting rollers 16. The control portion 80 can detect a passage of the front end or the rear end of the document at the detection position by using the signal transmitted from the first document detection portion 93.

The double feeding detection portion 91 is a detection portion provided between the feeding roller 14 and the pair of first transporting rollers 16, and includes an ultrasonic wave transmitting portion and an ultrasonic wave receiving portion disposed so as to face each other with the document feeding path R1 interposed therebetween. The control portion 80 can detect the double feeding of the document by using the signal transmitted from the double feeding detection portion 91.

The second document detection portion 94 is a detection portion provided between the pair of first transporting rollers 16, and the first reading portion 32 and the second reading portion 33, and the control portion 80 can detect the passage of the front end or the rear end of the document at the detection position by using the signal transmitted from the second document detection portion 94.

Figure 25:
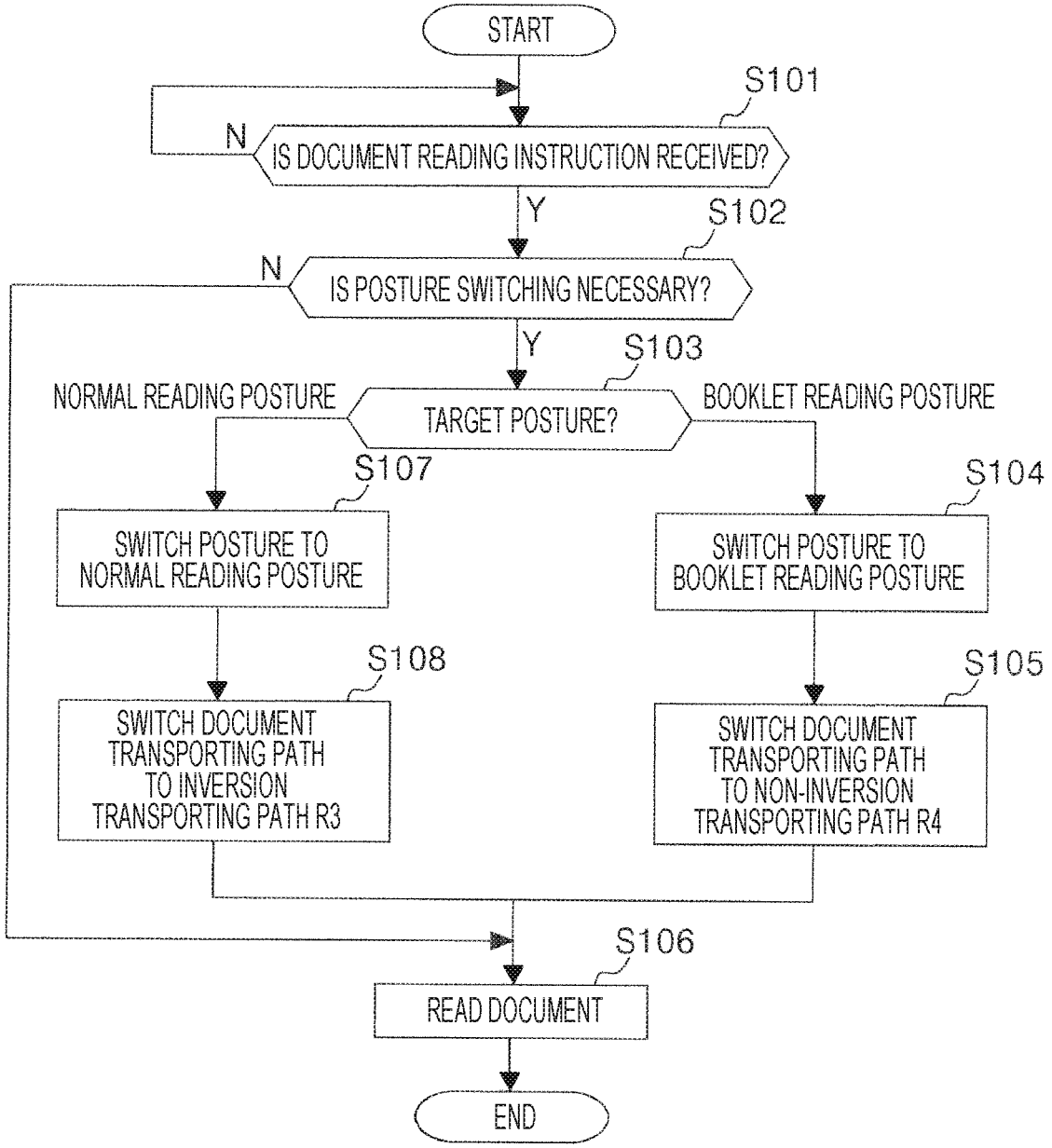
FIG. 25 is a flowchart illustrating control when posture switching of the apparatus main body is performed.

Next, an example of processing performed by the control portion 80 will be described with reference to FIG. 25. FIG. 25 is a flowchart illustrating the processing of the control portion 80 when the posture switching of the apparatus main body 2 is performed. In FIG. 25, when the control portion 80 receives a document reading instruction (Yes in step S101), the control portion 80 determines whether or not it is necessary to perform the posture switching of the apparatus main body 2 (step S102). It is assumed that the document reading instruction is received from the external apparatus 500 (see FIG. 12) as an example. In the external apparatus 500, the type of the document to be read can be set. The control portion 80 sets the posture of the apparatus main body 2 as the booklet reading posture when the type of the document to be read is a document having a card shape or a document having a booklet shape, and sets the posture of the apparatus main body 2 as the normal reading posture when the type of the document to be read is a document having a sheet shape.

In step S102, it is determined whether or not to switch the posture of the apparatus main body 2 by comparing the acquired document type with the current posture of the apparatus main body 2. As a result, when the posture switching is unnecessary (No in step S102), the document is read without performing the posture switching control (step S106). When the posture switching is necessary (Yes in step S102), based on a target posture (step S103), the control portion 80 switches the posture of the apparatus main body 2 to the booklet reading posture when the target posture is the booklet reading posture (step S104) and switches the document transporting path to the non-inversion transporting path R4 (step S105). Steps S104 and S105 may be executed at the same time. Thereafter, the document is read (step S106).

Further, based on the target posture (step S103), the control portion 80 switches the posture of the apparatus main body 2 to the normal reading posture when the target posture is the normal reading posture (step S107) and switches the document transporting path to the inversion transporting path R3 (step S108). Steps S107 and S108 may be executed at the same time. Thereafter, the document is read (step S106).

It is preferable to validate the detection information of the double feeding detection portion 91 when the apparatus main body 2 is in the normal reading posture, and invalidate the detection information of the double feeding detection portion 91 when the apparatus main body 2 is in the booklet reading posture.

As described above, the scanner 1 includes the main body supporting portion 6 that is placed on the placement surface G of the apparatus and the apparatus main body 2 that is supported by the main body supporting portion 6. The apparatus main body 2 includes the read transporting path R2 that is the document transporting path for transporting the document and that faces the first reading portion 32 and the second reading portion 33 reading the document, the inversion transporting path R3 that is the document transporting path downstream of the read transporting path R2 and is used when the read document is inverted upward and ejected, and the non-inversion transporting path R4 that is the document transporting path downstream of the read transporting path R2 and is used when the read document is ejected without being inverted. Further, the flap 35 that switches the document transporting path, which is coupled to the read transporting path R2, to either the inversion transporting path R3 or the non-inversion transporting path R4, is included.

The apparatus main body 2 is rotatably attached to the main body supporting portion 6 and is capable of being switched between the normal reading posture (FIG. 5) and the booklet reading posture (FIG. 6) in which an angle formed by the read transporting path R2 and the placement surface G is smaller than that of the normal reading posture, by the rotation of the apparatus main body 2. The flap 35 couples the read transporting path R2 to the inversion transporting path R3 when the apparatus main body 2 takes the normal reading posture and couples the read transporting path R2 to the non-inversion transporting path R4 when the apparatus main body 2 takes the booklet reading posture.

The scanner 1 can satisfactorily transport the document that is hard to bend by using the non-inversion transporting path R4. Examples of the document that is hard to bend include booklets, cards, and the like. The flap 35 couples the read transporting path R2 to the inversion transporting path R3 when the apparatus main body 2 takes the normal reading posture and couples the read transporting path R2 to the non-inversion transporting path R4 when the apparatus main body 2 takes the booklet reading posture. Thereby, an ejection direction of the document can be set to be along the placement surface G, rather than ejecting the document by using the non-inversion transporting path R4 when the normal reading posture is taken. As a result, it is possible to eject the document having a large size as compared with the configuration in which the document is ejected by using the non-inversion transporting path R4 when the normal reading posture is taken.

By setting the posture of the apparatus main body 2 in the normal reading posture, the angle that is formed by the read transporting path R2 and the placement surface G can be made larger than that in the booklet reading posture, and the footprint of the apparatus main body 2 can be suppressed.

The posture switching of the apparatus main body 2 may be performed by using a button constituting the operation portion 7. For example, when one of the buttons constituting the operation portion 7 is assigned to a posture switching button and the posture switching button is pressed by the user when the current posture is the normal reading posture, the control portion 80 executes steps S104 and S105. Further, when the posture switching button is pressed by the user when the current posture is the booklet reading posture, the control portion 80 controls the posture switching motor 40 and executes steps S107 and S108.

Of course, as described above, the posture switching of the apparatus main body 2 may be performed by the user applying a force to the apparatus main body 2. In this case, when the control portion 80 detects that the posture of the apparatus main body 2 is switched from the normal reading posture to the booklet reading posture, the control portion 80 executes steps S104 and S105. Alternatively, when the control portion 80 detects that the posture of the apparatus main body 2 is switched from the booklet reading posture to the normal reading posture, the control portion 80 executes steps S107 and S108.

Subsequently, the separation switching section 100 that switches a state between a separation state and a non-separation state of the separation roller 15 will be described.

Figure 14:
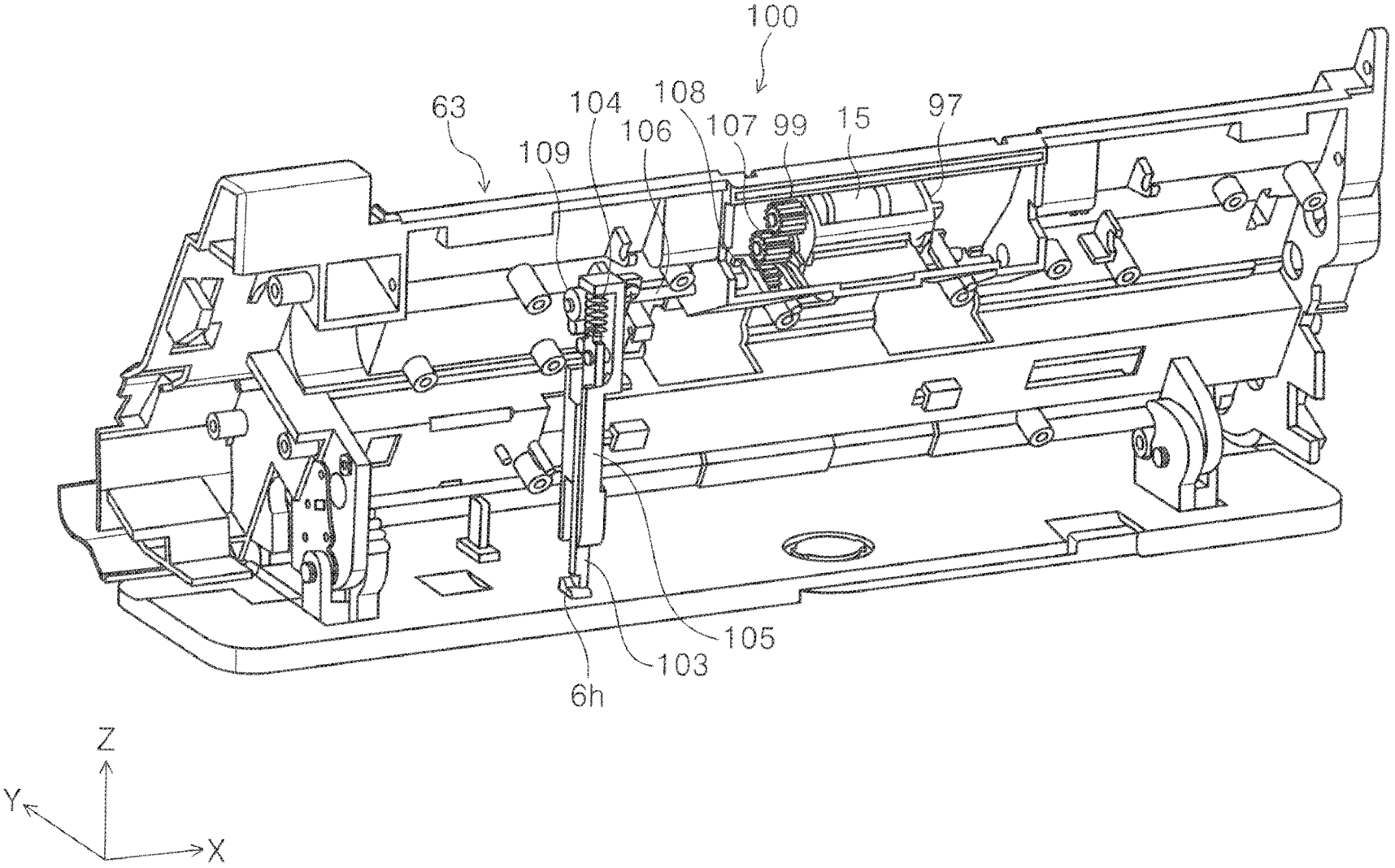
FIG. 14 is a perspective view of a first frame and a separation switching section (a first embodiment) as viewed from the rear.

As illustrated in FIGS. 7 and 14, the separation switching section 100 is provided in the −Y direction with respect to the first frame 63, that is, on the back surface of the first frame 63. The separation switching section 100 does not protrude in the −Y direction from a top portion of the first frame 63 in the +Z direction regardless of the posture of the apparatus main body 2, and is contained within an area formed at the back surface of the first frame 63.

The separation switching section 100 is positioned between the separation roller 15 and the rotation converting section 41 in the X axis direction. Part of the separation switching section 100 and part of the rotation converting section 41 are at the same position in the Y axis direction.

Figure 15:
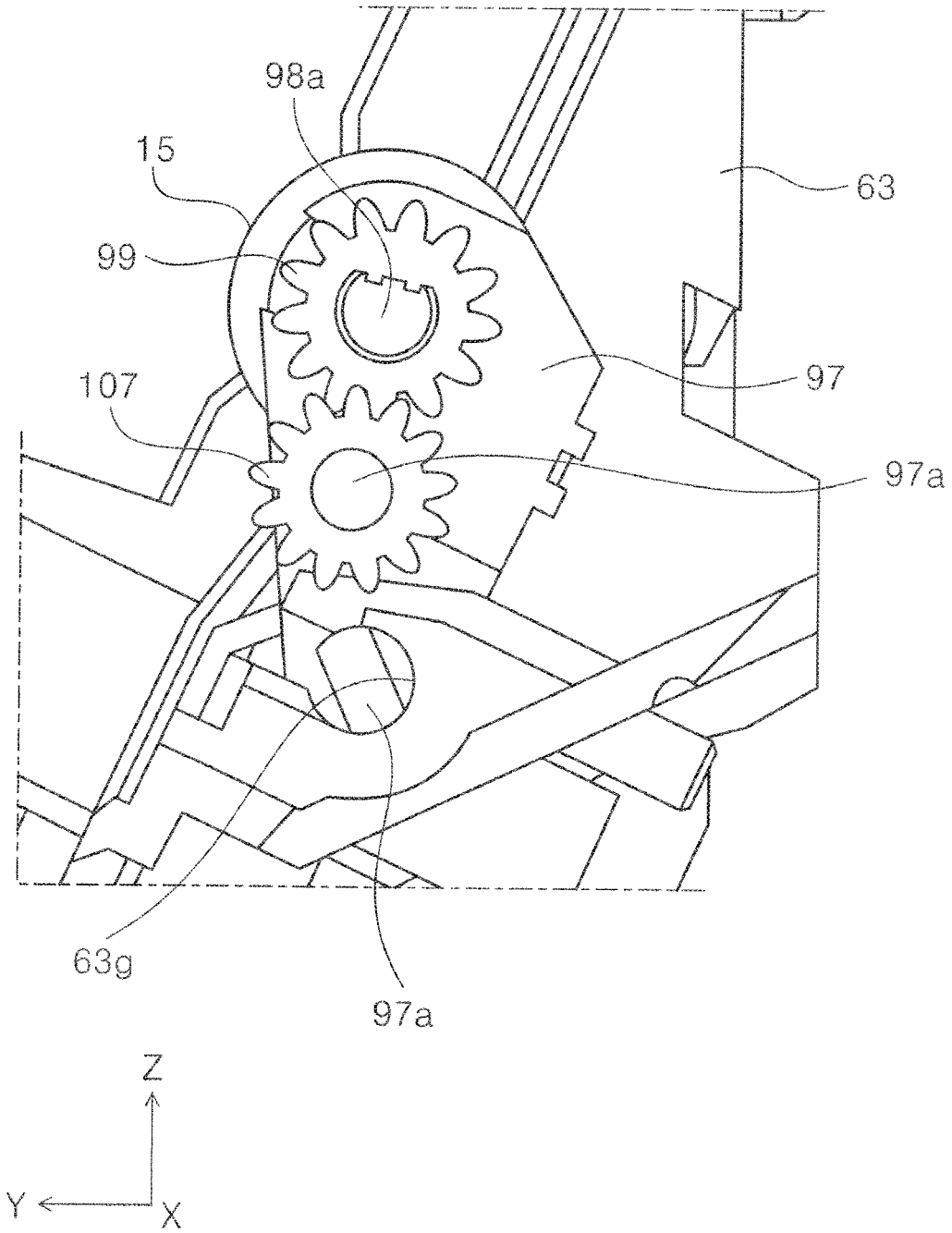
FIG. 15 is a side view of a roller holder.
Figure 16:
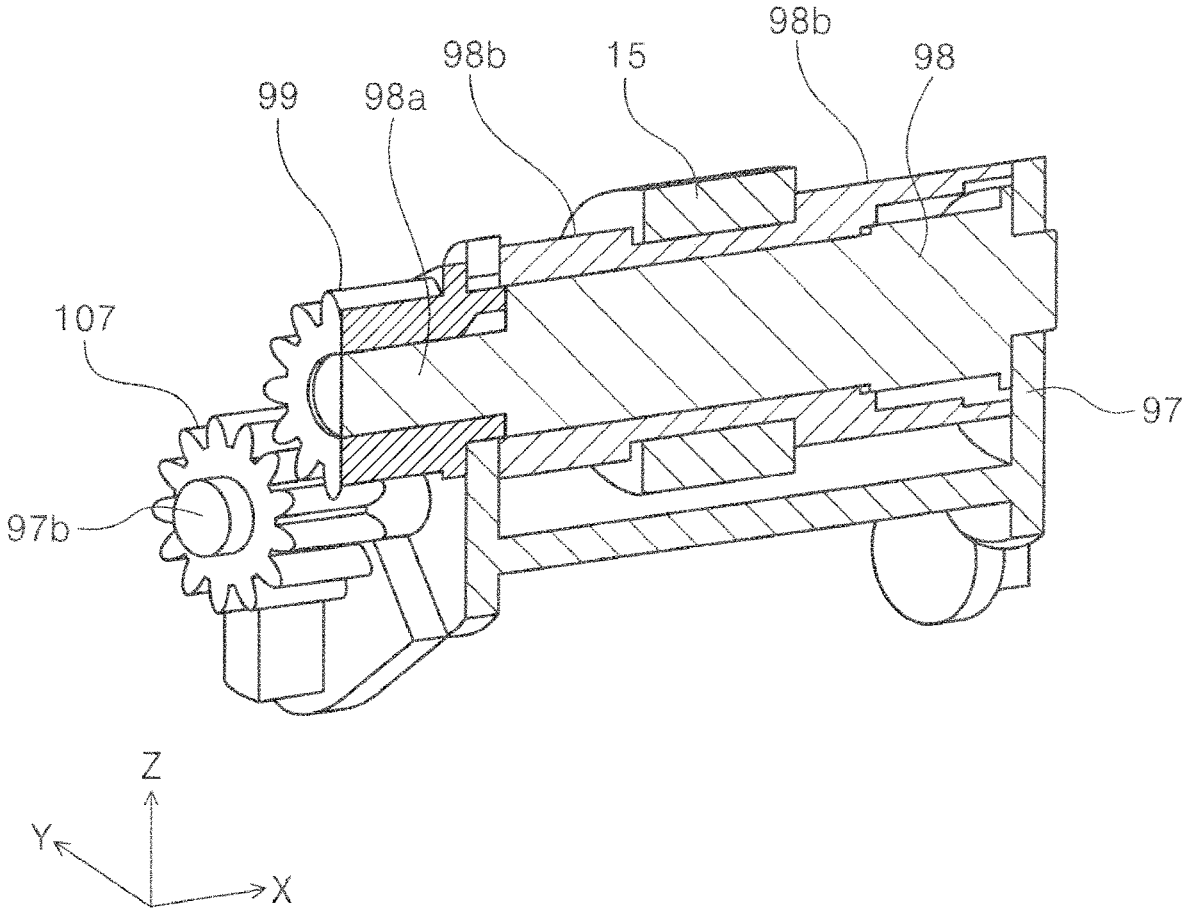
FIG. 16 is a cross-sectional perspective view of a separation roller, the roller holder, and a torque limiter.

As illustrated in FIG. 16, the separation roller 15 is rotatably provided in a roller holder 97. As illustrated in FIG. 15, a shaft portion 97*a* is integrally formed in the roller holder 97. The shaft portion 97*a* is a shaft in which the shaft center line is parallel to the X axis direction. The shaft portion 97*a* is pivotally supported by a bearing portion 63*g* formed in the first frame 63. As a result, the roller holder 97 is capable of swinging around the shaft portion 97*a*, that is, the separation roller 15 is capable of advancing and retreating with respect to the feeding roller 14. The roller holder 97 is pressed in a direction in which the separation roller 15 advances into the feeding roller 14 by a pressing section (not illustrated) such as a torsion spring.

As illustrated in FIG. 16, the torque limiter 98, which is an example of a resistance applying portion that applies the rotational resistance to the separation roller 15, is rotatably provided in the roller holder 97. The center line of the rotation shaft of the torque limiter 98 is parallel to the X axis direction. The separation roller 15 is provided for the torque limiter 98, and the separation roller 15 receives a rotational torque from the torque limiter 98 in a state in which the rotation of the torque limiter 98 is regulated. That is, the separation state in which the separation of the documents is performed, is established.

In a state in which the rotation of the torque limiter 98 is not regulated, the separation roller 15 rotates with the torque limiter 98 and does not receive the rotational torque from the torque limiter 98. That is, the non-separation state in which the separation of the documents is not performed, is established.

The separation switching section 100 according to the present embodiment switches the state between the separation state and the non-separation state of the separation roller 15 by switching between the state in which the rotation of the torque limiter 98 in the roller holder 97 is regulated and the state in which the rotation is not regulated.

A shaft portion 98*a* is formed in the torque limiter 98, and a first toothed wheel 99 is fixedly provided on the shaft portion 98*a*. That is, the first toothed wheel 99 and the torque limiter 98 do not rotate relatively.

A shaft portion 97*b* is formed in the roller holder 97, and a second toothed wheel 107 is provided on the shaft portion 97*b*. The second toothed wheel 107 is rotatable with respect to the shaft portion 97*b*. The second toothed wheel 107 meshes with the first toothed wheel 99.

Figure 17:
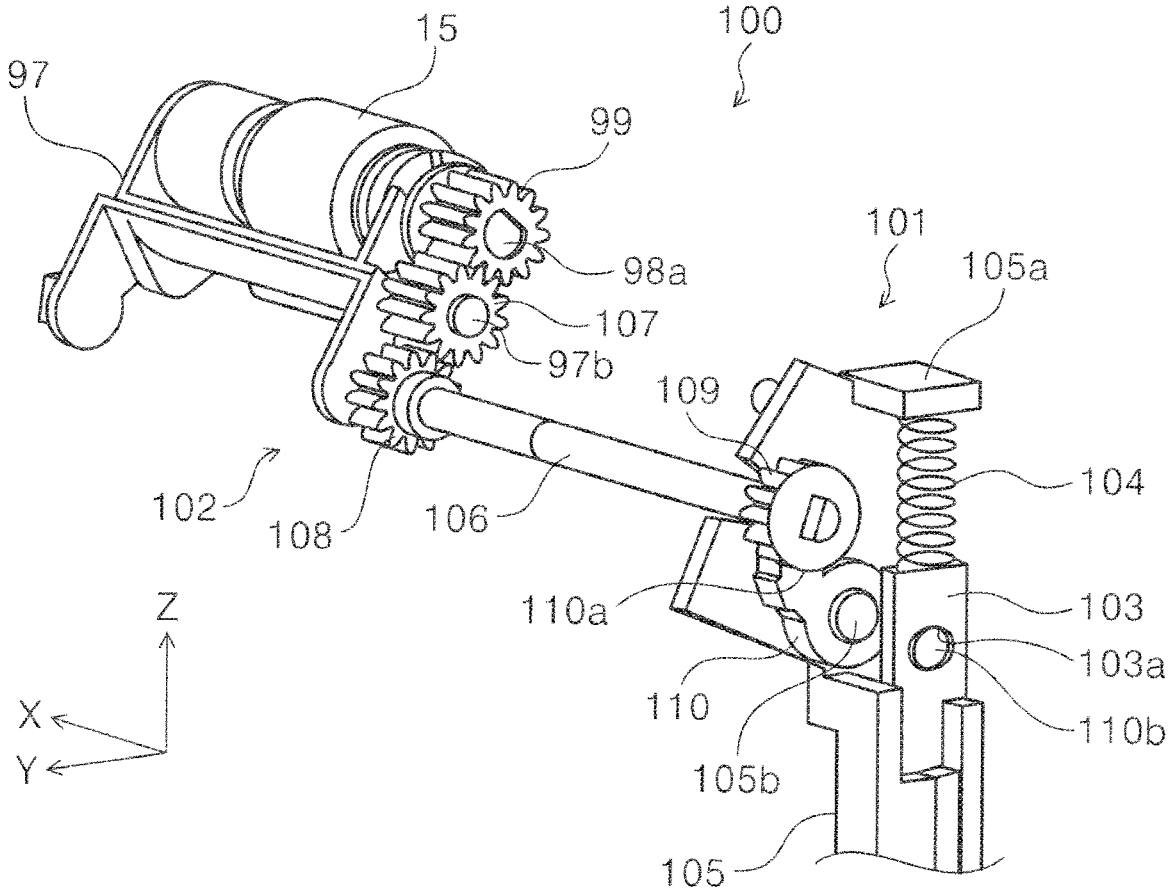
FIG. 17 is a perspective view of the separation switching section (the first embodiment) in a separation state.

As illustrated in FIG. 17, the separation switching section 100 includes a linkage shaft 106. The linkage shaft 106 is a shaft in which the shaft center line is parallel to the X axis direction and is rotatably provided with respect to a bearing portion (not illustrated) formed in the first frame 63. A third toothed wheel 108 is fixedly provided at an end portion of the linkage shaft 106 in the X direction. That is, the third toothed wheel 108 and the linkage shaft 106 do not rotate relatively.

The second toothed wheel 107 and the third toothed wheel 108 constitute a second mechanism portion 102.

A fourth toothed wheel 109 is fixedly provided at the end portion of the linkage shaft 106 in the −X direction. That is, the fourth toothed wheel 109 and the linkage shaft 106 do not rotate relatively.

A rotation regulating member 110 is provided at the lower side of the fourth toothed wheel 109. The rotation regulating member 110 is rotatably provided with respect to a shaft portion 105*b* formed in a guide member 105. The guide member 105 is a member fixed to the first frame 63 by a fixing section (not illustrated).

Figure 19:
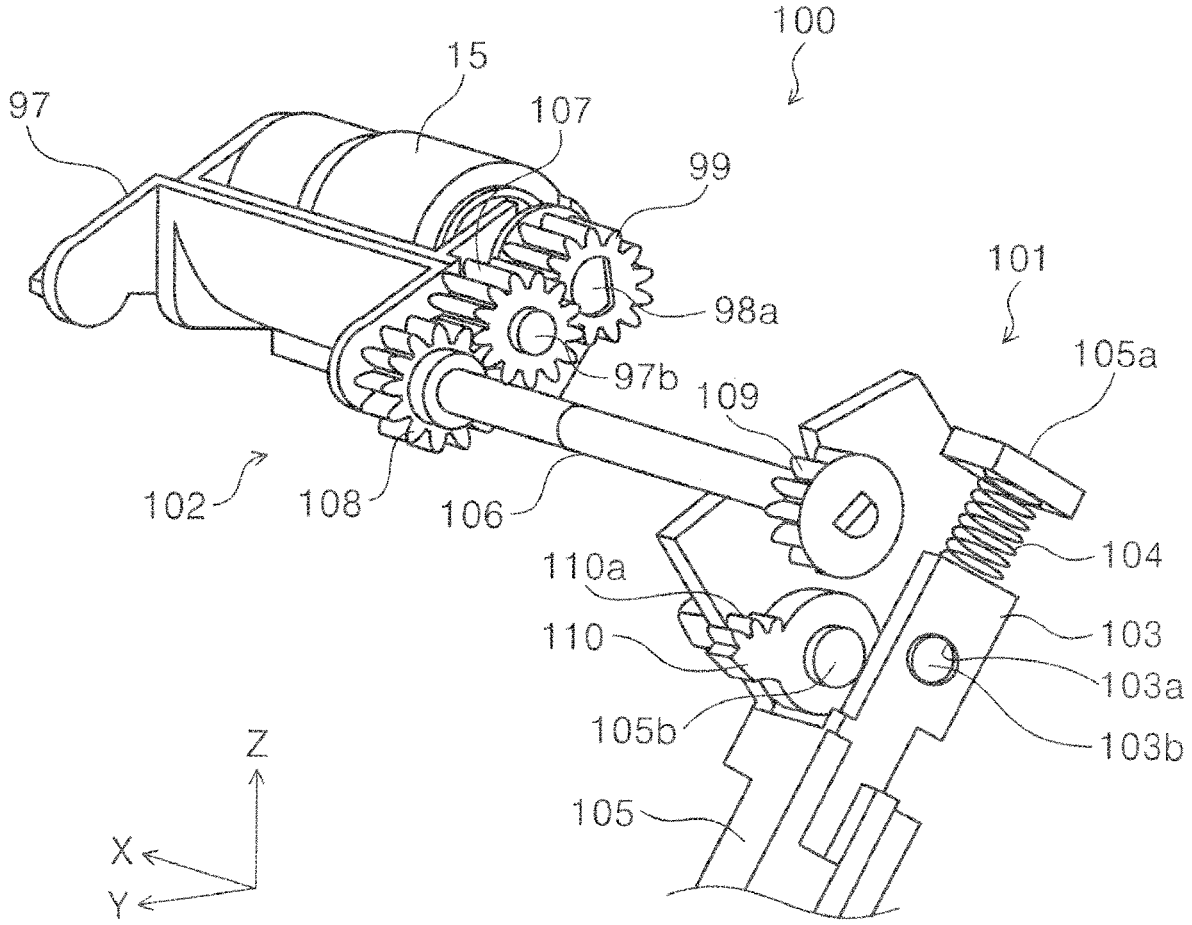
FIG. 19 is a perspective view of the separation switching section (the first embodiment) in a non-separation state.
Figure 20:
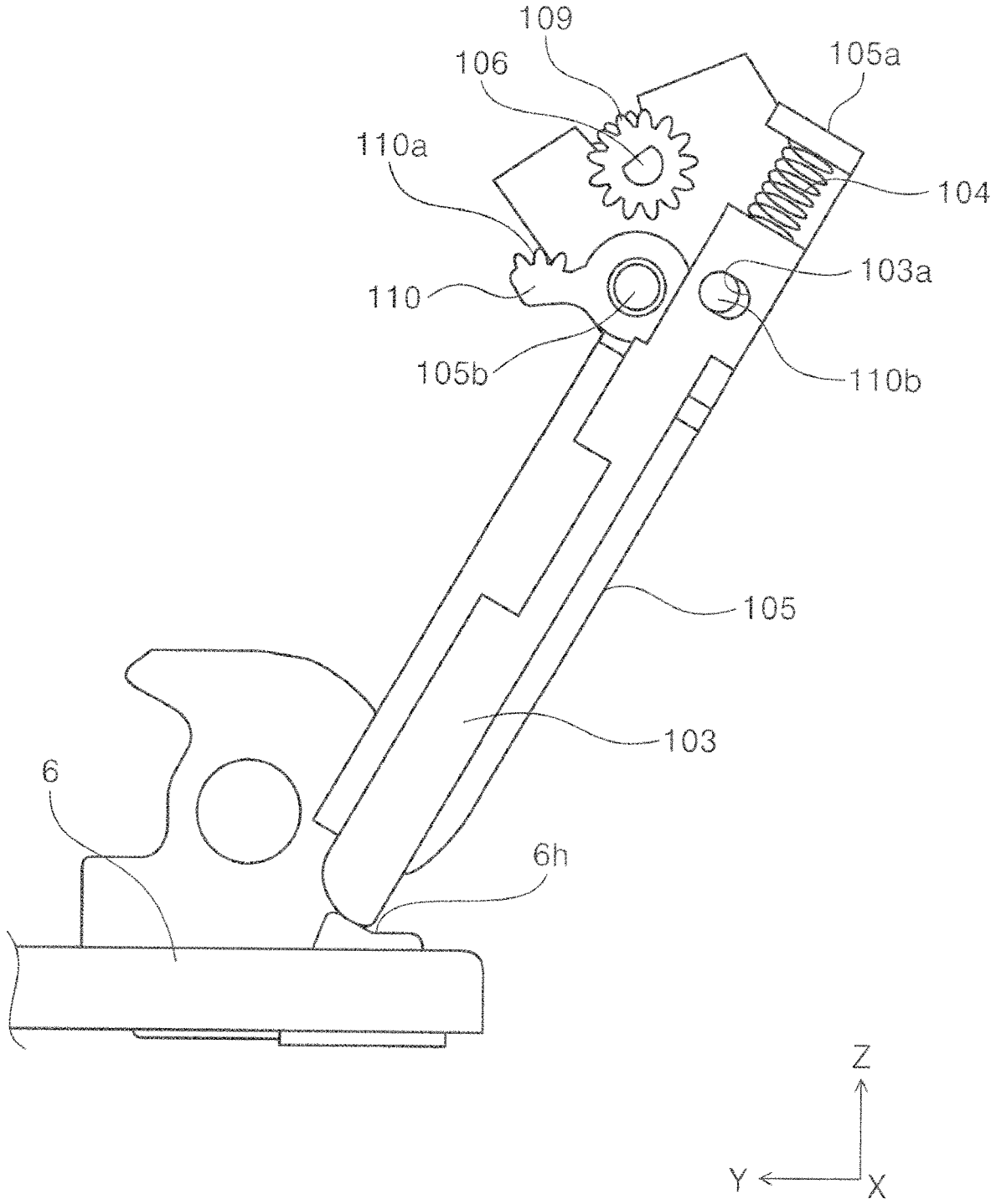
FIG. 20 is a side view of the separation switching section (the first embodiment) in the non-separation state.

A toothed portion 110*a* is formed in the rotation regulating member 110. The toothed portion 110*a* switches between a state of meshing with the fourth toothed wheel 109 (FIGS. 17 and 18) and a state of being separated from the fourth toothed wheel 109 (FIGS. 19 and 20) by the rotation of the rotation regulating member 110.

The rotation regulating member 110 is formed with a boss 110*b* protruding in the −X direction. The boss 110*b* is loosely inserted into a hole 103*a* that is formed in a link member 103.

The link member 103 is a member having a rod shape provided with respect to the guide member 105 in a slidable manner, and the lower end portion is in contact with a cam portion 6*h* that is formed at the main body supporting portion 6. The link member 103 is pressed against the cam portion 6*h* by a compression coil spring 104, which is an example of the pressing member. The reference numeral 105*a* indicates a spring holding portion formed in the guide member 105.

Since the link member 103 performs a sliding operation with respect to the guide member 105, the rotation regulating member 110 rotates due to the sliding operation of the link member 103. In other words, the linear operation of the link member 103 is converted into a rotational operation of the rotation regulating member 110.

The fourth toothed wheel 109, the rotation regulating member 110, the guide member 105, the link member 103, the compression coil spring 104, and the cam portion 6*h* constitute a first mechanism portion 101.

Figure 18:
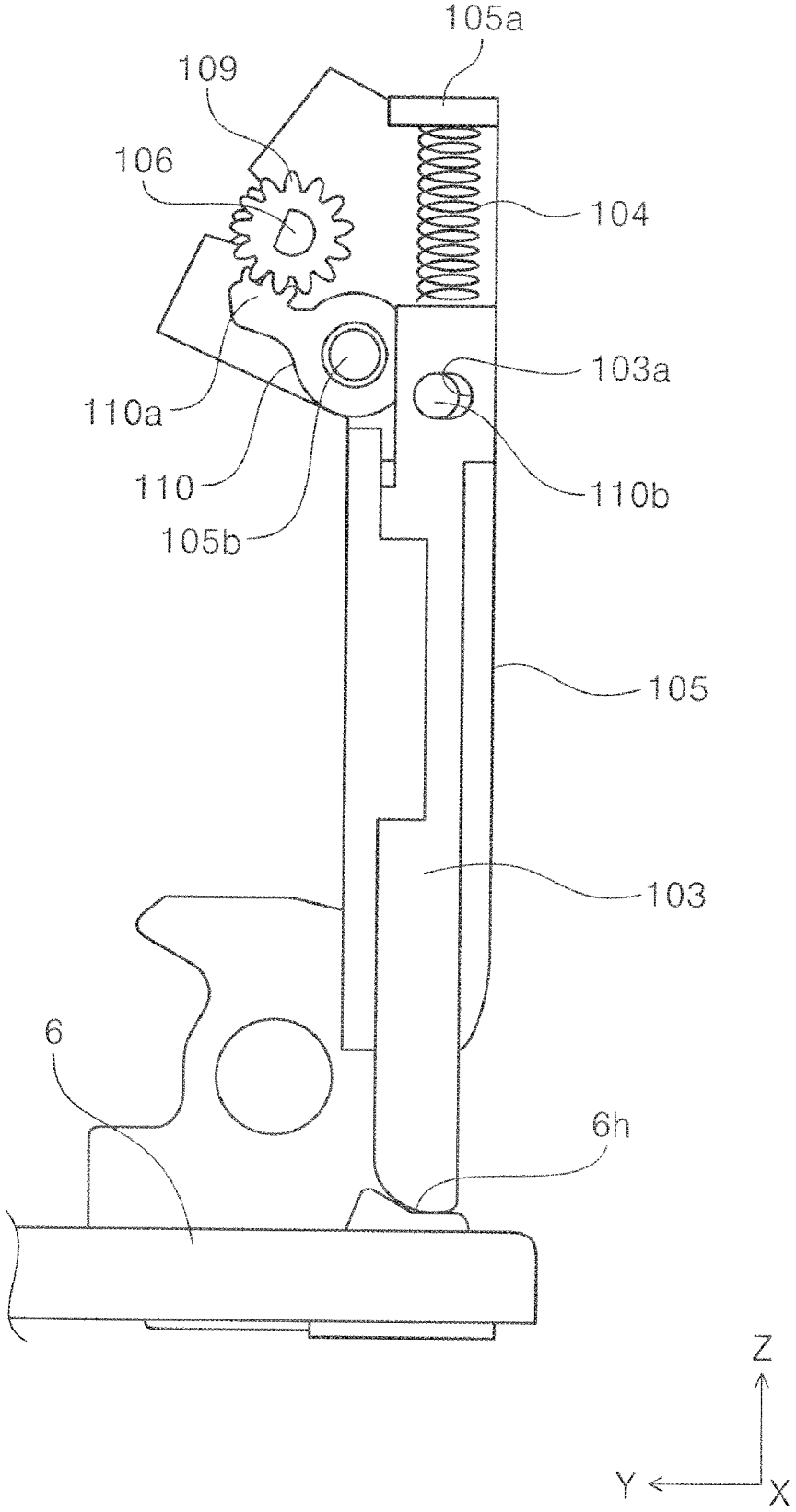
FIG. 18 is a side view of the separation switching section (the first embodiment) in the separation state.

When the apparatus main body 2 is in the normal reading posture, the toothed portion 110*a* of the rotation regulating member 110 meshes with the fourth toothed wheel 109 as illustrated in FIGS. 17 and 18. As a result, the rotation of the fourth toothed wheel 109 is regulated, the rotation of the linkage shaft 106, the third toothed wheel 108, the second toothed wheel 107, and the first toothed wheel 99 is regulated, and the rotation of the torque limiter 98 is regulated. That is, the separation roller 15 becomes in the separation state.

When the apparatus main body 2 performs the posture switching toward the booklet reading posture from the above state, the lower end portion of the link member 103 switches a position in contact with the cam portion 6*h*. The cam portion 6*h* in the +Y direction is higher than that in the −Y direction, and when the apparatus main body 2 performs the posture switching toward the booklet reading posture, the lower end portion of the link member 103 moves in the +Y direction with respect to the cam portion 6*h* (see FIG. 20). As a result, the link member 103 slides in the upward direction, the rotation regulating member 110 rotates, and the toothed portion 110*a* is separated from the fourth toothed wheel 109. As a result, the rotation of the fourth toothed wheel 109 is allowed, the rotation of the linkage shaft 106, the third toothed wheel 108, the second toothed wheel 107, and the first toothed wheel 99 is allowed, and the rotation of the torque limiter 98 is allowed. That is, the separation roller 15 becomes in the non-separation state.

When the apparatus main body 2 is in the booklet reading posture and when the apparatus main body 2 switches the posture to the normal reading posture from a state in which the separation roller 15 is in the non-separation state (FIGS. 19 and 20), the lower end portion of the link member 103 moves in the −Y direction with respect to the cam portion 6*h*. As a result, the link member 103 slides in the downward direction, the rotation regulating member 110 rotates, and the toothed portion 110*a* meshes with the fourth toothed wheel 109. As a result, the rotation of the fourth toothed wheel 109 is regulated, the rotation of the linkage shaft 106, the third toothed wheel 108, the second toothed wheel 107, and the first toothed wheel 99 is regulated, and the rotation of the torque limiter 98 is regulated. That is, the separation roller 15 becomes in the separation state.

As described above, the apparatus main body 2 of the scanner 1 is rotatably attached to the main body supporting portion 6 and is capable of being switched between the normal reading posture and the booklet reading posture in which an angle formed by the read transporting path R2 and the placement surface G is smaller than that of the normal reading posture, by the rotation of the apparatus main body 2. Further, the separation switching section 100, which is capable of switching the state between the separation state in which the separation roller 15 separates the documents and the non-separation state in which the separation roller 15 does not separate the documents, is included. The separation switching section 100 puts the separation roller 15 in the separation state when the apparatus main body 2 is in the normal reading posture and puts the separation roller 15 in the non-separation state when the apparatus main body 2 is in the booklet reading posture.

As a result, the user does not need to perform a dedicated operation for switching between the separation state and the non-separation state of the separation roller 15, and the usability of the apparatus is improved.

Further, the scanner 1 is provided with the torque limiter 98 that applies the rotational resistance to the separation roller 15, and the separation switching section 100 regulates the rotation of the torque limiter 98 and regulates the associative rotation of the separation roller 15 and the torque limiter 98 to form the separation state. Further, the separation switching section 100 allows the rotation of the torque limiter 98 and allows the associative rotation of the separation roller 15 and the torque limiter 98 to form the non-separation state. As a result, the separation state and the non-separation state of the separation roller 15 can be easily switched.

The separation switching section 100 includes the link member 103 that is a member engaged with the cam portion 6*h* formed at the main body supporting portion 6 and is capable of sliding in the apparatus main body 2, and the compression coil spring 104 that presses the link member 103 toward the cam portion 6*h*. The cam portion 6*h* has a shape in which the link member 103 slides in accordance with the rotation of the apparatus main body 2. By the link member 103 slides in accordance with the rotation of the apparatus main body 2, the switching is performed between the separation state that is a state in which the rotation of the torque limiter 98 is regulated and the non-separation state that is a state in which the rotation of the torque limiter 98 is allowed.

Thereby, the separation switching section 100 can be implemented with a simple configuration.

The torque limiter 98 is provided with the first toothed wheel 99, and the separation switching section 100 is provided with the first mechanism portion 101 that includes the link member 103, the second mechanism portion 102 that is related to the first toothed wheel 99, and the linkage shaft 106 that is a shaft capable of rotating while extending in a rotation shaft line direction of the torque limiter 98 and that links the first mechanism portion 101 and the second mechanism portion 102 together. Since the first mechanism portion 101 and the second mechanism portion 102 are linked together by the linkage shaft 106 in this way, the first mechanism portion 101 and the second mechanism portion 102 can be disposed separated from each other, and the degree of freedom in designing the apparatus is improved.

The second mechanism portion 102 is provided with the second toothed wheel 107 that meshes with the first toothed wheel 99 and the third toothed wheel 108 that is a toothed wheel meshing with the second toothed wheel 107 and that is provided at one end of the linkage shaft 106. The first mechanism portion 101 includes the fourth toothed wheel 109 that is provided at the other end of the linkage shaft 106 and the rotation regulating member 110 that is a member having the toothed portion 110*a* capable of meshing with the fourth toothed wheel 109 and in which the toothed portion 110*a* advances and retreats with respect to the fourth toothed wheel 109 when the rotation regulating member 110 is engaged with the link member 103 and rotates in accordance with the slide of the link member 103.

When the toothed portion 110*a* meshes with the fourth toothed wheel 109, the rotation of the torque limiter 98 is regulated and the separation state is established, and when the toothed portion 110*a* is separated from the fourth toothed wheel 109, the rotation of the torque limiter 98 is allowed and the non-separation state is established.

The first frame 63 constituting the base body of the apparatus main body 2 has a shape along a direction in which the read transporting path R2 extends, and the separation switching section 100 is disposed in an area formed at the lower side of the first frame 63. As a result, it is possible to suppress the increase in size of the apparatus by disposing the separation switching section 100 using the area formed at the lower side of the first frame 63.

The separation switching section 100 described above can also be modified as follows. Hereinafter, the separation switching section 100A according to a second embodiment will be described with reference to FIGS. 21 to 24. The same configurations as those already described in FIGS. 21 to 24 are designated with the same reference numerals, and duplicate description will be avoided below.

The separation switching section 100A has a first mechanism portion 101A and a second mechanism portion 102A, and the first mechanism portion 101A and the second mechanism portion 102A are linked together by the linkage shaft 106.

The second mechanism portion 102A includes a rotation regulating member 113 and a rotation cam 112. The first mechanism portion 101A includes a first rotation member 115, a second rotation member 116, a guide member 105, a link member 103, a compression coil spring 104, and a cam portion 6*h*.

Figure 21:
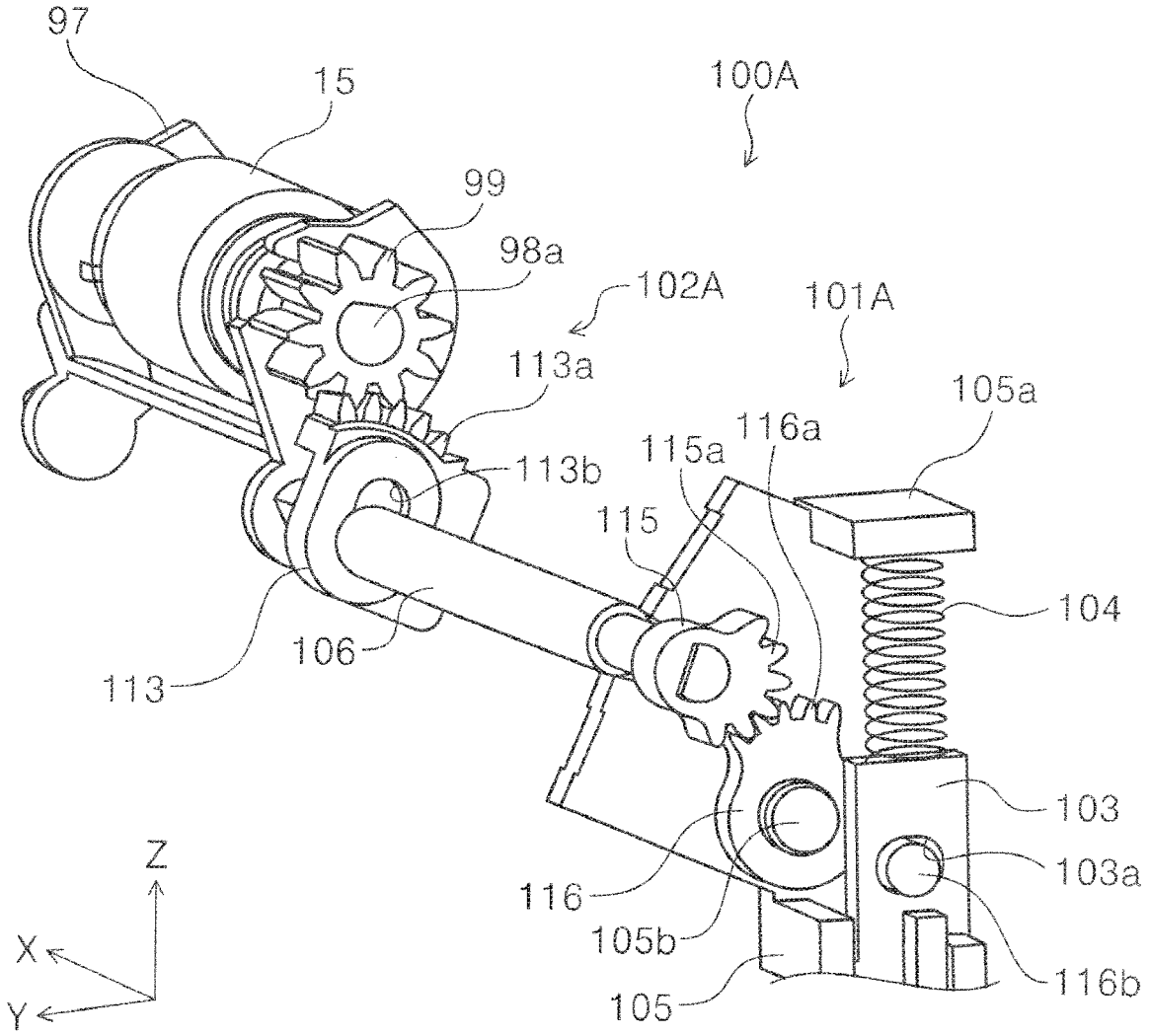
FIG. 21 is a perspective view of a separation switching section (a second embodiment) in a separation state.
Figure 22:
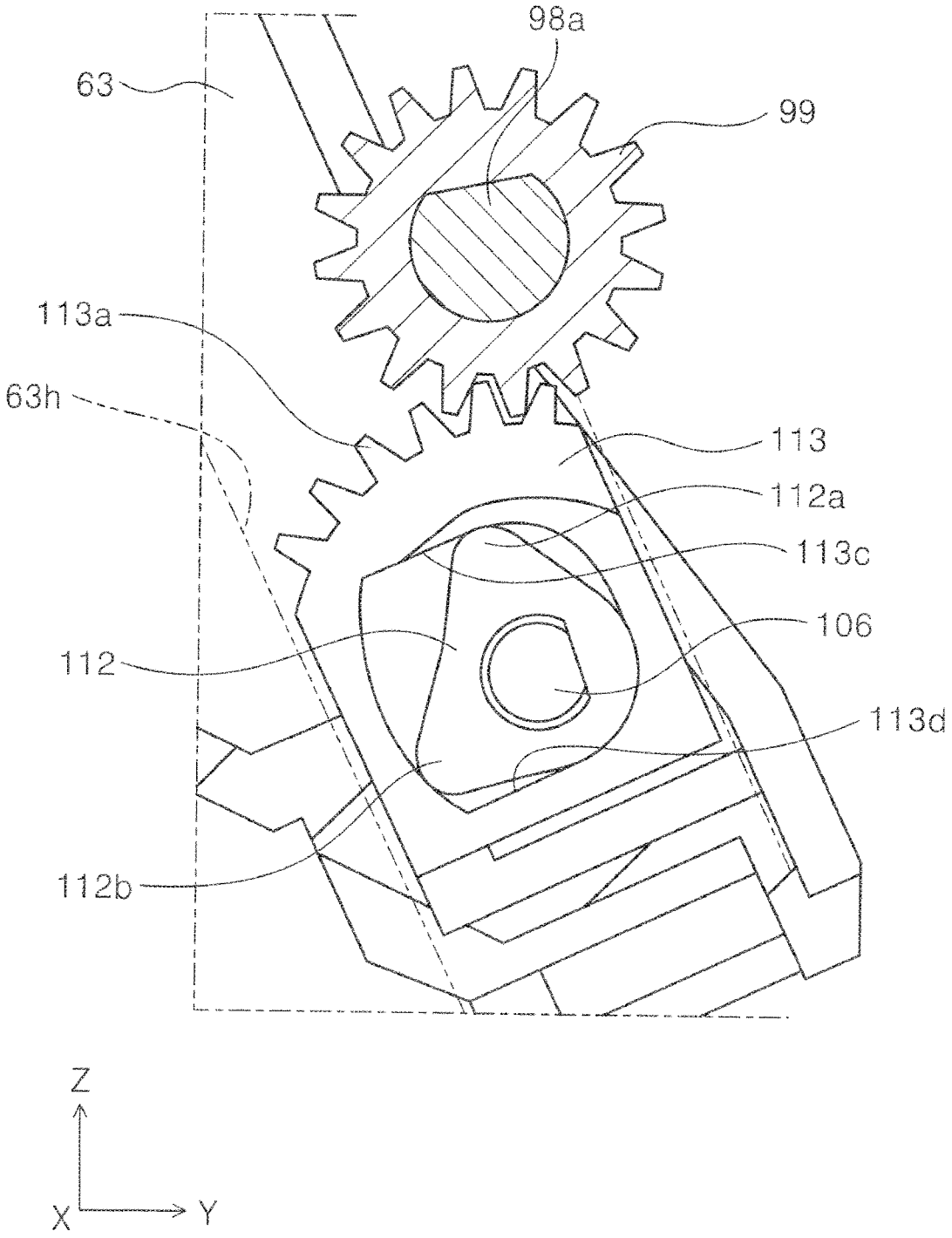
FIG. 22 is a side view of a main portion of the separation switching section (the second embodiment) in the separation state.

As illustrated in FIGS. 21 and 22, the rotation regulating member 113 is provided at the lower side of the first toothed wheel 99. The rotation regulating member 113 is provided along the guide groove 63*h* formed in the first frame 63 in a displaceable manner and advances and retreats with respect to the first toothed wheel 99 by being displaced along the guide groove 63*h*.

A toothed portion 113*a* is formed in the rotation regulating member 113, and by the displacement of the rotation regulating member 113, the switching is possible between a state in which the toothed portion 113*a* meshes with the first toothed wheel 99 and a state in which the toothed portion 113*a* is separated from the first toothed wheel 99.

When the toothed portion 113*a* meshes with the first toothed wheel 99, the rotation of the first toothed wheel 99 is regulated, so that the separation roller 15 becomes in the separation state. Further, when the toothed portion 113*a* is separated from the first toothed wheel 99, the rotation of the first toothed wheel 99 is allowed, so that the separation roller 15 becomes in the non-separation state.

The rotation regulating member 113 is formed with an elongated hole 113*b* along the displacement direction of the rotation regulating member 113, and the linkage shaft 106 is passed through the elongated hole 113*b*. As illustrated in FIG. 22, a first cam follower 113*c* and a second cam follower 113*d* are formed at a surface of the rotation regulating member 113 in the +X direction, and a rotation cam 112 faces the cam followers.

The rotation cam 112 is fixed to one end of the linkage shaft 106. That is, the rotation cam 112 and the linkage shaft 106 do not rotate relatively. The rotation cam 112 has a first cam portion 112*a* and a second cam portion 112*b* protruding in the radial direction.

A first rotation member 115 is fixedly provided at an end portion of the linkage shaft 106 in the −X direction. That is, the first rotation member 115 and the linkage shaft 106 do not rotate relatively. The second rotation member 116 is rotatably provided on the shaft portion 105*b* of the guide member 105. A boss 116*b* is formed in the second rotation member 116, and the boss 116*b* is loosely inserted into a hole 103*a* formed in the link member 103. Therefore, the sliding operation of the link member 103 causes the second rotation member 116 to rotate.

A toothed portion 116*a* is formed in the second rotation member 116, and the toothed portion 116*a* meshes with a toothed portion 115*a* formed in the first rotation member 115.

With such a configuration, when the second rotation member 116 is rotated by the slide of the link member 103, the first rotation member 115, the linkage shaft 106, and the rotation cam 112 are rotated.

When the apparatus main body 2 is in the normal reading posture, the toothed portion 113*a* of the rotation regulating member 113 meshes with the first toothed wheel 99 as illustrated in FIGS. 21 and 22. This state is maintained by the first cam portion 112*a* of the rotation cam 112 pushing up the first cam follower 113*c* of the rotation regulating member 113.

As a result, the rotation of the torque limiter 98 is regulated, and the separation roller 15 becomes in the separation state.

When the apparatus main body 2 performs the posture switching toward the booklet reading posture from the above state, the link member 103 is pushed up by the cam portion 6*h* as in the first embodiment described above. As a result, the second rotation member 116, the first rotation member 115, the linkage shaft 106, and the rotation cam 112 rotate from the state illustrated in FIGS. 21 and 22 to the state illustrated in FIGS. 23 and 24. The rotational direction of the rotation cam 112 at this time is a counterclockwise direction in FIG. 22.

Figure 23:
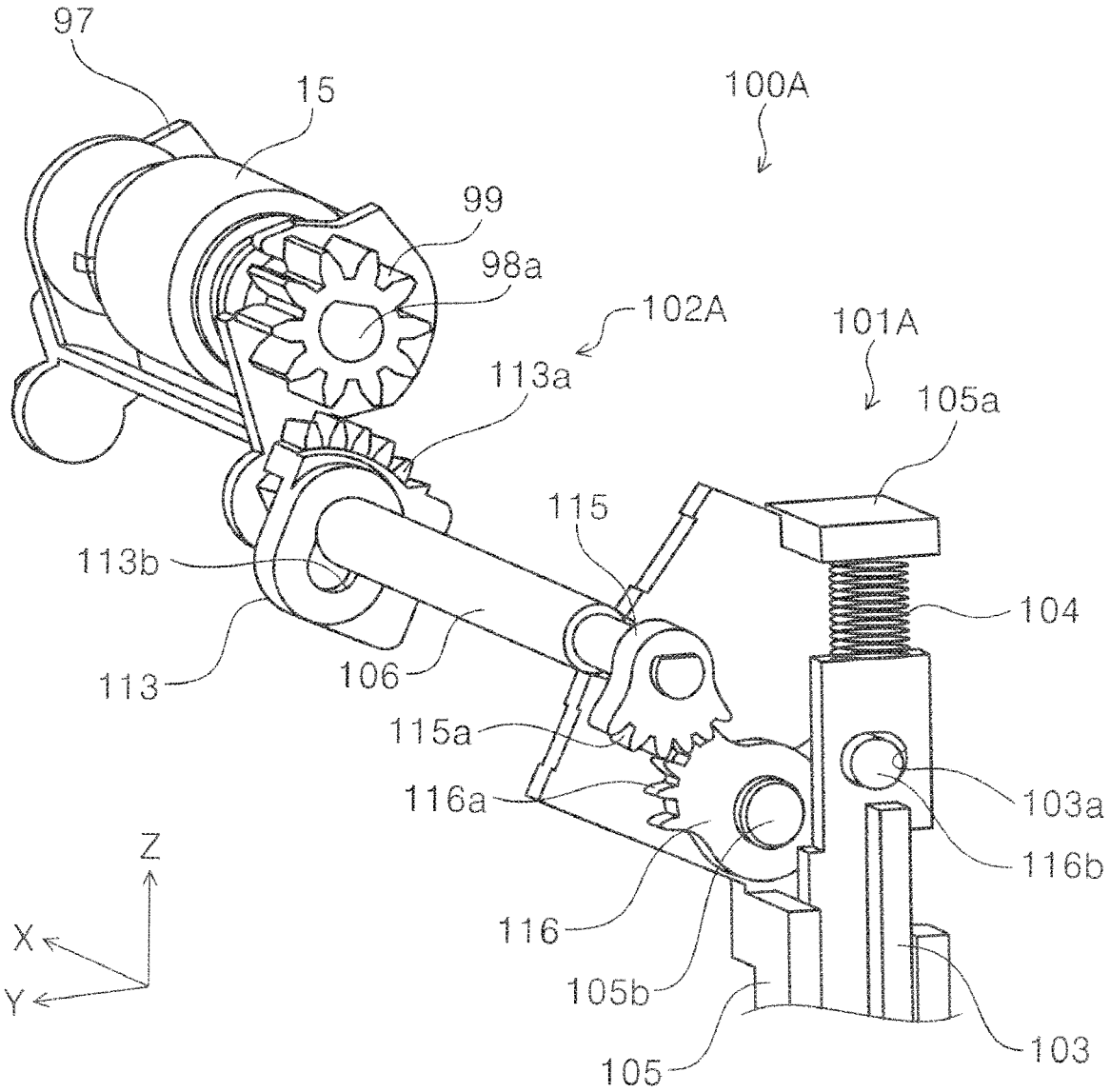
FIG. 23 is a perspective view of the separation switching section (the second embodiment) in a non-separation state.
Figure 24:
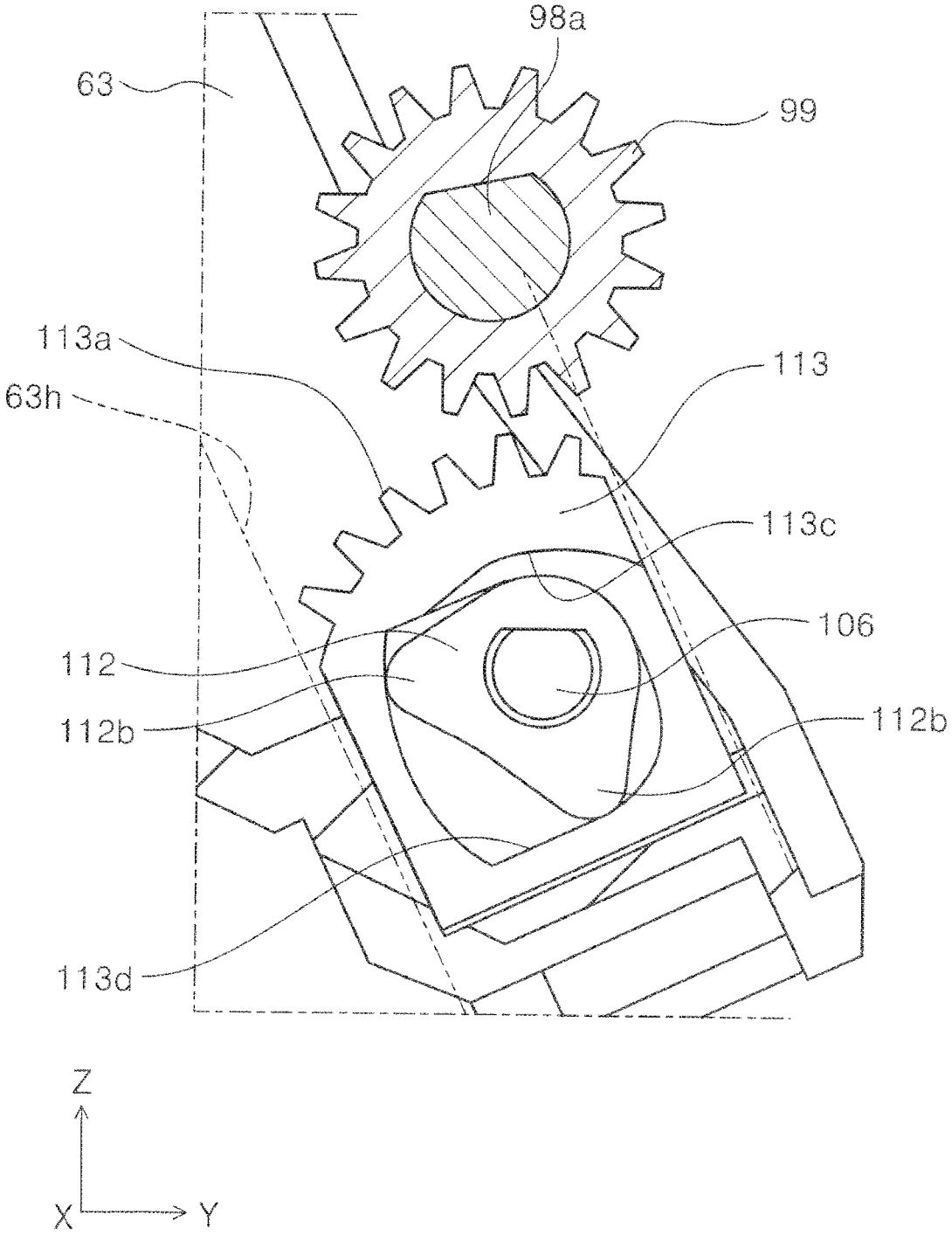
FIG. 24 is a side view of the main portion of the separation switching section (the second embodiment) in the non-separation state.

When the rotation cam 112 rotates counterclockwise from the state of FIG. 22, the second cam portion 112*b* pushes down the second cam follower 113*d* as illustrated with the change from FIG. 22 to FIG. 24. As a result, the rotation regulating member 113 is separated from the first toothed wheel 99, that is, the meshing between the toothed portion 113*a* and the first toothed wheel 99 is released, and the rotation of the torque limiter 98 is allowed. That is, the separation roller 15 becomes in the non-separation state.

When the apparatus main body 2 switches the posture to the normal reading posture from the state in which the apparatus main body 2 is in the booklet reading posture and the separation roller 15 is in the non-separation state, the link member 103 slides in the downward direction, the rotation cam 112 rotates clockwise from the state illustrated in FIG. 24, the first cam portion 112*a* pushes up the rotation regulating member 113, and the toothed portion 113*a* meshes with the first toothed wheel 99. As a result, the rotation of the torque limiter 98 is regulated, and the separation roller 15 becomes in the separation state.

As described above, in the second embodiment, the second mechanism portion 102A includes the rotation regulating member 113 that is a member having the toothed portion 113*a* meshing with the first toothed wheel 99 and is capable of advancing and retreating with respect to the first toothed wheel 99, and the rotation cam 112 that is a rotation cam provided at one end of the linkage shaft 106 and that switches between a state in which the rotation regulating member 113 is caused to advance toward the first toothed wheel 99 and a state in which the rotation regulating member 113 is caused to retreat from the first toothed wheel 99 by the rotation of the rotation cam 112. The first mechanism portion 101A has a configuration in which the linkage shaft 106 is rotated when the first mechanism portion 101A rotates in accordance with the slide of the link member 103. In the first embodiment, since the rotation of the first toothed wheel 99 is directly regulated by the rotation regulating member 113, the backlash in meshing of toothed wheels can be suppressed and twisting of the linkage shaft 106 does not intervene, so the separation state of the separation roller 15 can be appropriately formed.

In each of the above embodiments, when a displayer that is provided in the external apparatus 500 (see FIG. 12) is included, or when the scanner 1 includes a displayer, the displayer may display whether the separation roller 15 is in the separation state or the non-separation state. At that time, the displayer may also display whether the apparatus main body 2 is in the normal reading posture or the booklet reading posture.

Next, the configuration around the feeding roller 14 and the separation roller 15 will be described in detail with reference to FIG. 27 onwards and other drawings as necessary.

Figure 27:
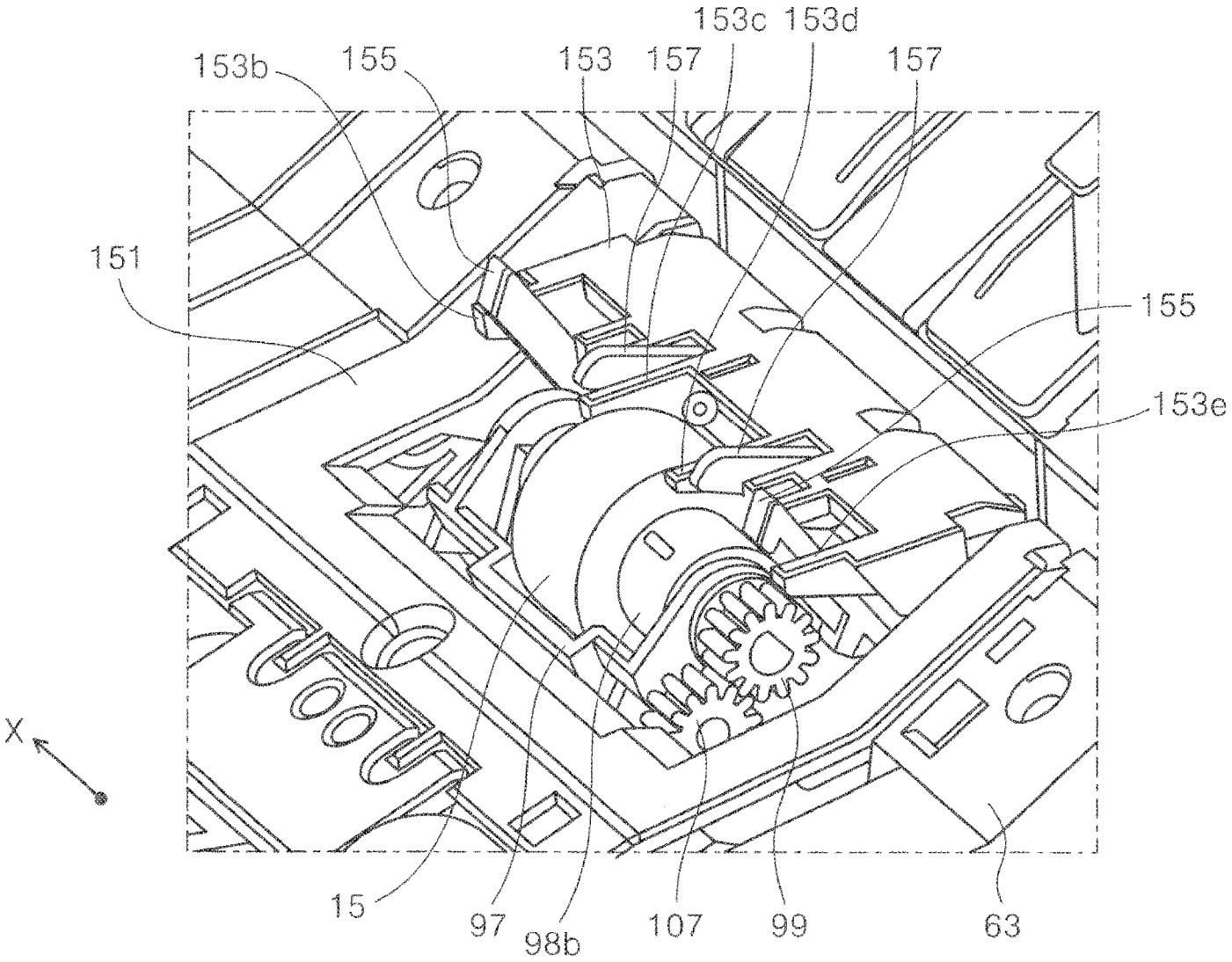
FIG. 27 is a perspective view illustrating a configuration around the separation roller.

A guide member 151, a set guide 153, a set flap 155, and a pushing lever 157 are provided around the separation roller 15 as illustrated in FIG. 27. The set guide 153 is an example of a path forming member. The pushing lever 157 is an example of a pushing portion.

A recess portion 63*m* (see FIG. 28) is formed the upstream of the first frame 63 in the feeding direction and is formed at the center portion in the X axis direction, and the separation roller 15, the guide member 151, the set guide 153, the set flap 155, and the pushing lever 157 are provided in the recess portion 63*m*.

The guide member 151 is a member having a frame shape, and the separation roller 15, the set guide 153, the set flap 155, and the pushing lever 157 are disposed inside the guide member 151. The guide member 151 is provided in an attachable and detachable manner with respect to the first frame 63 by a snap-fit structure (not shown) and forms part of the document feeding path in a state of being mounted.

Figure 28:
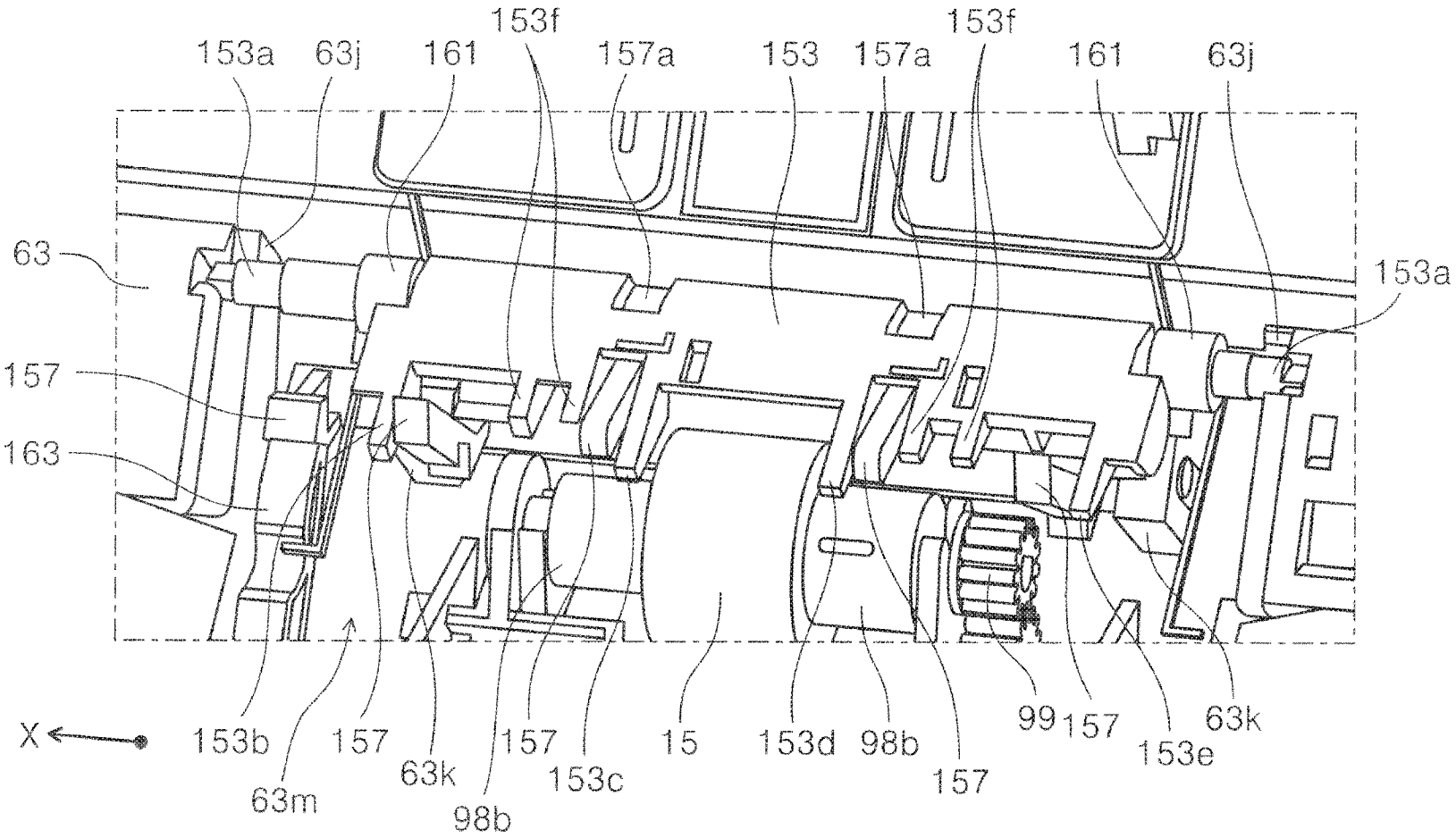
FIG. 28 is a diagram illustrating a state in which a guide member is removed from a state in FIG. 27.
Figure 29:
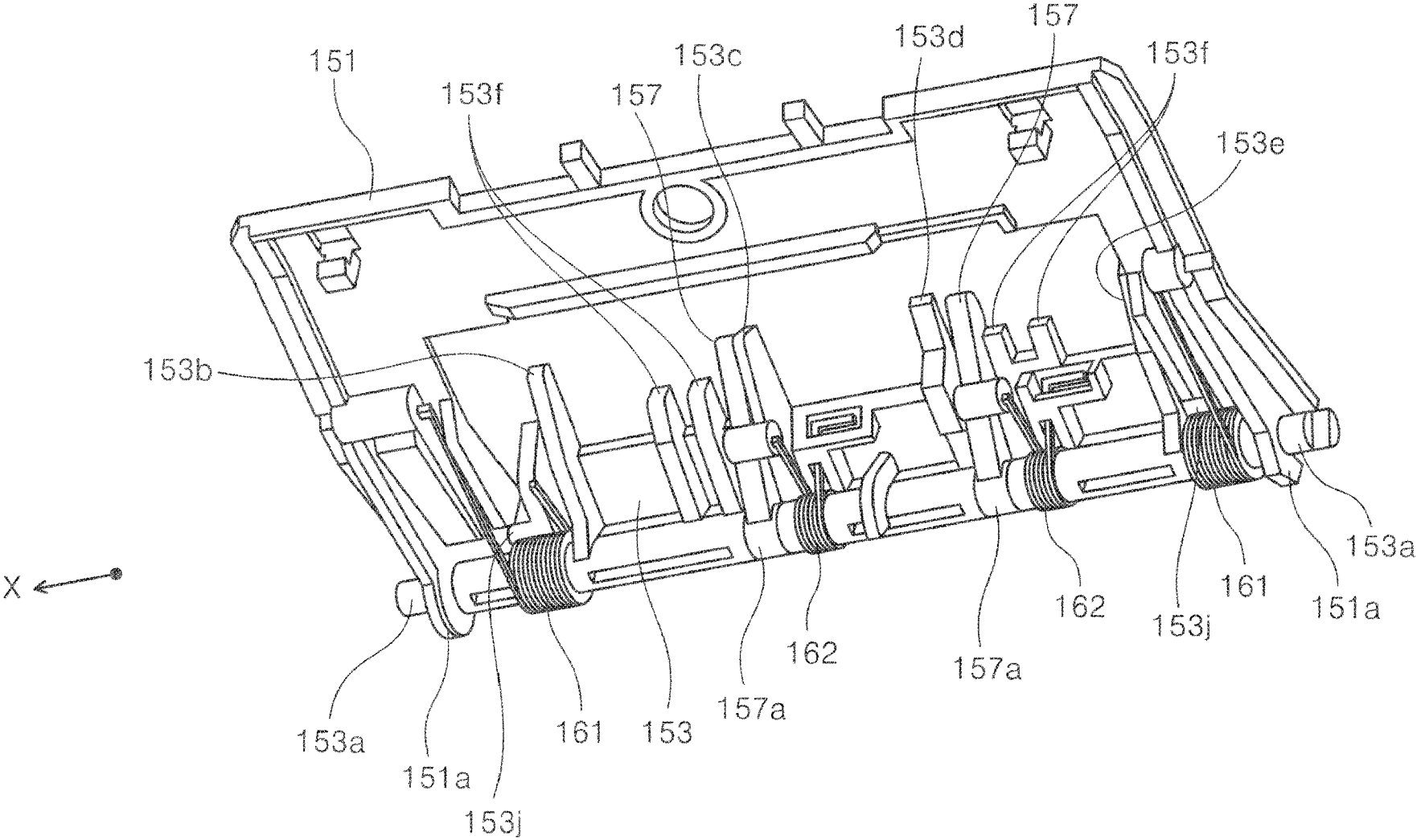
FIG. 29 is a perspective view of the guide member, a set guide, and a pushing lever viewed from a lower side.
Figure 31:
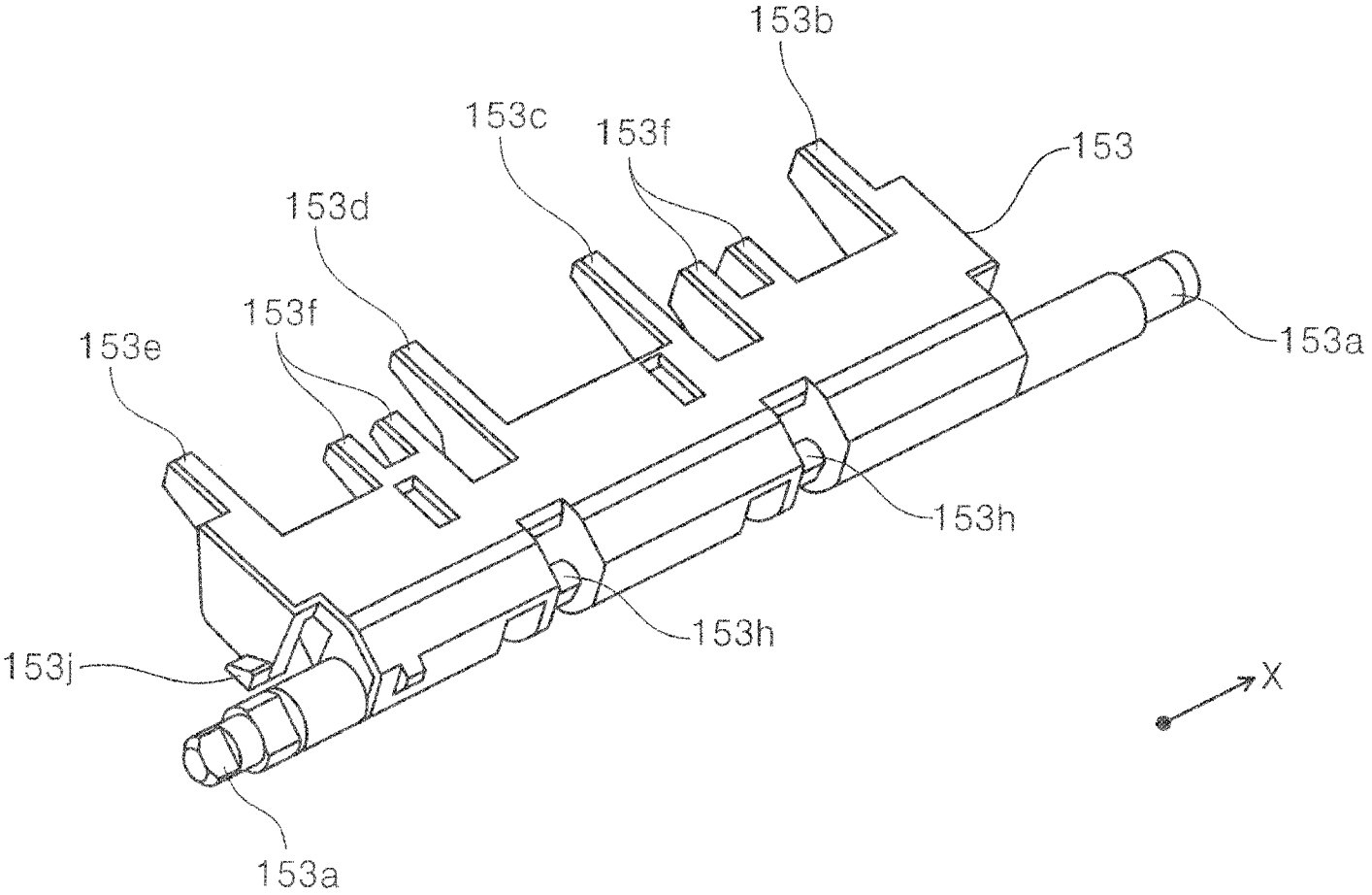
FIG. 31 is a perspective view of the set guide.

As illustrated in FIG. 31, the set guide 153 includes rotation shafts 153*a* on both sides in the X axis direction. As illustrated in FIG. 29, the guide member 151 is formed with bearing portions 151*a* on both sides in the X axis direction, and the rotation shafts 153*a* of the set guide 153 are pivotally supported by the bearing portions 151*a* in a rotatable manner. As illustrated in FIG. 28, the recess portion 63*m* of the first frame 63 is provided with regulation portions 63*j* on both sides in the X axis direction, and when the guide member 151 is mounted on the first frame 63, the movement of the rotation shafts 153*a* of the set guide 153 in the feeding direction is regulated by the regulation portions 63*j*.

First springs 161 are provided on both sides of the set guide 153 in the X axis direction. The first spring 161 is a torsion coil spring in the present embodiment, and a pressing force is generated between the guide member 151 and the set guide 153. The set guide 153 is pressed by the first spring 161 in the rotational direction (the clockwise direction in FIG. 33) in which the downstream in the feeding direction is directed toward the feeding roller 14 about the rotation shaft 153*a*.

As illustrated in FIGS. 29 and 31, contact portions 153*j* are formed on both side surfaces of the set guide 153 in the X axis direction, and when the contact portions 153*j* come into contact with the lower side of the guide member 151, the rotation of the set guide 153 (the rotation in the clockwise direction in FIG. 33) is regulated.

As illustrated in FIG. 4, when the second unit 4 is opened with respect to the first unit 3, the contact portions 153*j* come into contact with the lower side of the guide member 151. When the second unit 4 is closed with respect to the first unit 3 from this state, the feeding roller 14 comes into contact with long ribs 153*c* and 153*d* of the set guide 153, thereby the set guide 153 rotates in the counterclockwise direction in FIG. 33 by a predetermined amount. In this state, the contact portions 153*j* are separated from the lower side of the guide member 151.

A plurality of ribs extending in the document feeding direction are formed on the set guide 153 at predetermined intervals in the X axis direction. The plurality of ribs is composed of long ribs 153*b*, 153*c*, 153*d*, and 153*e* and four short ribs 153*f* whose lengths in the document feeding direction are shorter than those of the long ribs.

Two short ribs 153*f* are formed between the long rib 153*b* and the long rib 153*c*, and two short ribs 153*f* are formed between the long rib 153*d* and the long rib 153*e*.

Figure 30:
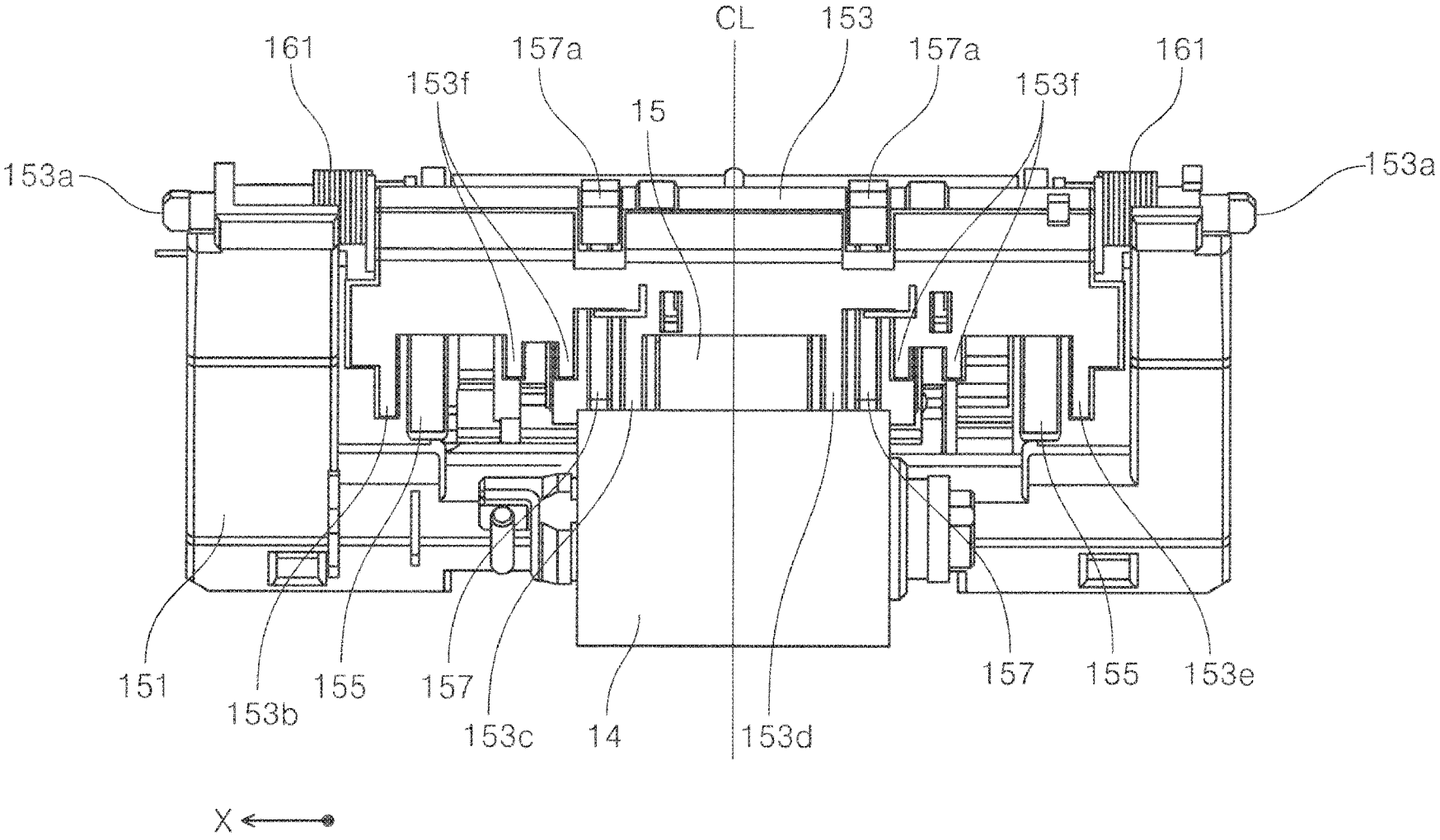
FIG. 30 is a plan view illustrating a configuration around the separation roller.

In FIG. 30, a straight line CL is a straight line that passes through the center of the document in the X axis direction and that is parallel in the document feeding direction, and the plurality of ribs are disposed to be line symmetrical about the straight line CL. Specifically, the long rib 153*b* and the long rib 153*e* are disposed to be line symmetrical about the straight line CL, and the long rib 153*c* and the long rib 153*d* are disposed to be line symmetrical about the straight line CL. Two short ribs 153*f* positioned in the +X direction and two short ribs 153*f* positioned in the −X direction with respect to the straight line CL are disposed to be line symmetrical about the straight line CL.

The ribs do not necessarily have to be disposed line symmetrically about the straight line CL.

Figure 33:
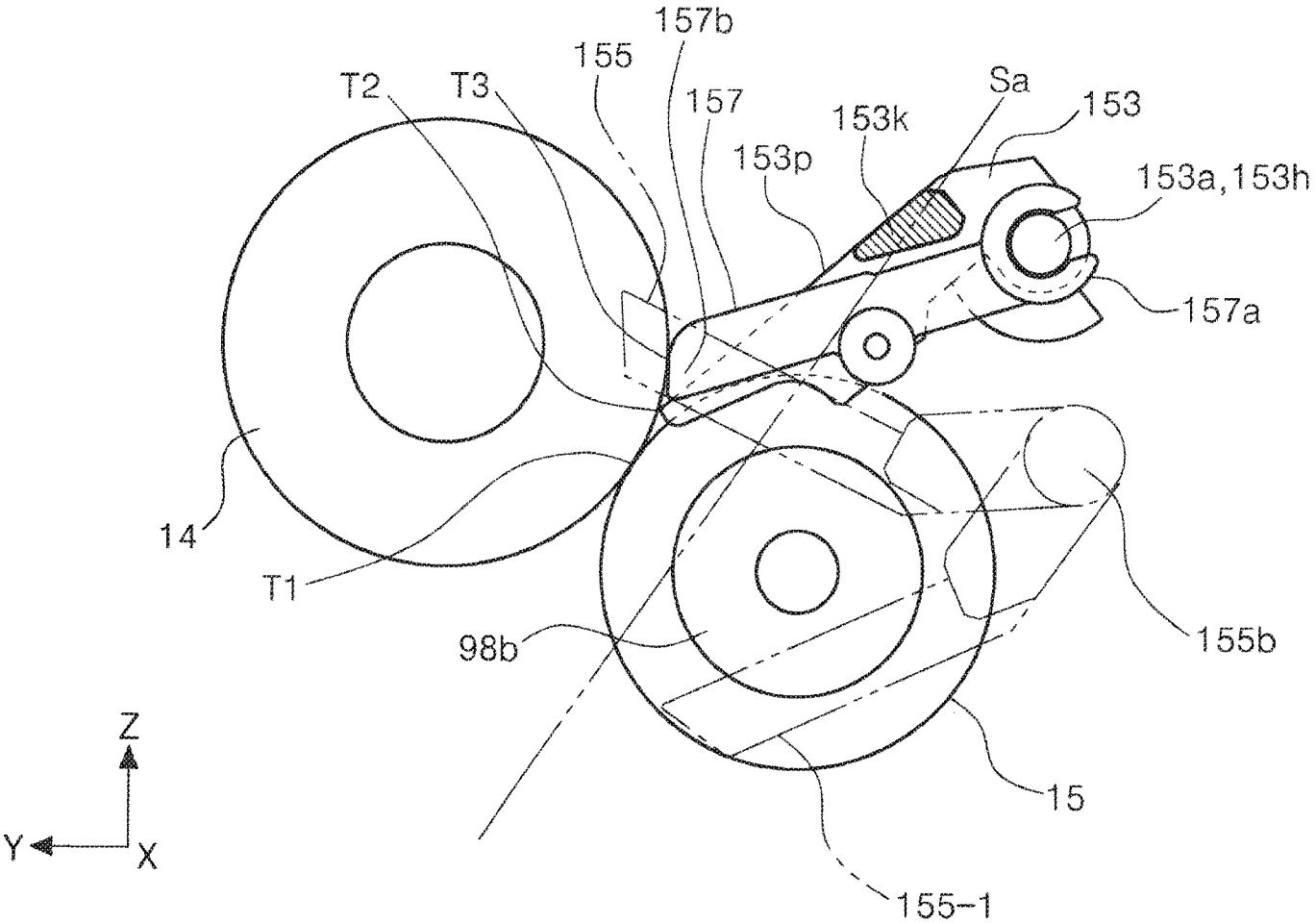
FIG. 33 is a side sectional view illustrating a configuration around the separation roller.

The long rib 153*c* and the long rib 153*d* are formed at positions where the long rib 153*c* and the long rib 153*d* can come into contact with a cylindrical portion 98*b* forming the outer peripheral of the torque limiter 98 (see FIG. 16), and the long ribs 153*c* and 153*d* are configured to come into contact with the cylindrical portion 98*b* when the set guide 153 rotates in the counterclockwise direction in FIG. 33.

As illustrated in FIG. 31, the set guide 153 is formed with two shaft portions 153*h*, and the pushing lever 157 is pivotally supported on the shaft portion 153*h* as shown in FIG. 29. The reference numeral 157*a* indicates a shaft fitting portion that fits the shaft portion 153*h* in the pushing lever 157. In the present embodiment, a rotation center position of the pushing lever 157 and a rotation center position of the set guide 153 coincide with each other.

The rotation center position of the pushing lever 157 and the rotation center position of the set guide 153 may be configured to be different from each other.

A second spring 162 is provided at a position adjacent to the pushing lever 157. The second spring 162 is a torsion coil spring in the present embodiment and a pressing force is generated between the pushing lever 157 and the set guide 153. The pushing lever 157 is pressed by the second spring 162 in the rotational direction (the clockwise direction in FIG. 33) in which the downstream in the feeding direction is directed toward the feeding roller 14 about the shaft portion 153*h*. That is, the pushing lever 157 is pressed by the second spring 162 in a direction in which a front end portion 157*b* faces the feeding roller 14.

As illustrated in FIG. 33, the set guide 153 is formed with a regulation portion 153*k*, and when the pushing lever 157 comes into contact with the regulation portion 153*k*, the rotation of the pushing lever 157 (the rotation in the clockwise direction in FIG. 33) is regulated.

As illustrated in FIG. 4, when the second unit 4 is opened with respect to the first unit 3, the pushing lever 157 comes into contact with the regulation portion 153*k*. When the second unit 4 is closed with respect to the first unit 3 from this state, the feeding roller 14 comes into contact with the pushing lever 157, thereby the pushing lever 157 rotates in the counterclockwise direction in FIG. 33 by a predetermined amount. By regulating the rotation limit of the pushing lever 157 when the second unit 4 is open by the regulation portion 153*k*, the pushing lever 157 can be rotated appropriately when the second unit 4 is closed. In this state, as illustrated in FIG. 33, the pushing lever 157 is slightly separated from the regulation portion 153*k*.

As shown in FIGS. 28, 29, and 30, one of the two pushing levers 157 protrudes toward the document feeding path from between the long rib 153*c* and the short rib 153*f*, which is positioned in the +X direction with respect to the long rib 153*c*, in the set guide 153. The other of the two pushing levers 157 protrudes toward the document feeding path from between the long rib 153*d* and the short rib 153*f*, which is positioned in the −X direction with respect to the long rib 153*d*, in the set guide 153.

The two pushing levers 157 are disposed at positions line symmetrical about the straight line CL as illustrated in FIG. 30. Each of the two pushing levers 157 can be rotated independently. The two pushing levers 157 are also positioned within the width of the feeding roller 14 in the X axis direction and positioned at both end portions of the feeding roller 14.

Next, the set flaps 155 are disposed between the long rib 153*b* and the short rib 153*f*, which is adjacent to the long rib 153*b*, of the set guide 153, and disposed between the long rib 153*e* and the short rib 153*f*, which is adjacent to the long rib 153*e*, respectively.

Figure 32:
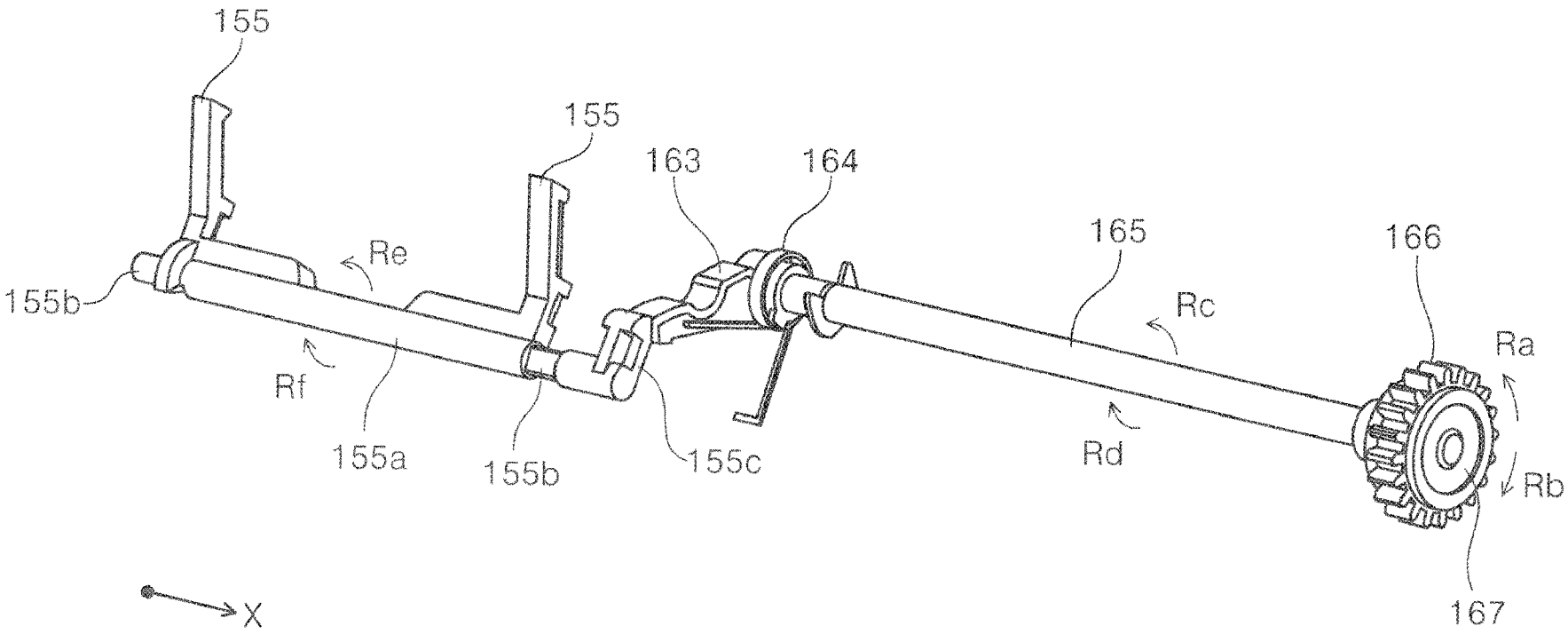
FIG. 32 is a perspective view illustrating a set flap and part of a mechanism that drives the set flap.

As illustrated in FIG. 32, the two set flaps 155 are provided on a base portion 155*a* having a substantially shaft shape extending in the X axis direction and rotate integrally.

Shaft portions 155*b* are formed on both sides of the base portion 155*a* in the X axis direction, and the shaft portions 155*b* serve as rotation shafts of the set flap 155. The shaft portion 155*b* is rotatably supported by a bearing portion 63*k* formed in the recess portion 63*m* of the first frame 63 as illustrated in FIG. 28.

A cam follower portion 155*c* is formed in the +X direction with respect to the shaft portion 155*b* in the +X direction in FIG. 32. A set flap cam 163 is provided in the cam follower portion 155*c* in a contactable manner. The set flap cam 163 is fixed to the end portion of the shaft 165 in the −X direction, and a toothed wheel 166 is provided in the end portion of the shaft 165 in the +X direction via a one-way clutch 167. The driving power of the transporting motor 50 (see FIG. 12) is transmitted to the toothed wheel 166, and the toothed wheel 166 rotates as the transporting motor 50 rotates. The power of the transporting motor 50 is transmitted to the shaft 165 via the toothed wheel 166 and the one-way clutch 167.

A spring 164 is provided in the set flap cam 163. The spring 164 applies a pressing force to a spring hooking portion (not shown) and the set flap cam 163, thereby the pressing force is being applied to the set flap cam 163, that is, the shaft 165 in an arrow Rc direction.

FIG. 32 illustrates a state in FIG. 33, that is, the feeding standby state, and in this state, the cam follower portion 155*c* comes into contact with the set flap cam 163, and the set flap 155 closes the document feed path as shown in FIG. 33. In this state, the front end of the document to be set comes into contact with the set flap 155 and is regulated from entering between the feeding roller 14 and the separation roller 15.

In this state, the set flap cam 163, that is, the shaft 165 is regulated from rotating in the arrow Rc direction by the action of the one-way clutch 167. The toothed wheel 166 is stopped due to the load in a power transmission path between the toothed wheel 166 and the transporting motor 50.

When the transporting motor 50 rotates forward from this state and the toothed wheel 166 rotates in an arrow Ra direction, the shaft 165 rotates in the arrow Rc direction by the pressing force of the spring 164, that is, the set flap cam 163 rotates in the arrow Rc direction. As a result, the set flap cam 163 is disengaged from the cam follower portion 155*c*, the set flap 155 rotates in an arrow Rf direction, and the set flap 155 retreats from the document feeding path as indicated by the reference numeral 155-1 in FIG. 33. When the set flap 155 retreats from the document feeding path, the set document can be directed between the feeding roller 14 and the separation roller 15.

By forward rotation of the transporting motor 50, each roller, which is provided in the document transport path, rotates in a direction in which the document is transported downstream. At this time, the toothed wheel 166 in FIG. 32 continues to rotate in the arrow Ra direction, but the torque of the transporting motor 50 is not transmitted to the shaft 165 due to the action of the one-way clutch 167.

When the transporting motor 50 rotates reversely in a state in which the set flap 155 retreats from the document feeding path, the toothed wheel 166 rotates in an arrow Rb direction in FIG. 32. When the toothed wheel 166 rotates in the arrow Rb direction, the torque in the arrow Rd direction is transmitted to the shaft 165 by the action of the one-way clutch 167. As a result, the shaft 165, that is, the set flap cam 163 rotates in the arrow Rd direction against the pressing force of the spring 164 and pushes up the cam follower portion 155*c*, and the set flap 155 rotates in an arrow Re direction, and then the state returns to the states illustrated in FIG. 32.

The configuration around the separation roller 15 has been described above, and the set guide 153 will be further described below.

As described above, FIG. 33 illustrates the feeding standby state and illustrates a state in which no document is set. The reference numeral T1 indicates a contact position between the feeding roller 14 and the separation roller 15 and indicates a contact position when it is assumed that both rollers are not elastically deformed. The reference numeral T2 indicates a contact position between the set guide 153 and the feeding roller 14, and the reference numeral T3 indicates a contact position between a front end portion 157*b* of the pushing lever 157 and the feeding roller 14. As illustrated, the contact position T2 is positioned upstream in the feeding direction from the contact position T1, and the contact position T3 is positioned upstream in the feeding direction from the contact position T2.

The reference numeral Sa indicates a path forming surface formed by the upper surface of the first frame 63.

Figure 34A:
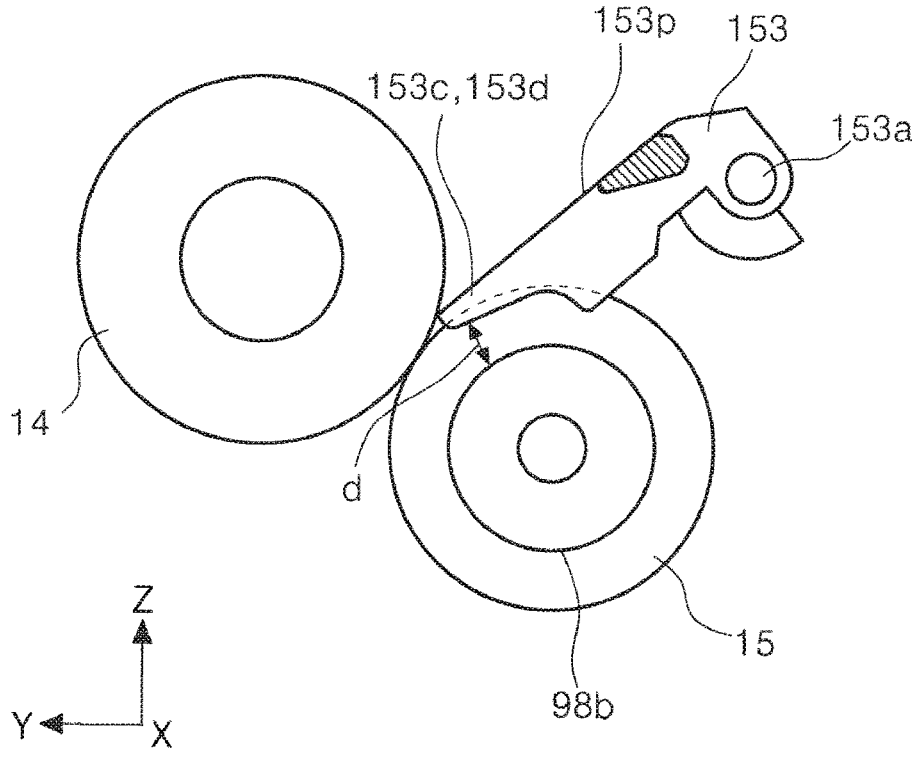
FIGS. 34A and 34B are diagrams for describing an operation of the set guide.

In FIGS. 34A to 35B, the illustration of the set flap 155 and the pushing lever 157 is omitted in order to avoid the complications in the drawings. FIG. 34A is a diagram corresponding to FIG. 33, and in this feeding standby state, a gap d is formed between the long ribs 153*c* and 153*d* of the set guide 153 and the cylindrical portion 98*b*. Since the set guide 153 advances with respect to the feeding roller 14, the document feeding path R1 toward the contact position T1 is narrowed.

Figure 34B:
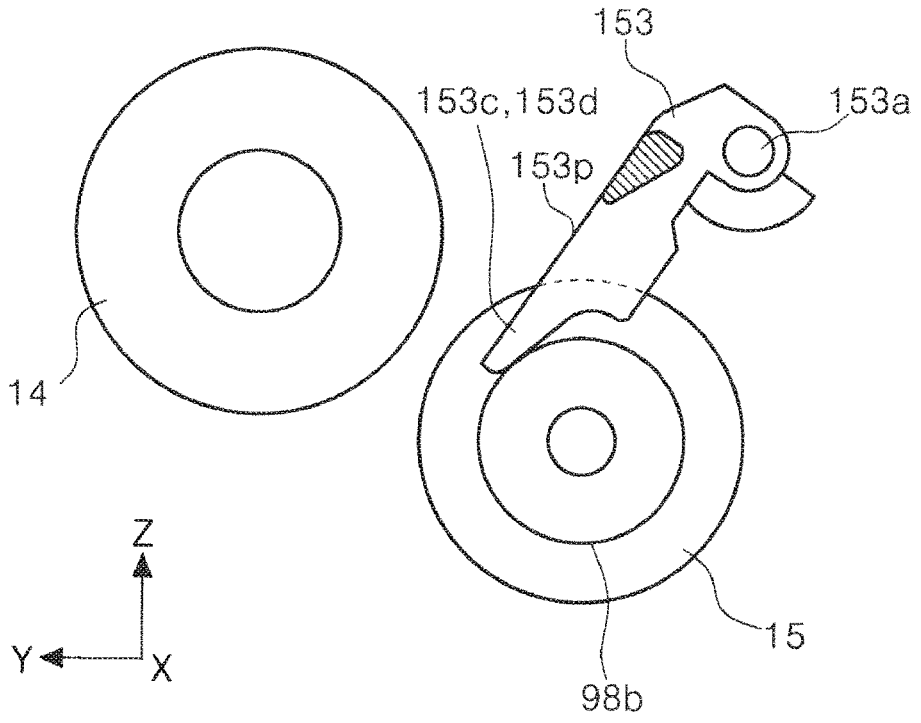

When the thickness of the document to be set exceeds a predetermined thickness, the set guide 153 has no gap d, and as illustrated in FIG. 34B, the cylindrical portion 98*b*, that is, the separation roller 15 is pushed down by the long rib 153*d*. As a result, the separation roller 15 is separated from the feeding roller 14. The engagement between the set guide 153 and the separation roller 15 has been described above.

Figure 35A:
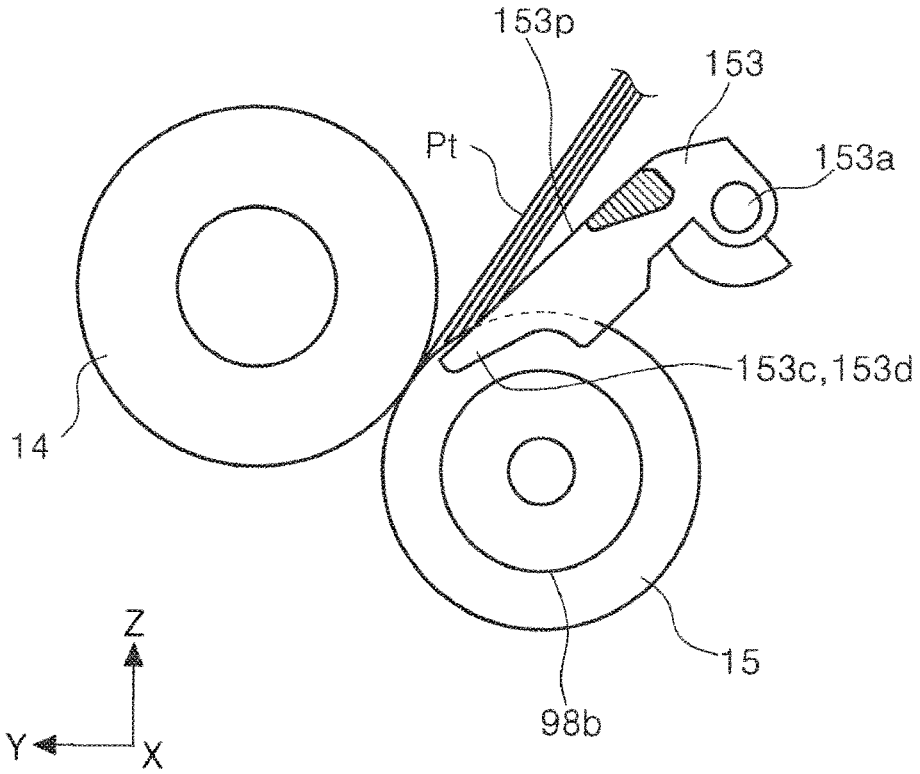
FIGS. 35A and 35B are diagrams for describing an operation of the set guide.

FIG. 35A illustrates a state in which a plurality of documents Pt having a sheet shape are placed, and in this state, the long ribs 153*c* and 153*d* are separated from the cylindrical portion 98*b* and do not push down the separation roller 15. As an example, when the thickness of a document bundle, which is composed of documents Pt having a sheet shape, is less than 2 mm, the long ribs 153*c* and 153*d* do not come into contact with the cylindrical portion 98*b*. In this state, the upper surface 153*p* of the set guide 153 applies a pre-separation action to the front end of the document Pt. The upper surface 153*p* of the set guide 153 is formed by the upper surface of the entire set guide 153 including the long ribs 153*b*, 153*c*, 153*d*, and 153*e*, and the short rib 153*f*.

Figure 35B:
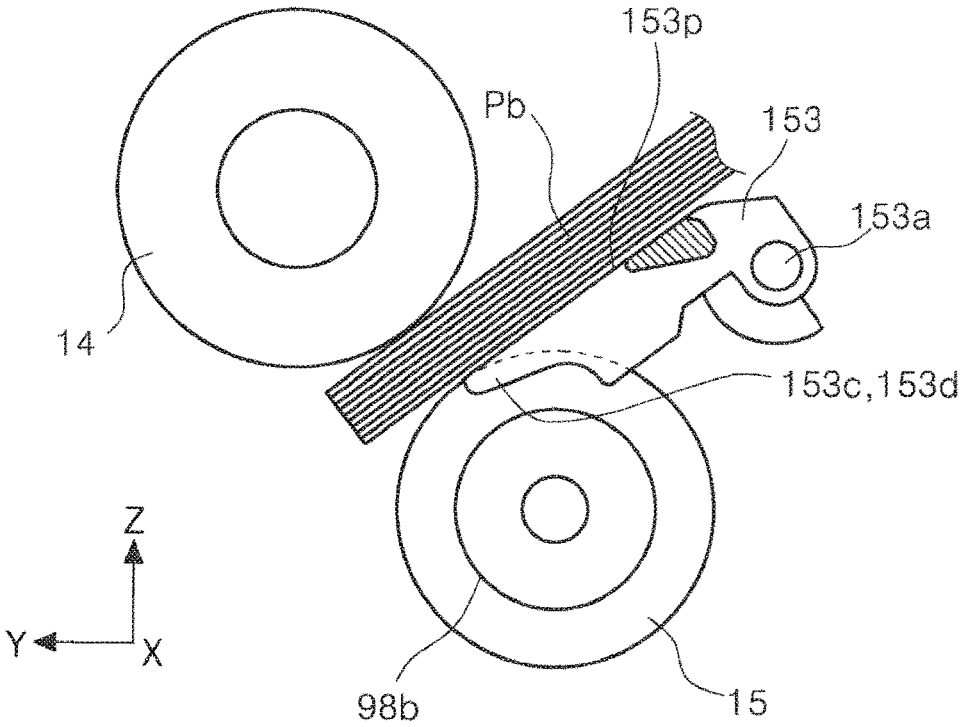

FIG. 35B illustrates a state in which the document Pb having a booklet shape is placed and then fed. In the procedure of reaching this state, the set guide 153 is pushed down by the document Pb having a booklet shape, the long ribs 153*c* and 153*d* come into contact with the cylindrical portion 98*b*, the separation roller 15 is pushed down, and a gap is formed between the feeding roller 14 and the separation roller 15. As an example, when the document Pb having a booklet shape has a thickness of 2 mm or more, the long ribs 153*c* and 153*d* contact the cylindrical portion 98*b*.

When the document Pb having a booklet shape is transported by the feeding roller 14, the separation roller 15 is pushed down by the document Pb having a booklet shape. When the document Pb having a booklet shape is nipped and transported by the feeding roller 14 and the separation roller 15, it is preferable that the long ribs 153*c* and 153*d* are separated from the cylindrical portion 98*b* as illustrated in FIG. 35B. Since the separation roller 15 is not pushed down by the set guide 153, the separation roller 15 can stably nip the document Pb having a booklet shape between the separation roller 15 and the feeding roller 14.

As described above, the scanner 1 or the document feeding apparatus 150 includes the set guide 153 upstream of the document feeding direction with respect to the contact position T1 between the feeding roller 14 and the separation roller 15. The set guide 153 is capable of advancing and retreating with respect to the feeding roller 14 in accordance with the thickness of the document and narrows the document feeding path R1 toward the contact position T1 by advancing with respect to the feeding roller 14. The set guide 153 is capable of engaging with the separation roller 15 and displaces the separation roller 15 away from the feeding roller 14 when the set guide 153 is pushed down in a direction retreating from the feeding roller 14 by a document having a thickness exceeding a predetermined thickness.

In this way, when the document having a thickness exceeding the predetermined thickness is fed, the separation roller 15 is separated from the feeding roller 14 in advance before the document enters between the separation roller 15 and the feeding roller 14, thereby it is possible to prevent a document having a thickness exceeding a predetermined thickness from hitting the separation roller 15 and being unable to be fed.

As illustrated in FIG. 35A, when the plurality of documents Pt having a sheet shape ise supported by the document supporting portion 11, the upper surface of the set guide 153 applies a separation action to the front end of the document Pt. As a result, by performing the separation by the set guide 153 prior to the separation of the documents Pt by the feeding roller 14 and the separation roller 15, the documents Pt can be separated more reliably.

The set guide 153 includes the plurality of ribs (153*b*, 153*c*, 153*d*, 153*e*, 153*f*) extending in the document feeding direction as described with reference to FIGS. 28 to 30, and the plurality of ribs are disposed to be line symmetrical about the straight line CL that is a straight line passing through the center of the document and that is parallel to the document feeding direction, in the width direction (the X axis direction) that is a direction intersecting the document feeding direction. As a result, frictional forces, which are applied to the document by the set guide 153, become equal to the left and right with respect to the straight line CL in the width direction, thereby it is possible to suppress the skew of the document.

The straight line CL passes through the center position of the feeding roller 14 and the center position of the separation roller 15 in the width direction, and the long ribs 153*c* and 153*d*, which are two ribs that are close to the straight line among the plurality of ribs, are positioned while interposing the separation roller 15 therebetween in the width direction and are positioned within the width of the feeding roller 14. As a result, the document feeding path toward the contact position T1 can be narrowed appropriately, and the number of documents toward the contact position T1 can be appropriately regulated. As a result, the separation action by the separation roller 15 can be appropriately obtained.

In the present embodiment, the separation portion disposed to face the feeding roller 14 is composed of the rotatable separation roller 15, and the set guide 153 is configured to engage with the separation roller 15 by coming into contact with the cylindrical portion 98*b* around the rotation center of the separation roller 15. As described with reference to FIGS. 34A and 34B, when the thickness of the document is equal to or thinner than a predetermined thickness, a gap d exists between the set guide 153 and the cylindrical portion 98*b*, and when the thickness of the document exceeds the predetermined thickness, the set guide 153 comes into contact with the cylindrical portion 98*b* and displaces the separation roller 15 away from the feeding roller 14. As a result, the separation roller 15 can be reliably separated from the feeding roller 14.

In the present embodiment, a configuration in which the set guide 153 pushes down the cylindrical portion 98*b* forming the outer peripheral of the torque limiter 98 has been described, but a configuration in which the set guide 153 pushes down the rotation shaft of the separation roller 15 may be used. In either case, a configuration in which the set guide 153 indirectly pushes down the separation roller 15 via another member has been described, but a configuration in which the set guide 153 directly pushes down the separation roller 15 may be used.

Figure 36A:
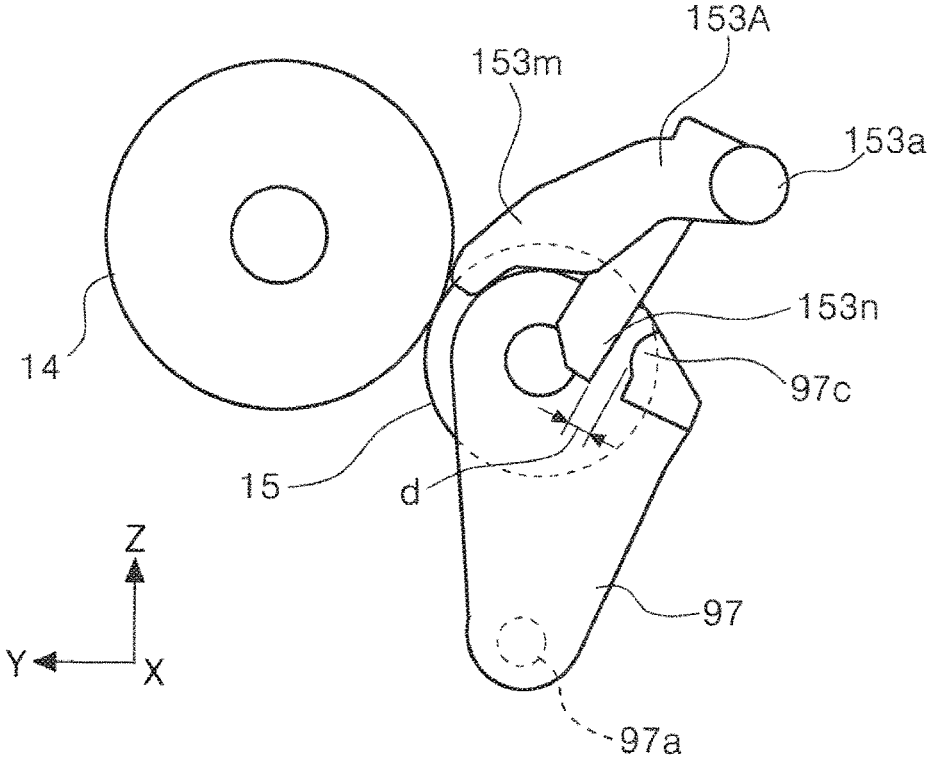
FIGS. 36A and 36B are diagrams illustrating another embodiment of a configuration in which the set guide pushes down the separation roller.
Figure 36B:
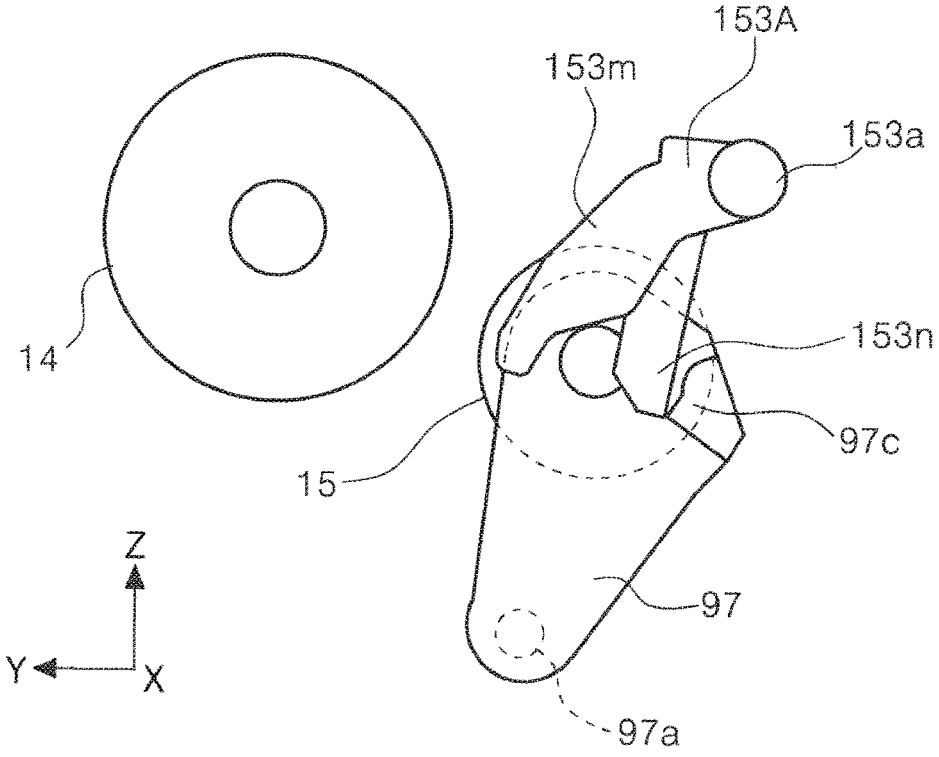

Instead of the above embodiment, as illustrated in FIGS. 36A and 36B, a configuration in which the set guide is engaged with the separation roller 15 by coming into contact with a contact portion 97*c*, which is formed in a roller holder 97 that holds the separation roller 15, may be used. In FIGS. 36A and 36B, the reference numeral 153A indicates a set guide according to another embodiment, and the set guide 153A includes a guide portion 153*m* that guides a document and a contact portion 153*n*.

FIG. 36A illustrates a state of the feeding standby state and a state in which the document is not set, and in this state, a gap d is formed between the contact portion 153*n* and the contact portion 97*c*. The guide portion 153*m* narrows the document feeding path R1 that is directed toward the contact position T1.

Since the set guide 153A is pushed down by the document to be set, the gap d disappears when the thickness of the document exceeds the predetermined thickness, and then, as illustrated in FIG. 36B, the contact portion 97*c* is pushed down by the contact portion 153*n*, the roller holder 97 swings, and the separation roller 15 is pushed down. As a result, the separation roller 15 is separated from the feeding roller 14.

Since the contact portion 97*c* is formed on the roller holder 97 in this way, the position of the contact portion 97*c* is highly flexible, and the degree of freedom in design can be improved.

Next, the movement of the pushing lever 157 will be described with reference to FIGS. 37A and 37B. The illustration of the set flap 155 is omitted in FIGS. 37A and 37B.

Figure 37A:
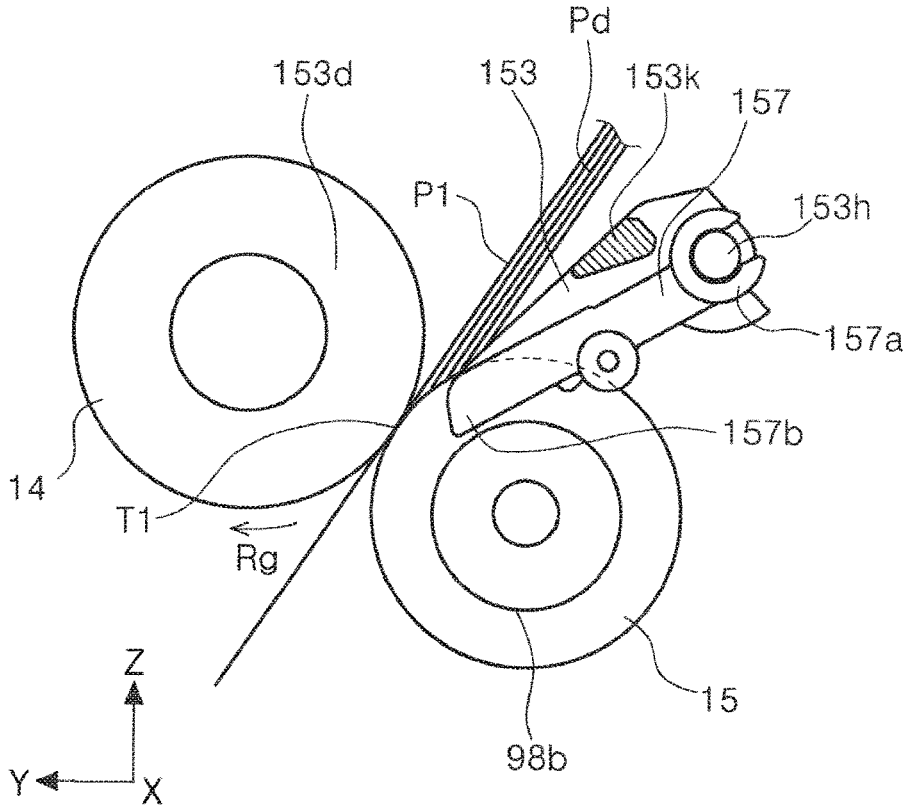
FIGS. 37A and 37B are diagrams for describing the operation of the pushing lever.
Figure 37B:
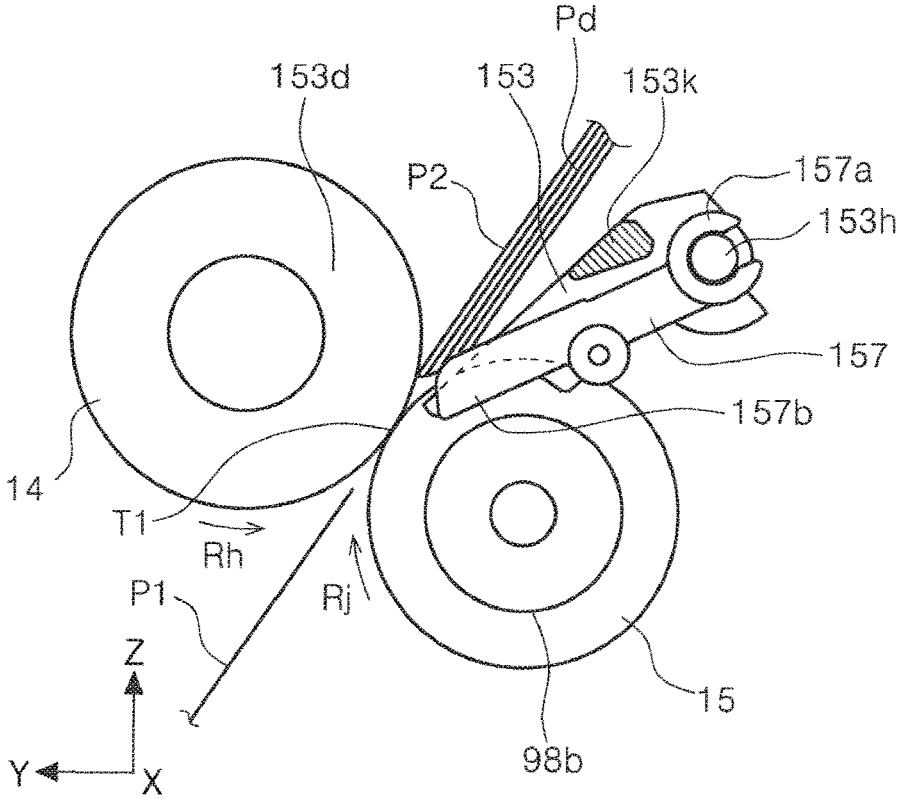

In FIGS. 37A and 37B, the reference numeral P1 indicates the document to be fed, the reference numeral Pd indicates the document bundle at the lower side of the document P1, and the reference numeral P2 indicates the uppermost medium in the document bundle Pd, which is the document to be fed following the document P1.

FIG. 37A illustrates a state in which the document P1 is being fed, and in this state, the feeding roller 14 applies a feeding force downstream in the document feeding direction with respect to the document P1 by the forward rotation of the feeding roller 14 (in an arrow Rg direction), and along with this, the document bundle Pd also tends to move downstream in the document feeding direction. Therefore, the document bundle Pd pushes down the pushing lever 157 against the spring force of the second spring 162 (see FIG. 29), and the pushing lever 157 does not protrude upward from the set guide 153.

In this state, the pushing lever 157 is not in contact with the cylindrical portion 98*b*, and the pushing lever 157 does not push down the separation roller 15. As a result, it is possible to prevent the separation roller 15 from being separated from the feeding roller 14 at an inappropriate timing.

Next, when the rear end of the document P1 passes the contact position T1 between the feeding roller 14 and the separation roller 15 from the state in FIG. 37A, spring-back occurs in the torque limiter 98 that applies a rotational load to the separation roller 15, and the separation roller 15 rotates reversely (in an arrow Rj direction).

In the present embodiment, since the feeding roller 14 is not provided with a one-way clutch, the feeding roller 14 also rotates reversely (in an arrow Rh direction) as the separation roller 15 rotates reversely.

When the feeding roller 14 is capable of freely rotating reversely, the document bundle Pd including the document P2 is vigorously returned upstream in the document feeding direction due to the reverse rotation of the feeding roller 14, thereby there is a risk that significant skewing or non-feeding may occur.

However, the pushing lever 157 is provided, and the document bundle Pd is pushed toward the feeding roller 14 by the front end portion 157*b* of the pushing lever 157 after the rear end of the fed document P1 passed through the contact position T1. As a result, the phenomenon in which the document bundle Pd is vigorously returned upstream in the document feeding direction can be suppressed, and feeding failures such as skewing or non-feeding can be suppressed.

In particular, in the present embodiment, since a configuration in which the document that is supported by the document supporting portion 11 is fed from the uppermost document is used, the uppermost document P2, which tends to be returned upstream in the document feeding direction due to the reverse rotation of the feeding roller 14, is likely to be skewed and is likely to be returned upstream in the document feeding direction. However, due to the action of the pushing lever 157 described above, the phenomenon in which the document P2 is vigorously returned upstream in the document feeding direction can be suppressed, and feeding failures such as skewing or non-feeding can be suppressed.

In the present embodiment, the pushing lever 157 rotates around the shaft portion 153*h*, which serves as a rotation shaft, so that the front end portion 157*b* advances and retreats with respect to the feeding roller 14, and the shaft portion 153*h* is positioned upstream in the document feeding direction with respect to the front end portion 157*b*. When the document is about to be returned upstream in the document feeding direction due to the reverse rotation of the feeding roller 14, when the pushing lever 157, which is in contact with the document, easily rotates in the clockwise direction in FIG. 37, the document is easily returned upstream in the document feeding direction. However, since the shaft portion 153*h* is positioned upstream in the document feeding direction with respect to the front end portion 157*b*, the pushing lever 157, which comes into contact with the document, is difficult to rotate, and the phenomenon in which the document is returned upstream due to the reverse rotation of the feeding roller 14 can be effectively suppressed.

The set guide 153 is also provided with the regulation portion 153*k* that regulates the rotation limit of the pushing lever 157 in a direction in which the front end portion 157*b* of the pushing lever 157 advances toward the feeding roller 14. As a result, the rotation of the pushing lever 157 in the clockwise direction in FIGS. 37A and 37B is more reliably suppressed, and the phenomenon in which the document is returned upstream due to the reverse rotation of the feeding roller 14 can be effectively suppressed.

In the present embodiment, as described with reference to FIG. 30, the pushing lever 157 is provided within the width of the feeding roller 14 in the X axis direction, that is, the width direction that is a direction intersecting the document feeding direction. As a result, the pushing lever 157 can reliably push the document against the feeding roller 14, and the phenomenon in which the medium is returned upstream due to the reverse rotation of the feeding roller 14 can be more reliably suppressed.

Further, in the present embodiment, the pushing levers 157 are provided at both end portions of the feeding roller 14 in the width direction. As a result, the skew when the document is about to be returned upstream due to the reverse rotation of the feeding roller 14 can be suppressed.

Figure 38:
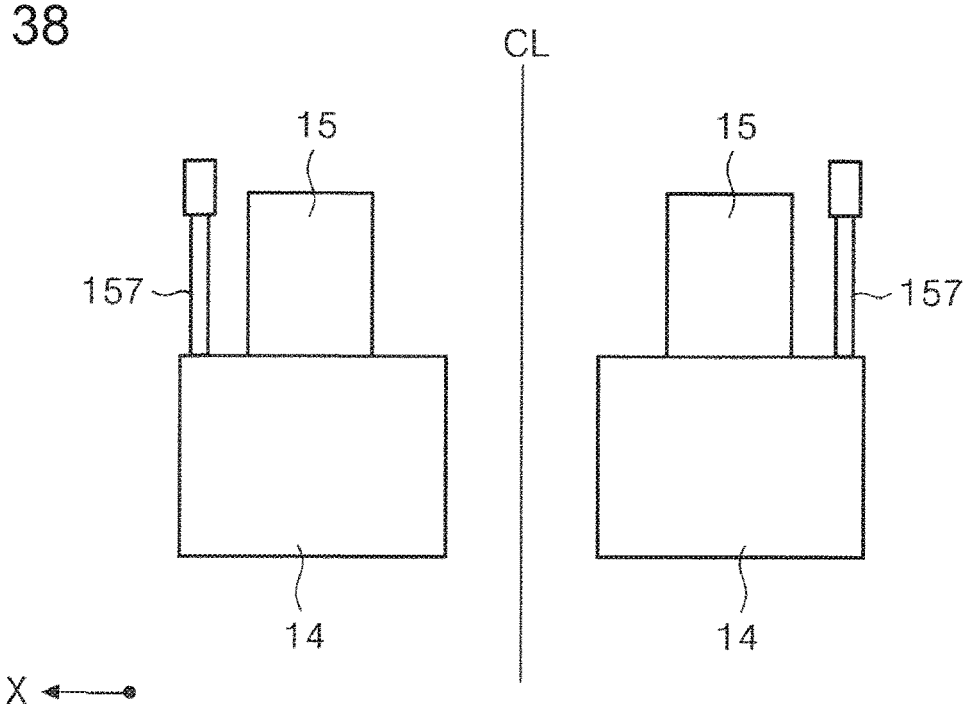
FIG. 38 is a diagram illustrating an example of a disposition of the pushing levers when a plurality of feeding rollers is provided.

When a plurality of feeding rollers 14 are provided in the X axis direction as illustrated in FIG. 38, the pushing levers 157 are preferably provided at both end portions of the plurality of feeding rollers 14 as a whole. As a result, it is possible to suppress the skew when the document is about to be returned upstream.

Instead of the configuration in which the plurality of pushing levers 157 are provided, for example, one pushing lever 157 may be provided at the central position in the X axis direction.

In the present embodiment, the plurality of pushing levers 157 are capable of independently advancing and retreating with respect to the feeding roller 14. When the plurality of pushing levers 157 are configured to advance and retreat integrally, a difference in the pressed state of the documents by each of the plurality of pushing levers 157 may occur, thereby there is a risk that the skew of the document may occur. For example, when one pushing lever 157 comes into contact with the document and the other pushing lever 157 does not come into contact with the document, the skew of the document occurs. However, in the present embodiment, the plurality of pushing levers 157 can independently advance and retreat with respect to the feeding roller 14, so that each of the plurality of pushing levers 157 can appropriately push the document, and the skewing can be suppressed.

In the present embodiment, as described with reference to FIG. 33, since the contact position T3 where the pushing lever 157 comes into contact with the feeding roller 14 is positioned upstream of the contact position T2 where the set guide 153 comes into contact with the feeding roller 14, when the document is about to be returned upstream due to the reverse rotation of the feeding roller 14, the document can be pushed for a longer period of time, and the phenomenon in which the document is returned upstream due to the reverse rotation of the feeding roller 14 can be more reliably suppressed.

Further, since the force of the second spring 162 pressing the pushing lever 157 is smaller than the force of the first spring 161 pressing the set guide 153, when the document is fed, the pushing lever 157 can easily retreat from the document feeding path, and it is possible to prevent the pushing lever 157 from interfering with the feeding of the document.

Figure 39:
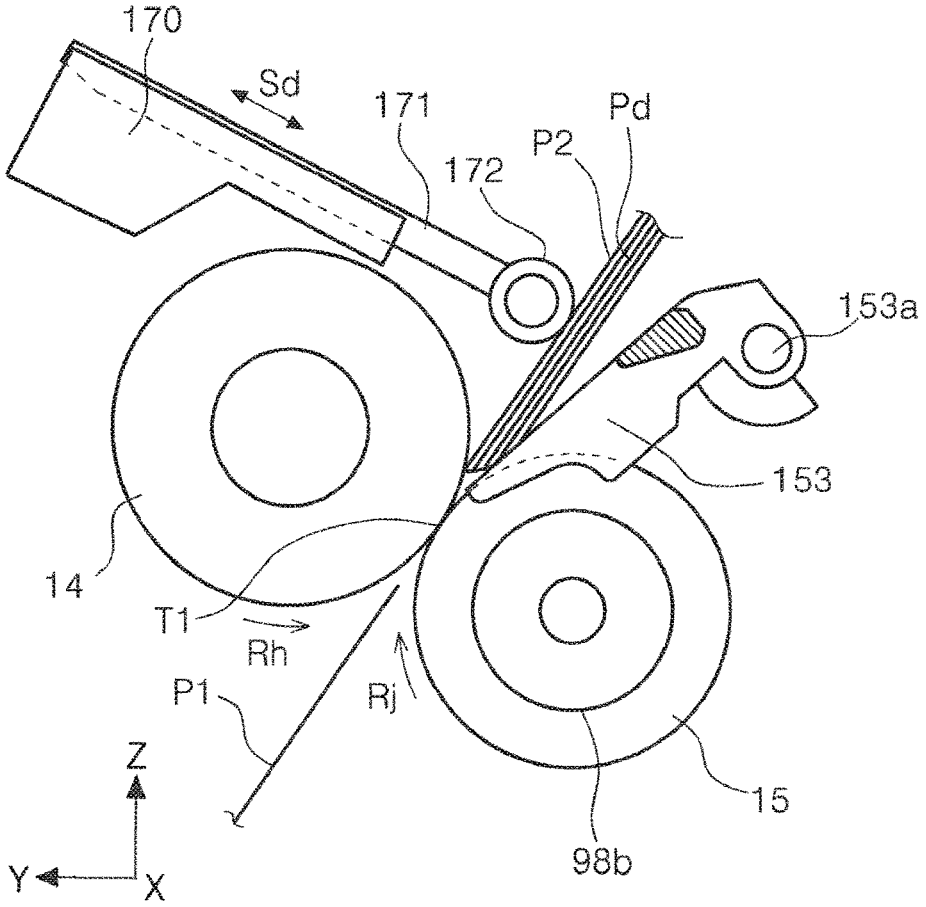
FIG. 39 is a diagram illustrating still another embodiment of a pushing portion.

A pushing portion, which is capable of pushing the document against the feeding roller 14, can also be configured as illustrated in FIG. 39. In FIG. 39, an arm portion 171 is provided in an arrow Sd direction with respect to a supporting portion 170 in a slidable manner, and a driven roller 172 is provided at the front end of the arm portion 171. The arm portion 171 is pressed in an advancing direction toward the document by a spring (not shown), and the driven roller 172 is pressed against the document and comes into contact with the document. As a result, when the feeding roller 14 rotates reversely (the arrow Rh direction), the phenomenon in which the document bundle Pd is vigorously returned upstream in the document feeding direction can be suppressed, and feeding failures such as skewing or non-feeding can be suppressed. The driven roller 172 reduces the feeding load applied to the fed document.

The present disclosure is not limited to the embodiments described above, and various modifications can be made within the scope of the disclosure described in the claims, and needless to say, the various modifications are also included in the scope of the present disclosure.

Further, although the above-described embodiments have been described as an example applied to an image reading apparatus represented by a scanner, embodiments can also be applied to a recording apparatus represented by a printer. That is, by using the document in the above embodiments as a recording target medium and using the reading portion as a recording portion that performs recording on the recording target medium, the same effect as those in the above-described embodiments can be obtained in the recording apparatus. An ink jet printer is an example of the recording apparatus, and an ink jet type recording head is an example of the recording portion.

What is claimed is:

1. A medium feeding apparatus comprising:

a medium supporting portion supporting a medium;

a feeding roller that comes into contact with an upper surface of the medium supported by the medium supporting portion;

a separation portion disposed to face the feeding roller and configured to advance and retreat with respect to the feeding roller;

a path forming member that is a member positioned upstream in a medium feeding direction with respect to a contact position between the feeding roller and the separation portion, that is configured to advance and retreat with respect to the feeding roller in accordance with a thickness of the medium, and that is configured to narrow a medium feeding path directed toward the contact position by advancing with respect to the feeding roller;

the separation portion is held by a holding member that is configured to advance and retreat with respect to the feeding roller;

a first pressing portion that presses the path forming member toward the feeding roller; and a second pressing portion that is separate from the first pressing portion and that presses the holding member toward the feeding roller, wherein the path forming member is configured to displace the separation portion in a direction away from the feeding roller when the path forming member is pushed down in a direction retreating from the feeding roller by a medium having a thickness exceeding a predetermined thickness.

2. The medium feeding apparatus according to claim 1, wherein when a plurality of media are supported by the medium supporting portion, an upper surface of the path forming member applies a separation action to front ends of the plurality of medium.

3. The medium feeding apparatus according to claim 1, wherein the path forming member includes a plurality of ribs extending in the medium feeding direction, and the plurality of ribs is disposed in a width direction that is a direction intersecting the medium feeding direction to be line symmetrical about a straight line that passes through a center of the medium and that is parallel to the medium feeding direction.

4. The medium feeding apparatus according to claim 3, wherein the straight line passes through a center position of the feeding roller and a center position of the separation portion in the width direction, and two ribs, among the plurality of ribs, that are close to the straight line in the width direction are positioned while interposing the separation portion therebetween in the width direction and are positioned within a width of the feeding roller in the width direction.

5. The medium feeding apparatus according to claim 1, wherein the separation portion is composed of a separation roller configured to rotate, the path forming member is configured to be engaged with the separation portion by coming into contact with a cylindrical portion centered on a rotation center of the separation roller, a gap exists between the path forming member and the cylindrical portion when the thickness of the medium is equal to or thinner than the predetermined thickness, and the path forming member comes into contact with the cylindrical portion and displaces the separation roller in the direction away from the feeding roller when the thickness of the medium exceeds the predetermined thickness.

6. The medium feeding apparatus according to claim 5, further comprising:

a pushing portion that is a member configured to advance and retreat with respect to the feeding roller upstream in the medium feeding direction with respect to the contact position between the feeding roller and the separation roller, and that is configured to push a second medium, which is set on the medium supporting portion and to be fed following a first medium, toward the feeding roller after a rear end of the first medium to be fed passed through the contact position; and a third pressing portion pressing the pushing portion toward the feeding roller.

7. The medium feeding apparatus according to claim 1, wherein the separation portion is composed of a separation roller configured to rotate, the path forming member is engaged with the separation portion by coming into contact with a rotation shaft of the separation roller, a gap exists between the path forming member and the rotation shaft when the thickness of the medium is equal to or thinner than the predetermined thickness, and the path forming member comes into contact with the rotation shaft and displaces the separation roller in the direction away from the feeding roller when the thickness of the medium exceeds the predetermined thickness.

8. The medium feeding apparatus according to claim 1, wherein the path forming member is engaged with the separation portion by coming into contact with a contact portion formed on the holding member, a gap exists between the path forming member and the contact portion when the thickness of the medium is equal to or thinner than the predetermined thickness, and the path forming member comes into contact with the contact portion and displaces the separation portion in the direction away from the feeding roller when the thickness of the medium exceeds the predetermined thickness.

9. The medium feeding apparatus according to claim 1, further comprising:

a pushing portion that is a member configured to advance and retreat with respect to the feeding roller upstream in the medium feeding direction with respect to the contact position between the feeding roller and the separation portion that is composed of a separation roller configured to rotate, and that is configured to push a second medium, which is supported by the medium supporting portion and to be fed following a first medium, toward the feeding roller after a rear end of the first medium to be fed passed through the contact position; and a third pressing portion pressing the pushing portion toward the feeding roller.

10. The medium feeding apparatus according to claim 9, wherein the pushing portion rotates around a rotation shaft so that a front end portion of the pushing portion advances and retreats with respect to the feeding roller, and the rotation shaft is positioned upstream in the medium feeding direction with respect to the front end portion.

11. The medium feeding apparatus according to claim 10, further comprising:

a regulation portion regulating a rotation limit of the pushing portion in a direction in which the front end portion advances to the feeding roller.

12. The medium feeding apparatus according to claim 9, wherein the pushing portion is provided within an area of the feeding roller in a width direction that is a direction intersecting the medium feeding direction.

13. The medium feeding apparatus according to claim 12, wherein the pushing portion is positioned at both end portions of the feeding roller in the width direction.

14. The medium feeding apparatus according to claim 13, wherein the pushing portion has at least two levers, each of which is configured to independently advance and retreat with respect to the feeding roller.

15. The medium feeding apparatus according to claim 9, wherein in a feeding standby state, the path forming member and the pushing portion come into contact with the feeding roller, and a position where the pushing portion comes into contact with the feeding roller is positioned upstream of a position where the path forming member comes into contact with the feeding roller in the medium feeding direction.

16. The medium feeding apparatus according to claim 9, wherein a force of the third pressing portion pressing the pushing portion is smaller than a force of the first pressing portion pressing the path forming member.

17. The medium feeding apparatus according to claim 1, further comprising:

a main body supporting portion placed on a placement surface of the apparatus; and an apparatus main body supported by the main body supporting portion, wherein the separation portion is composed of a separation roller configured to rotate, the apparatus main body is rotatably attached to the main body supporting portion and is configured to be switched by rotation of the apparatus main body between a first posture and a second posture in which an angle formed by the medium feeding path with the placement surface is smaller than that of the first posture, a separation switching section is provided, the separation switching section being configured to switch between a separation state in which the separation roller separates media and a non-separation state in which the separation roller does not separate media, and the separation switching section puts the separation roller in the separation state when the apparatus main body is in the first posture and puts the separation roller in the non-separation state when the apparatus main body is in the second posture.

18. An image reading apparatus comprising:

the medium feeding apparatus according to claim 1; and a reading portion reading the medium fed by the medium feeding apparatus.

* * * * *